US011173930B2

(12) United States Patent
Ren et al.

(10) Patent No.: US 11,173,930 B2
(45) Date of Patent: Nov. 16, 2021

(54) RAIL TRANSPORT SYSTEM

(71) Applicant: BYD COMPANY LIMITED, Guangdong (CN)

(72) Inventors: Lin Ren, Shenzhen (CN); Hao Zeng, Shenzhen (CN); Junjie Liu, Shenzhen (CN); Fanghong Peng, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 261 days.

(21) Appl. No.: 16/335,160

(22) PCT Filed: Feb. 28, 2017

(86) PCT No.: PCT/CN2017/075164

§ 371 (c)(1),
(2) Date: Mar. 20, 2019

(87) PCT Pub. No.: WO2018/053996

PCT Pub. Date: Mar. 29, 2018

(65) Prior Publication Data

US 2019/0225243 A1 Jul. 25, 2019

(30) Foreign Application Priority Data

Sep. 21, 2016 (CN) ..... 201610836496.5

(51) Int. Cl.
*B61F 5/52* (2006.01)
*B61F 3/00* (2006.01)
(Continued)

(52) U.S. Cl.
CPC ..... *B61F 5/52* (2013.01); *B61B 5/02* (2013.01); *B61B 13/04* (2013.01); *B61B 13/06* (2013.01);
(Continued)

(58) Field of Classification Search
CPC ..... B61F 5/52; B61F 3/00; B61F 9/00; B61B 5/02; B61B 13/04; B61B 13/06; B61D 19/023; E01B 25/10
See application file for complete search history.

(56) References Cited

U.S. PATENT DOCUMENTS 4,061,089 A * 12/1977 Sawyer ..... B60L 5/005 104/23.2
4,587,906 A * 5/1986 Coester ..... B61C 11/06 104/156
(Continued)

FOREIGN PATENT DOCUMENTS

BR 102012002851 A2 10/2013
CN 1914079 A 2/2007
(Continued)

OTHER PUBLICATIONS

PCT International Search Report and the Written Opinion dated Jul. 10, 2017, issued in related International Application No. PCT/CN2017/075164 (7 pages).
(Continued)

*Primary Examiner* — Jason C Smith

(57) ABSTRACT

A rail transport system includes a rail (10) provided with a first concave portion built thereon, and a rail vehicle comprising a bogie (21) and a vehicle body (22). The bogie (21) has a second concave portion (110) for straddling the rail (10), the bogie (21) movably straddles the rail (10), and the vehicle body (22) is connected to the bogie (21) and is pulled by the bogie (21) to run along the rail (10). The rail transport system according to embodiments of the present disclosure has the advantages of simple structure, low cost, small occupied space, and high stability.

17 Claims, 61 Drawing Sheets

(51) Int. Cl.

| | |
|---|---|
| ***B61F 9/00*** | (2006.01) |
| ***B61B 13/04*** | (2006.01) |
| ***B61B 5/02*** | (2006.01) |
| ***B61B 13/06*** | (2006.01) |
| ***B61D 19/02*** | (2006.01) |
| ***E01B 25/10*** | (2006.01) |

(52) U.S. Cl.
CPC ..... *B61D 19/023* (2013.01); *B61F 3/00* (2013.01); *B61F 9/00* (2013.01); *E01B 25/10* (2013.01)

(56) References Cited

U.S. PATENT DOCUMENTS

| | | | | | |
|---|---|---|---|---|---|
| 4,658,732 | A * | 4/1987 | Coester | B61C 11/06 | 104/156 |
| 4,823,704 | A * | 4/1989 | Fujita | E01B 25/00 | 104/247 |
| 5,174,219 | A * | 12/1992 | Streiff | B61B 9/00 | 104/119 |
| 5,445,080 | A * | 8/1995 | Austin | B61B 13/04 | 104/119 |
| 5,845,582 | A * | 12/1998 | Coester | B61B 13/122 | 104/156 |
| 6,076,469 | A * | 6/2000 | Coester | B61B 13/122 | 104/138.1 |
| 6,763,766 | B1 * | 7/2004 | Cornellier | B61B 5/02 | 104/124 |
| 2001/0037747 | A1 * | 11/2001 | Svensson | B60L 13/06 | 104/120 |
| 2002/0162478 | A1 * | 11/2002 | Henderson | E01B 25/28 | 104/124 |
| 2009/0293758 | A1 * | 12/2009 | Timan | B61G 5/02 | 104/245 |
| 2010/0186620 | A1 * | 7/2010 | Rodet | B61D 13/00 | 105/182.1 |
| 2011/0056405 | A1 * | 3/2011 | Coester | B61B 13/122 | 104/124 |
| 2014/0158013 | A1 * | 6/2014 | Diebel | B60L 13/00 | 104/118 |
| 2018/0208218 | A1 * | 7/2018 | Gao | B61F 5/50 | |
| 2019/0225243 | A1 * | 7/2019 | Ren | B61B 13/04 | |
| 2019/0249372 | A1 * | 8/2019 | Ren | E01B 25/00 | |
| 2019/0276052 | A1 * | 9/2019 | Zhao | B60L 5/39 | |
| 2019/0276053 | A1 * | 9/2019 | Zhao | B61C 3/02 | |
| 2019/0300023 | A1 * | 10/2019 | Ren | B61C 9/50 | |

FOREIGN PATENT DOCUMENTS

| | | | |
|---|---|---|---|
| CN | 101678841 | A | 3/2010 |
| CN | 201538325 | U | 8/2010 |
| CN | 102076545 | A | 5/2011 |
| CN | 201923132 | U | 8/2011 |
| CN | 202029847 | U | 11/2011 |
| CN | 102303611 | A | 1/2012 |
| CN | 202879489 | U | 4/2013 |
| CN | 104527660 | A | 4/2015 |
| CN | 204432660 | U | 7/2015 |
| CN | 105035098 | A | 11/2015 |
| CN | 204871031 | U | 12/2015 |
| CN | 204978684 | U | 1/2016 |
| CN | 105730458 | A | 7/2016 |
| CN | 205365593 | U | 7/2016 |
| CN | 205440382 | U | 8/2016 |
| DE | 4322369 | A1 | 1/1995 |
| JP | S52-069118 | A | 6/1977 |
| JP | 2007-069751 | A | 3/2007 |
| KR | 100785593 | B1 | 12/2007 |
| KR | 20120059292 | A | 6/2012 |
| KR | 20150012177 | A | 2/2015 |
| KR | 20150012178 | A | 2/2015 |
| RU | 2012155024 | A | 6/2014 |

OTHER PUBLICATIONS

Office Action for Chinese Application No. 201610836496.5, dated Jun. 5, 2018, 10 pages.
Office Action for Chinese Application No. 201610836496.5, dated Mar. 5, 2019, 12 pages.
Search Report for European Application No. 17852075.5, dated Aug. 6, 2019, 5 pages.

* cited by examiner

RAIL TRANSPORT SYSTEM

CROSS-REFERENCE TO RELATED APPLICATIONS

This application is a national phase application of International Application No. PCT/CN2017/075164, filed on Feb. 28, 2017, which is based on and claims priority to and benefits of Chinese Patent Application No. 201610836496.5, filed with the State Intellectual Property Office (SIPO) of the People's Republic China on Sep. 21, 2016. The entire contents of the above-identified applications are incorporated herein by reference.

FIELD

The present disclosure relates to the field of transport technologies, and more particularly to a rail transport system.

BACKGROUND

A rail transport system such as a straddle-type monorail train has a complex structure and a relatively high cost, occupies relatively large space, and has potential hazards in stability.

In a straddle-type monorail train in the prior art, an independent escape passage is disposed to evacuate passengers in an emergency. Specifically, a structure is additionally disposed on a rail. The structure is usually connected to a side portion of the rail and extends outside. A floor is then laid on the structure to form a passage for evacuating passengers.

The inventor of this application finds through a large amount of research and experiments that the structure of the foregoing escape passage is the reason why a straddle-type monorail train in which an escape passage is disposed in the prior art has disadvantages such as a high cost, large occupied space and potential stability hazards. Specific reasons are as follows:

Both the structure and the floor that is laid on the structure are additionally structures independent of a rail, and when a rail vehicle is running, a specific location where an emergency occurs is unpredictable. Therefore, an escape passage having such a structure needs to be additionally disposed throughout the rail in a lengthwise direction (except for the platform). In this case, the workload is huge, and therefore, a cost is greatly increased. Moreover, the structure and the floor are located at the side portion of the rail, that is, an additional portion extends in a width direction of the rail, so that a large amount of space is occupied. In addition, the structure and the floor have weights. Regardless of whether the rail vehicle encounters an emergency, both the structure and the floor are mounted on the rail. That is, even though the rail vehicle runs normally, the rail still needs to bear the weights of the structure and the floor. In this case, the weight of the rail is increased, and the stability of the rail is adversely affected.

SUMMARY

Embodiments of the present disclosure seek to solve at least one of the problems existing in the related art to at least some extent.

To achieve the foregoing objective, according to an embodiment of the present disclosure, a rail transport system is proposed, including: a rail, provided with a concave portion built thereon; and a rail vehicle, the rail vehicle including a bogie and a vehicle body, the bogie having a second concave portion for straddling the rail, the bogie movably straddling the rail, and the vehicle body being connected to the bogie and being pulled by the bogie to run along the rail.

The rail transport system according to this embodiment of the present disclosure has advantages such as a structure simple, a low cost, small occupied space, light load on a rail, and high stability.

In addition, the rail transport system according to this embodiment of the present disclosure may further have the following additional technical features.

According to an embodiment of the present disclosure, the first concave portion is configured to be an escape passage.

According to an embodiment of the present disclosure, the vehicle body includes a plurality of carriages sequentially hinged in a lengthwise direction of the rail. An emergency door that can be opened and closed is disposed on a surface, opposite an adjacent carriage, of a carriage that is located at least one end of the vehicle body in the lengthwise direction of the rail. A first end of the emergency door is pivotably mounted on a corresponding carriage. A second end of the emergency door slants downwards and is inserted in an escape passage when the emergency door is open.

According to an embodiment of the present disclosure, a slideway is disposed on an inner surface of the emergency door.

According to an embodiment of the present disclosure, the vehicle body includes a plurality of carriages that are sequentially hinged in the lengthwise direction of the rail. An emergency door that can be opened and closed is disposed on a surface, opposite an adjacent carriage, of a carriage that is located at least one end of the vehicle body in the lengthwise direction of the rail. An emergency exit and a cover plate are disposed on an inner floor of the carriage that is located at the at least one end of the vehicle body. The cover plate and the emergency door are linked and used to open and close the emergency exit. When the emergency door is open, the cover plate opens the emergency exit. When the emergency door is closed, the cover plate closes the emergency exit.

According to an embodiment of the present disclosure, the emergency exit has an escape ladder connected to the escape passage.

According to an embodiment of the present disclosure, the escape ladder has a telescopic driving device configured to drive the escape ladder to extend or retract.

According to an embodiment of the present disclosure, the rail includes: a first track beam; a second track beam, the first track beam and the second track beam being disposed in parallel and at an interval; and a bearing floor, the bearing floor being disposed between the first track beam and the second track beam and being connected to the first track beam and the second track beam, the first track beam, and the escape passage being defined between the second track beam and the bearing floor.

According to an embodiment of the present disclosure, the bearing floor includes: a connecting beam, two ends of the connecting beam being respectively connected to the first track beam and the second track beam; a support frame, the support frame being mounted on the connecting beam; and a support plate, the support plate being connected on the support frame and being supported by the support frame, and the support plate forming a bottom surface of the escape passage.

According to an embodiment of the present disclosure, the support plate is disposed at an interval from at least one of the first track beam and the second track beam in a horizontal direction.

According to an embodiment of the present disclosure, a plurality of connecting beams exist and are disposed at an interval in the lengthwise direction of the rail, and a plurality of support plates exist and are sequentially connected in the lengthwise direction of the rail.

According to an embodiment of the present disclosure, an anti-falling edge is disposed at least one end of an upper end and a lower end of at least one of the first track beam and the second track beam, and the anti-falling edge extends outwards horizontally and is used to prevent the bogie from falling off the rail.

According to an embodiment of the present disclosure, the bogie includes: a bogie frame, the bogie frame having a rail concave portion that straddles the rail; a first running wheel and a second running wheel, the first running wheel and the second running wheel being pivotably mounted on the bogie frame and being disposed coaxially and at an interval, the first running wheel being fit on an upper surface of the first track beam, the second running wheel being fit on an upper surface of the second track beam; and a driving device, the driving device being mounted on the bogie frame and being located between the first running wheel and the second running wheel, and the first running wheel and the second running wheel being driven by the driving device.

According to an embodiment of the present disclosure, the bogie includes: a bogie frame, the bogie frame having a rail concave portion that straddles the rail; a first running wheel and a second running wheel, the first running wheel and the second running wheel being pivotably mounted on the bogie frame and being disposed coaxially and at an interval, the first running wheel being fit on an upper surface of the first track beam, and the second running wheel being fit on an upper surface of the second track beam; a third running wheel and a fourth running wheel, the third running wheel and the fourth running wheel being pivotably mounted on the bogie frame and being disposed coaxially and at an interval, the third running wheel being fit on the upper surface of the first track beam and being disposed at an interval from the first running wheel in a lengthwise direction of the first track beam, and the fourth running wheel being fit on the upper surface of the second track beam and being disposed at an interval from the second running wheel in a lengthwise direction of the second track beam; and a driving device, the driving device being mounted on the bogie frame, the driving device being located between the first running wheel and the second running wheel and/or the driving device being located between the third running wheel and the fourth running wheel, and the first running wheel and the second running wheel being driven by the driving device and/or the third running wheel and the fourth running wheel being driven by the driving device.

According to an embodiment of the present disclosure, the first running wheel and the second running wheel are connected through a first connecting shaft and/or the third running wheel and the fourth running wheel are connected through a second connecting shaft, and the driving device has a transmission connection to the first connecting shaft and/or the second connecting shaft.

According to an embodiment of the present disclosure, the driving device includes a first driving device and a second driving device, the first driving device being located between the first running wheel and the second running wheel, the first running wheel and the second running wheel being driven by the first driving device, the second driving device being located between the third running wheel and the fourth running wheel, the third running wheel and the fourth running wheel being driven by the second driving device, the first driving device being closer to the first running wheel than to the second running wheel, and/or the second driving device being closer to the fourth running wheel than to the third running wheel.

According to an embodiment of the present disclosure, the bogie further includes: several first horizontal wheels, the several first horizontal wheels being pivotably mounted on the bogie frame and being fit on a side surface of the first track beam; and several second horizontal wheels, the several second horizontal wheels being pivotably mounted on the bogie frame and being fit on a side surface of the second track beam.

According to an embodiment of the present disclosure, the first horizontal wheel is connected to a first horizontal safety wheel that moves synchronously with the first horizontal wheel and has an outer diameter less than an outer diameter of the first horizontal wheel, and the second horizontal wheel is connected to a second horizontal safety wheel that moves synchronously with the second horizontal wheel and has an outer diameter less than an outer diameter of the second horizontal wheel.

According to an embodiment of the present disclosure, the several first horizontal wheels and the several second horizontal wheels are located at a same height in a vertical direction.

According to an embodiment of the present disclosure, a plurality of first horizontal wheels exist and are disposed at an interval and coaxially in a vertical direction, and a plurality of second horizontal wheels exist and are disposed at an interval and coaxially in a vertical direction.

According to an embodiment of the present disclosure, a plurality of first horizontal wheels exist and are disposed at an interval in a vertical direction and the lengthwise direction of the first track beam respectively, and a plurality of second horizontal wheels exist and are disposed at an interval in a vertical direction and the lengthwise direction of the second track beam respectively.

According to an embodiment of the present disclosure, the several first horizontal wheels are fit on an outer side surface of the first track beam, and the several second horizontal wheels are fit on an outer side surface of the second track beam.

According to an embodiment of the present disclosure, the several first horizontal wheels are fit on an inner side surface of the first track beam, and the several second horizontal wheels are fit on an inner side surface of the second track beam.

According to an embodiment of the present disclosure, a plurality of first horizontal wheels exist and are fit on an outer side surface and an inner side surface of the first track beam respectively, and a plurality of second horizontal wheels exist and are fit on an outer side surface and an inner side surface of the second track beam respectively.

According to an embodiment of the present disclosure, the first horizontal wheels that are fit on the inner side surface of the first track beam and the second horizontal wheels that are fit on the inner side surface of the second track beam are located at different heights in a vertical direction.

According to an embodiment of the present disclosure, the bogie further includes: a first current collector shoe, the first current collector shoe being disposed on the bogie frame, a first conductive rail being disposed on an outer side surface of the first track beam, and the first current collector shoe drawing electricity through the first conductive rail; and a second current collector shoe, the second current collector shoe being disposed on the bogie frame, a second conductive rail being disposed on an outer side surface of the second track beam, and the second current collector shoe drawing electricity through the second conductive rail.

According to an embodiment of the present disclosure, a plurality of first horizontal wheels exist and are disposed at an interval in the lengthwise direction of the first track beam, the first current collector shoe is located between adjacent first horizontal wheels in the lengthwise direction of the first track beam, a plurality of second horizontal wheels exist and are disposed at an interval in the lengthwise direction of the second track beam, and the second current collector shoe is located between adjacent second horizontal wheels in the lengthwise direction of the second track beam.

According to an embodiment of the present disclosure, a plurality of first horizontal wheels exist and are disposed at an interval in the lengthwise direction of the first track beam, the first current collector shoe and one of the plurality of first horizontal wheels are disposed right opposite in a vertical direction, a plurality of second horizontal wheels exist and are disposed at an interval in the lengthwise direction of the second track beam, and the second current collector shoe and one of the plurality of second horizontal wheels are disposed right opposite in a vertical direction.

According to an embodiment of the present disclosure, the first current collector shoe is above located the several first horizontal wheels, and the second current collector shoe is located above the several second horizontal wheels.

According to an embodiment of the present disclosure, the first current collector shoe is located below the several first horizontal wheels, and the second current collector shoe is located below the several second horizontal wheels.

According to an embodiment of the present disclosure, the first current collector shoe is located below the several first horizontal wheels, and the second current collector shoe is located above the several second horizontal wheels.

According to an embodiment of the present disclosure, a plurality of first horizontal wheels exist and are disposed at an interval in a vertical direction, the first current collector shoe is located between adjacent first horizontal wheels in a vertical direction, a plurality of second horizontal wheels exist and are disposed at an interval in a vertical direction, and the second current collector shoe are located between adjacent second horizontal wheels in a vertical direction.

According to an embodiment of the present disclosure, a power battery used to supply power for the rail vehicle to travel is disposed at the rail vehicle.

According to an embodiment of the present disclosure, the bogie further includes: a first support suspension device and a second support suspension device, the first support suspension device and the second support suspension device being mounted on the bogie frame and being connected to the vehicle body, and the first support suspension device and the second support suspension device being disposed at an interval in the lengthwise direction of the rail and being located on a central axis that equally divides the bogie frame in a width direction of the rail; or the first support suspension device and the second support suspension device being disposed at an interval in a width direction of the rail and being located on a central axis that equally divides the bogie frame in the lengthwise direction of the rail.

According to an embodiment of the present disclosure, the bogie further includes: a first support suspension device, a second support suspension device, a third support suspension device, and a fourth support suspension device, the first support suspension device, the second support suspension device, the third support suspension device, and the fourth support suspension device being mounted on the bogie frame and being connected to the vehicle body, the first support suspension device, the second support suspension device, the third support suspension device, and the fourth support suspension device being respectively located at four corners of a rectangle in a horizontal plane, and the rectangle being symmetric about the center of the bogie frame.

According to an embodiment of the present disclosure, two first horizontal wheels exist and are disposed at an interval in the lengthwise direction of the first track beam, and two second horizontal wheels exist and are disposed at an interval in the lengthwise direction of the second track beam. Central axes of the two first horizontal wheels and central axes of the two second horizontal wheels are respectively located at four corners of a rectangle in a horizontal plane, and the rectangle is symmetric about the center of the bogie frame.

According to an embodiment of the present disclosure, one first horizontal wheel and one second horizontal wheel exist, the first horizontal wheel and the second horizontal wheel are disposed at an interval in the width direction of the rail, and the first horizontal wheel and the second horizontal wheel deviate, in a traveling direction of the rail vehicle, from a center of the bogie frame in the lengthwise direction of the rail.

According to an embodiment of the present disclosure, an outer diameter of the first running wheel and an outer diameter of the second running wheel are the same and are between 900 millimeters and 1100 millimeters.

According to an embodiment of the present disclosure, an outer diameter of the first running wheel, an outer diameter of the second running wheel, an outer diameter of the third running wheel, and an outer diameter of the fourth running wheel are the same and are between 900 millimeters and 1100 millimeters.

DETAILED DESCRIPTION

Figure 1:
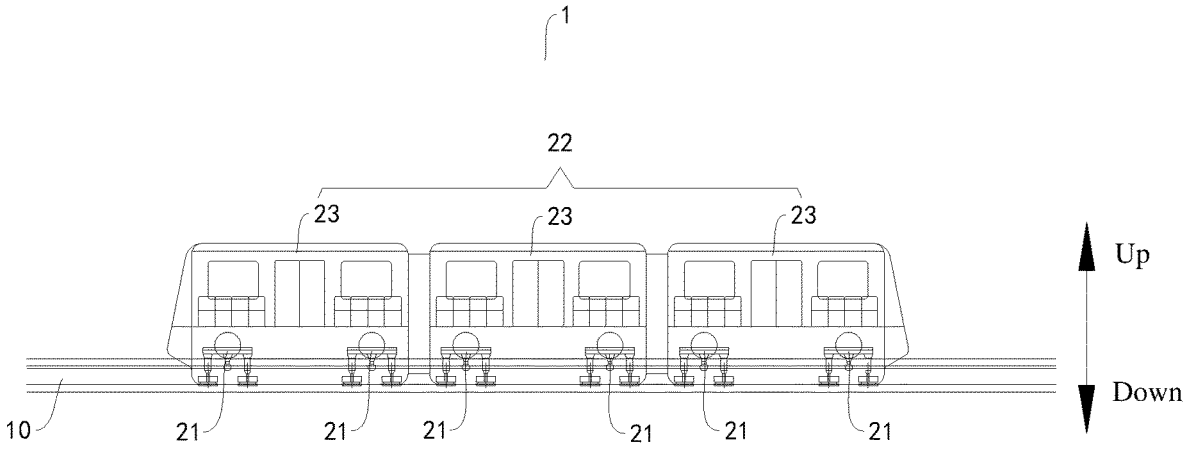
FIG. 1 is a schematic view of a rail transport system according to an embodiment of the present disclosure.
Figure 2:
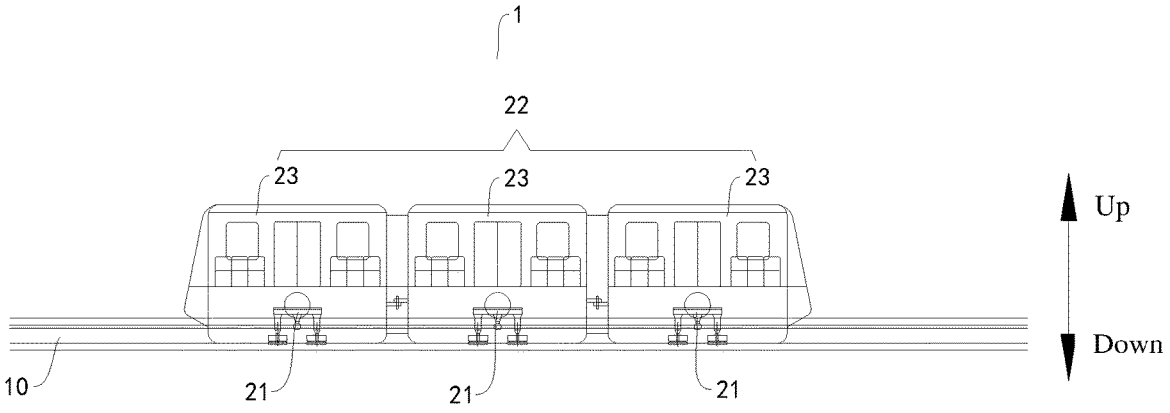
FIG. 2 is a schematic view of a rail transport system according to another embodiment of the present disclosure.
Figure 3:
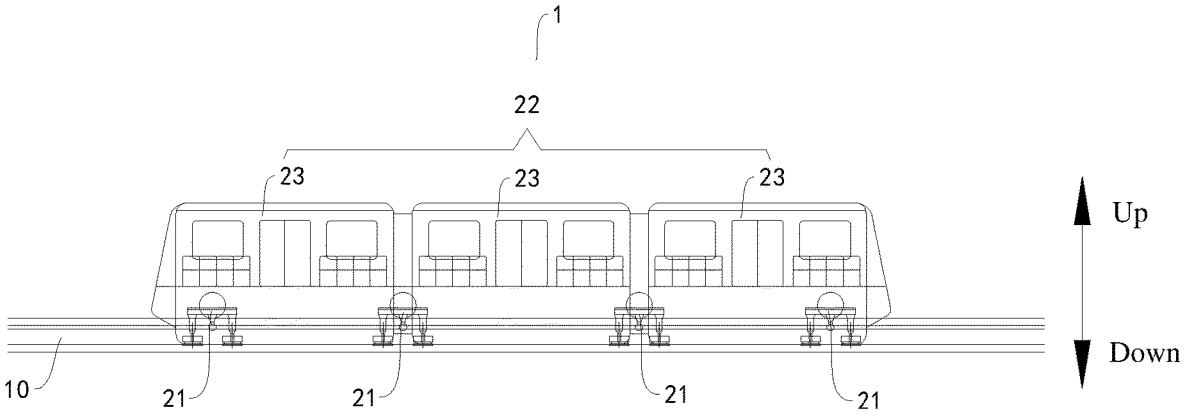
FIG. 3 is a schematic view of a rail transport system according to another embodiment of the present disclosure.

Embodiments of the present disclosure are described below in detail. Examples of the embodiments are shown in the accompanying drawings. Throughout the accompanying drawings, the same or similar reference numerals represent the same or similar elements or elements that have the same or similar functions. The embodiments described below with reference to the accompanying drawings are exemplary, and are intended to explain the present disclosure but should not be construed as a limitation to the present disclosure.

The present disclosure proposes a rail transport system 1 that has advantages such as convenient evacuation of passengers in an emergency, a low cost, small occupied space, light load on a rail, and high stability.

The rail transport system 1 according to an embodiment of the present disclosure is described below with reference to the accompanying drawings.

Figure 70:
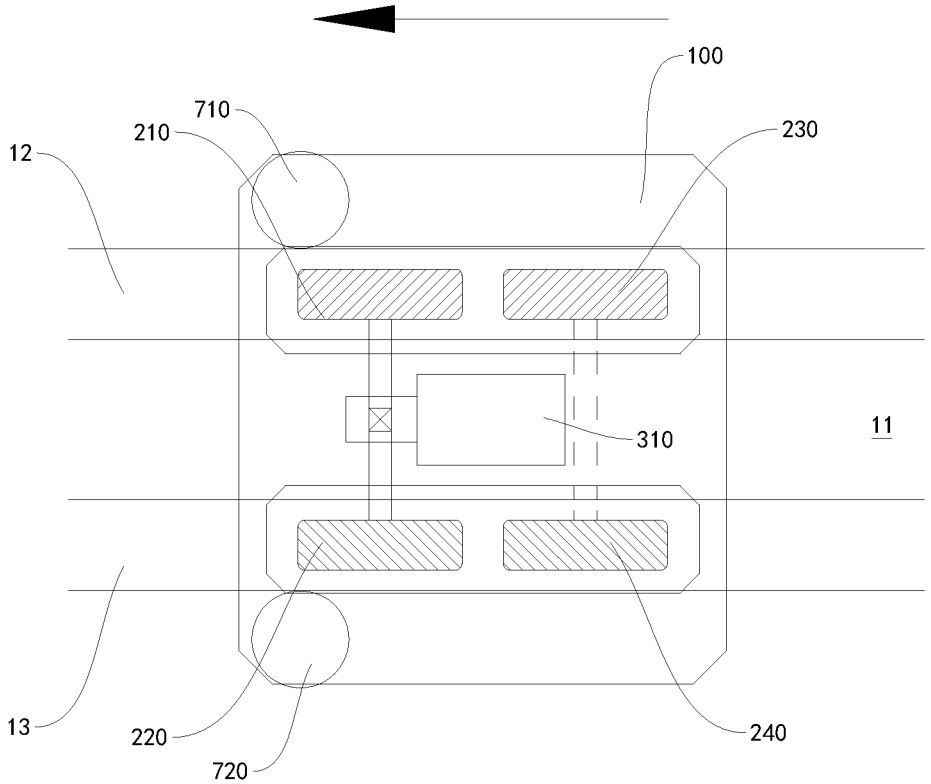
FIG. 70 is a schematic view of a bogie of a rail vehicle according to another embodiment of the present disclosure.

As shown in FIG. 1 to FIG. 70, the rail transport system 1 according to this embodiment of the present disclosure includes: a rail 10 and a rail vehicle 20.

In an embodiment, a first concave portion is built on the rail 10, and the first concave portion is configured as an escape passage 11. The rail vehicle 20 includes a bogie 21 and a vehicle body 22. The bogie 21 has a second concave portion 110 for straddling the rail 10. That is, the bogie 21 has the second concave portion 110, where the bogie 21 movably straddles the rail 10, and the vehicle body 22 is connected to the bogie 21 and pulls the bogie 21 to run along the rail 10. In an embodiment, in the left-right direction, the minimum distance between two ends of the second concave portion 110 is larger than or equal to the minimum width of the rail 10.

A person skilled in the art needs to understand here that when the escape passage 11 is disposed on the rail 10, the escape passage 11 is disposed on the rail 10 itself, but not on another additional member besides the rail 10. That is, compared with the structure of the escape passage in the prior art, in the rail transport system 1 according to this embodiment of the present disclosure, other members such as a structure and a floor does not need to be disposed on the rail 10, and the escape passage 11 is formed on the rail 10 itself.

In the rail transport system 1 according to this embodiment of the present disclosure, the escape passage 11 is disposed on the rail 10 itself. When an emergency occurs, passengers can be evacuated in time through the escape passage 11. Moreover, because the escape passage 11 is formed on the rail 10 itself, other additional structures do not need to be added to the rail 10, and only the escape passage 11 needs to be formed on the rail 10 in a lengthwise direction of the rail 10, so that the workload of a rail transport system can be greatly reduced; therefore, in an aspect, a cost is reduced, and in another aspect, space to occupy is reduced. In addition, because the escape passage 11 is formed on the rail 10, the load on the rail 10 does not increase, so that the stability of the rail 10 is improved. Therefore, the rail transport system 1 according to this embodiment of the present disclosure has advantages such as convenient evacuation of passengers in an emergency, a low cost, small occupied space, light load on a rail, and high stability.

The rail transport system 1 according to an embodiment of the present disclosure is described below with reference to the accompanying drawings.

As shown in FIG. 1 to FIG. 70, the rail transport system 1 according to this embodiment of the present disclosure includes the rail 10 and the rail vehicle 20.

In some specific embodiments of the present disclosure, as shown in FIG. 1 to FIG. 5, a vehicle body 22 includes a plurality of carriages 23 sequentially hinged in a lengthwise direction of the rail 10. An emergency door 24 that can be opened and closed is disposed on a surface, opposite an adjacent carriage 23, of a carriage 23 that is located at least one end of the vehicle body 22 in the lengthwise direction of the rail 10. In other words, the emergency door 24 is disposed on an end face of at least one carriage 23 of two carriages 23 that are located at two ends of the vehicle body 22. Further in other words, the emergency door 24 is disposed on a carriage 23 that is located at least one end of the vehicle body 22 in the lengthwise direction of the rail 10. Specifically, the emergency door 24 is disposed on a first end face of the carriage 23 that is located at the at least one end, and the first end face is a surface away from an adjacent carriage. The emergency door 24 has a first end 31 and a second end 32. The first end 31 of the emergency door 24 is pivotably mounted on a corresponding carriage 23. When opened, the emergency door 24 slants relative to a horizontal plane, and the second end 32 of the emergency door 24 slants downwards and is inserted in the escape passage 11. In this way, when an emergency occurs, the rail vehicle 20 actively or passively stops, the emergency door 24 is opened and the second end of the emergency door 24 is inserted in the escape passage 11. Passengers inside the carriage 23 can slide down to the escape passage 11 through the emergency door 24, so as to evacuate from the escape passage 11.

In an embodiment, the first end 31 of the emergency door 24 is disposed close to the bottom of the vehicle, and the second end 32 of the emergency door 24 is disposed close to the top of the vehicle when the emergency door 24 is closed. In other words, when the emergency door 24 is closed, the second end 32 of the emergency door 24 is located above the first end 31 of the emergency door 24. When the emergency door 24 is open, the second end 32 of the emergency door 24 is located below the first end 31 of the emergency door 24. In this way, the emergency door 24 turns downwards to switch from a closed state to an open state. The emergency door 24 has a turnable structure, so that passengers inside a vehicle only need to perform simple operations to rapidly open the emergency door 24, thereby effectively improving the escape efficiency.

Advantageously, a slideway is disposed on an inner surface of the emergency door 24 to make it convenient for passengers to slide on the slideway to the escape passage 11. It should be understood herein that the inner surface of the emergency door 24 refers to a surface that faces the inside of the vehicle when the emergency door 24 is closed.

Figure 67:
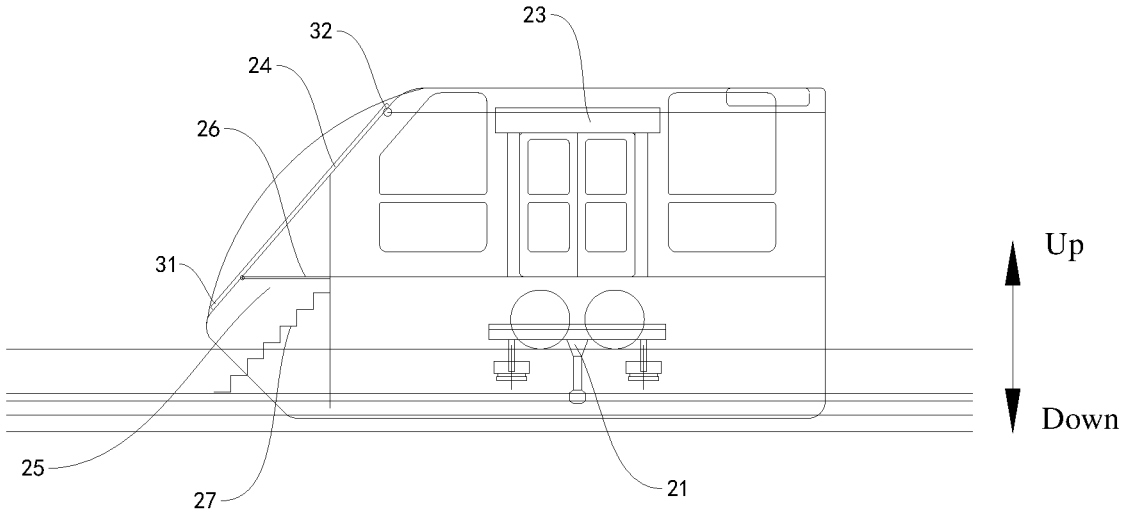
FIG. 67 is a partially schematic view of a rail transport system according to another embodiment of the present disclosure, where an emergency door is in a closed state.
Figure 68:
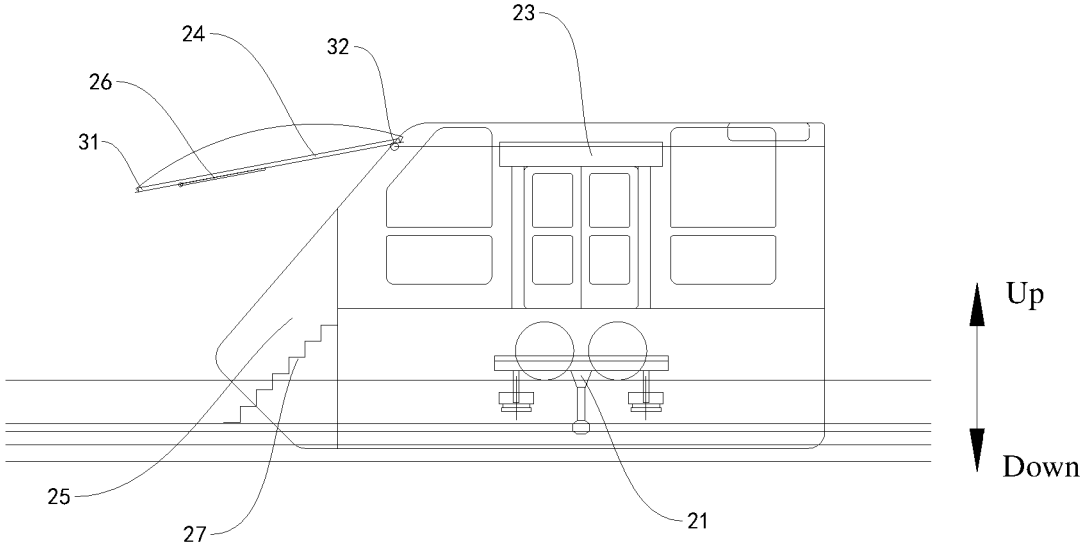
FIG. 68 is a partially schematic view of a rail transport system according to another embodiment of the present disclosure, where an emergency door is in an open state.

In some other specific embodiments of the present disclosure, as shown in FIG. 67 and FIG. 68, the vehicle body 22 includes a plurality of carriages 23 sequentially hinged in the lengthwise direction of the rail 10. An emergency door 24 that can be opened and closed is disposed on a surface, opposite an adjacent carriage 23, of a carriage 23 that is located at least one end of the vehicle body 22 in the lengthwise direction of the rail 10. Moreover, an emergency exit 25 and a cover plate 26 are disposed on an inner floor of the carriage 23 that is located at the at least one end of the vehicle body 22. That is, the emergency exit 25 and the cover plate 26 are disposed on the inner floor of the carriage 23 on which the emergency door 24 is disposed. The cover plate 26 is linked with the emergency door 24 and configured to open and close the emergency exit 25. When the rail vehicle 20 normally operates, the emergency door 24 is closed and the cover plate 26 closes the emergency exit 25 (as shown in FIG. 67). When an emergency occurs, the rail vehicle 20 actively or passively stops, the emergency door 24 is opened and the cover plate 26 opens the emergency exit 25 (as shown in FIG. 68). Passengers inside the carriage 23 can enter the escape passage 11 through the emergency exit 25, so as to evacuate from the escape passage 11. In addition, even though the rail vehicle 20 is forced to stop at a turning point of the rail 10, when being open, the emergency door 24 does not need to fit the rail 10, and therefore, the emergency door 24 does not collide with the rail 10, so that it becomes convenient for passengers to evacuate at the turning point of the rail 10.

In an embodiment, in the lengthwise direction of the rail 10, emergency doors 24 are disposed on two end faces of two carriages 23 located at two ends of the vehicle body 22. The end face is the surface of opposite an adjacent carriage 23. In other words, emergency doors 24 are disposed on first end faces of the two carriages 23 located at two ends of the vehicle body 22. When a sudden emergency occurs, the emergency doors 24 are opened at both ends of the vehicle body 22, and a wide air convection passage can be formed, to enable toxic gas such as smog inside the vehicle body 22 to disperse rapidly. Moreover, the emergency door 24 has a turnable structure, so that passengers inside a vehicle only need to perform simple operations to rapidly open the emergency door 24, thereby effectively improving the escape efficiency.

In an embodiment, the emergency door 24 has the first end 31 and the second end 32. The second end 32 of the emergency door 24 is pivotably mounted on a corresponding carriage 23. The second end 32 of the emergency door 24 is disposed close to the top of the vehicle. The first end 31 of the emergency door 24 is disposed close to the bottom of the vehicle when the emergency door 24 is closed. In other words, when the emergency door 24 is closed, the first end 31 of the emergency door 24 is located below the second end 32 of the emergency door 24. When the emergency door 24 is open, the first end 31 of the emergency door 24 may be located below the second end 32 of the emergency door 24, or may also be located above the second end 32 of the emergency door 24. In this way, the emergency door 24 turns upwards to switch from a closed state to an open state. The emergency door 24 has the turnable structure, so that passengers inside a vehicle only need to perform simple operations to rapidly open the emergency door 24, thereby effectively improving the escape efficiency, and facilitating linkage between the emergency door 24 and the cover plate 26.

Optionally, the linkage between the cover plate 26 and the emergency door 24 may be driven by the emergency door 24 or may be driven by the cover plate 26. Specifically, when evacuating passengers, the emergency door 24 may be actively opened, and the emergency door 24 drives the cover plate 26 to open the emergency exit 25, or the cover plate 26 may be actively opened, and the cover plate 26 drives the emergency door 24 to be opened. Preferably, the linkage is driven by the cover plate 26, that is, the cover plate 26 is opened to drive the emergency door 24 to be opened. In this way, when the cover plate 26 is opened, articles or passengers on the cover plate 26 can be prevented from falling down.

Furthermore, as shown in FIG. 67 and FIG. 68, an escape ladder 27 connected to the escape passage 11 is disposed inside the emergency exit 25. After the emergency exit 25 is opened, passengers inside the vehicle can move to the escape passage 11 through the escape ladder 27.

Optionally, the escape ladder 27 may be in a fixed state and be kept suspended inside the emergency exit 25, and a lower end of the escape ladder 27 is separated from an inner bottom surface of the escape passage 11, to prevent influence on running of the rail vehicle 20.

In an embodiment, the escape ladder 27 may also have a retracted state and an extended state. The vehicle body 22 further includes a telescopic driving device configured to drive the escape ladder 27 to extend or retract. After the emergency exit 25 is opened, the escape ladder 27 may be manually controlled to extend to the escape passage 11, and may also automatically extend to the escape passage 11 through linkage. In this embodiment, after being extended, the escape ladder 27 may be directly placed on the inner bottom surface of the escape passage 11, or may be separated from the inner bottom surface of the escape passage 11.

Advantageously, the cover plate 26 may be pivotably mounted on the emergency door 24. After the emergency door 24 turns upwards to be opened, the cover plate 26 is rotated through linkage and abuts on the inner surface of the emergency door 24, so as to save space, thereby preventing the cover plate 26 from affecting evacuation of passengers.

Figure 6:
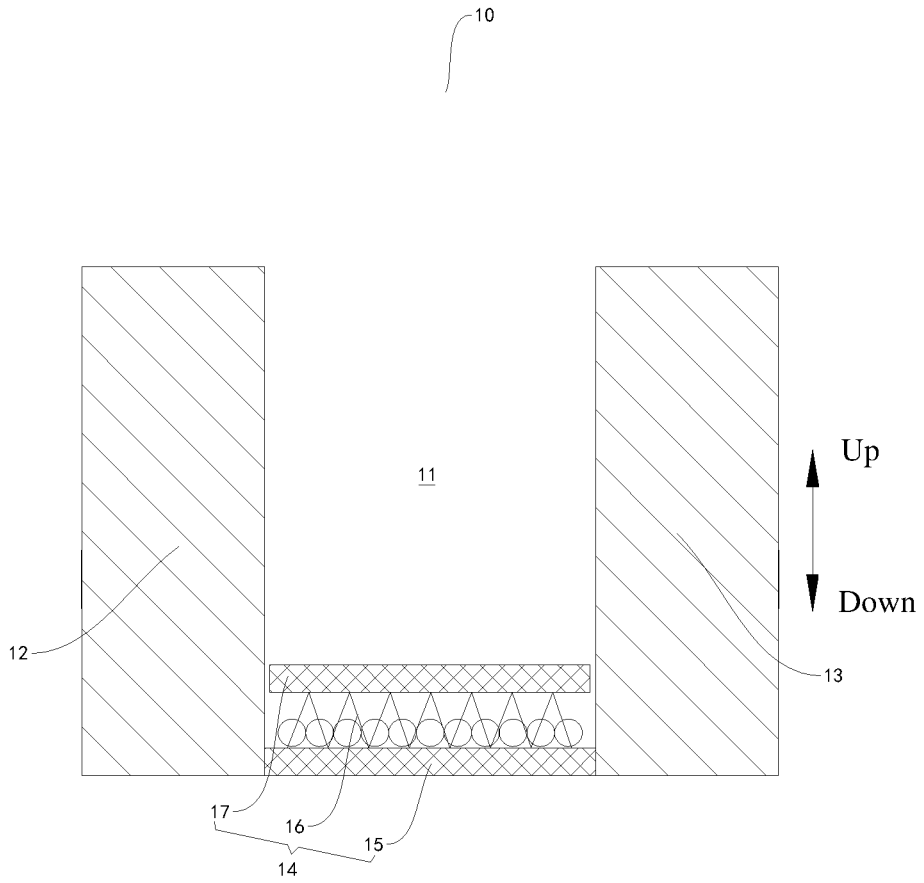
FIG. 6 is a schematic view of a rail of a rail transport system according to an embodiment of the present disclosure.

In some embodiments of the present disclosure, as shown in FIG. 6, the rail 10 includes a first track beam 12, a second track beam 13, and a bearing floor 14.

The first track beam 12 and the second track beam 13 are disposed in parallel and spaced apart. The bogie 21 straddles the first track beam 12 and the second track beam 13. The bearing floor 14 is disposed between the first track beam 12 and the second track beam 13. The bearing floor 14 is connected to the first track beam 12 and the second track beam 13. The escape passage 11 is defined among the first track beam 12, the second track beam 13, and the bearing floor 14. In this way, the escape passage 11 can be disposed on the rail 10 itself through the structure of the rail 10, so that no additional members is needed, a cost is low, occupied space is small, and the load on the rail 10 is reduced. In addition, track beams have relatively small sizes, occupy small space and areas, relatively light weights, high energy efficiency, and remarkably economical efficiency.

In an embodiment, as shown in FIG. 6, the bearing floor 14 includes a connecting beam 15, a support frame 16, and a support plate 17. The connecting beam 15 extends in an interval direction of the first track beam 12 and the second track beam 13. Two ends of the connecting beam 15 are respectively connected to a lower portion of the first track beam 12 and a lower portion of the second track beam 13. The support frame 16 is mounted on the connecting beam 15. The support plate 17 is connected on the support frame 16 and is supported by the support frame 16. The support plate 17 forms a bottom face of the escape passage 11. Because the rail 10 is usually built overhead by means of piers, and a predetermined distance exists between piers, through a structure having the foregoing bearing floor 14, the escape passage 11 that extends in the lengthwise direction of the rail 10 may be formed between piers, achieving low material consumption and a low cost.

Advantageously, as shown in FIG. 6, the support plate 17 is spaced apart from at least one of the first track beam 12 and the second track beam 13 in a horizontal direction. In other words, the support plate 17 is spaced apart from the first track beam 12 in the horizontal direction, or the support plate 17 is spaced apart from the second track beam 13 in the horizontal direction, or the support plate 17 is spaced apart from the first track beam 12 and the second track beam 13 in the horizontal direction. In this way, it may become convenient to insert a tool into a gap between the support frame 16 and a track beam, so as to pry the support plate 17 to facilitate maintenance.

Optionally, a plurality of connecting beams 15 exist and are spaced apart in the lengthwise direction of the rail 10, and a plurality of support plates 17 exist and are sequentially connected in the lengthwise direction of the rail 10. In an aspect, a single connecting beam 15 and a single support plate 17 are easier and more convenient to process, and in another aspect, overall construction of the rail 10 becomes convenient.

A person skilled in the art needs to understand that when the plurality of support plates 17 are sequentially connected, the plurality of support plates 17 may be connected directly or indirectly, and preferably, the plurality of support plates 17 are connected directly. When the plurality of support plates 17 are connected indirectly, gaps between adjacent support plates 17 need to ensure that passengers can successfully pass, that is, evacuation of passengers is not affected.

Furthermore, the rail 10 further includes an anti-falling edge 18. In an embodiment, the anti-falling edge 18 is disposed at least one of an upper end and a lower end of at least one of the first track beam 12 and the second track beam 13. The anti-falling edge 18 extends outwards in the horizontal direction and is configured to prevent the bogie 21 from falling out of the rail 10. In an embodiment, the anti-falling edge 18 may be disposed at a top portion and/or a bottom portion of the first track beam 12, or may be disposed on an outer side surface and/or an inner side surface of the first track beam 12. The anti-falling edge 18 may be disposed at a top portion and/or a bottom portion of the second track beam 13, or may be disposed on an outer side surface and/or an inner side surface of the second track beam 13. A person skilled in the art needs to understand herein that the anti-falling edge 18 is configured to prevent the bogie 21 from falling out of the rail 10, so as to ensure the stability of the rail vehicle 20 in a running condition such as making a turn. A partial structure of the bogie 21 needs to be placed right below the anti-falling edge 18 at the top portion and/or right above the anti-falling edge 18 at the bottom portion.

Figure 8:
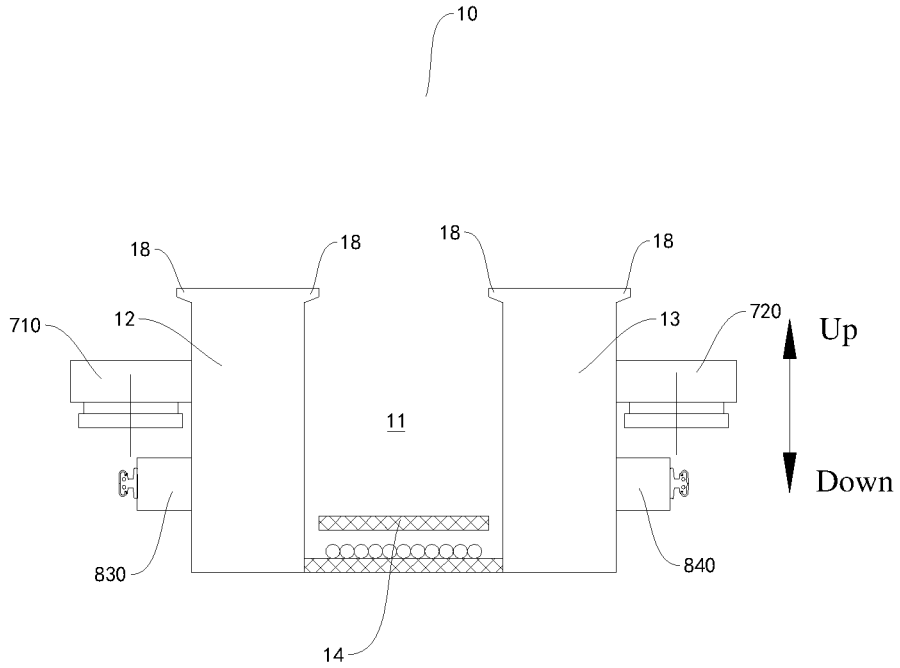
FIG. 8 is a schematic view of a rail of a rail transport system according to another embodiment of the present disclosure.

For example, as shown in FIG. 8, the first track beam 12 and the second track beam 13 are formed by pouring steel bars and concrete. The anti-falling edges 18 are respectively disposed on an inner side surface and an outer side surface of the top portion of the first track beam 12. The anti-falling edges 18 are respectively disposed on an inner side surface and an outer side surface of the top portion of the second track beam 13. A first horizontal wheel 710 of the bogie 21 is fit on the outer side surface of the first track beam 12 and is located below the anti-falling edge 18 on the outer side surface of the top portion of the first track beam 12. A second horizontal wheel 720 of the bogie 21 is fit on the outer side surface of the second track beam 13 and is located below the anti-falling edge 18 on the outer side surface of the top portion of the second track beam 13. In this way, the anti-falling edge 18 may stop a horizontal wheel from moving upwards, so as to achieve an anti-falling effect.

Figure 9:
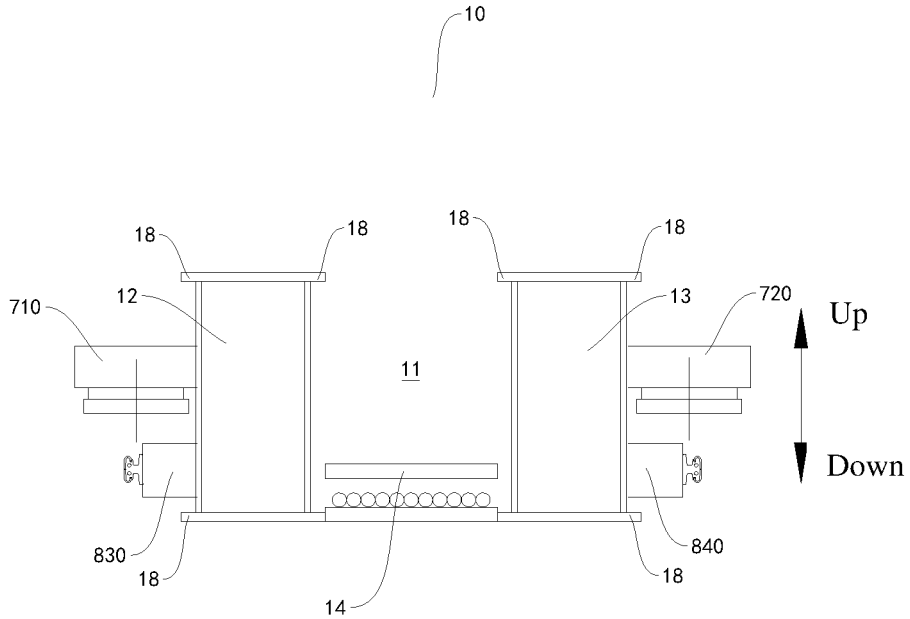
FIG. 9 is a schematic view of a rail of a rail transport system according to another embodiment of the present disclosure.

As shown in FIG. 9, the first track beam 12 and the second track beam 13 are formed by splicing steel plates. The anti-falling edges 18 are respectively disposed on an inner side surface and an outer side surface of the top portion of the first track beam 12. The anti-falling edges 18 are respectively disposed on an inner side surface and an outer side surface of the bottom portion of the first track beam 12. The anti-falling edges 18 are respectively disposed on an inner side surface and an outer side surface of the top portion of the second track beam 13. The anti-falling edges 18 are respectively disposed on an inner side surface and an outer side surface of the bottom portion of the second track beam 13. The first horizontal wheel 710 of the bogie 21 is fit on the outer side surface of the first track beam 12 and is located between the anti-falling edge 18 on the outer side surface of the top portion of the first track beam 12 and the anti-falling edge 18 on the outer side surface of the bottom portion of the first track beam 12. The second horizontal wheel 720 of the bogie 21 is fit on the outer side surface of the second track beam 13 and is located between the anti-falling edge 18 on the outer side surface of the top portion of the second track beam 13 and the anti-falling edge 18 on the outer side surface of the bottom portion of the second track beam 13. In this way, the anti-falling edges 18 may stop horizontal wheels from moving upwards and downwards, i.e. prevent the first horizontal wheel 710 from falling out of the first track beam 12 and prevent the second horizontal wheel 720 from falling out of the second track beam 13, so as to achieve an anti-falling effect.

Figure 7:
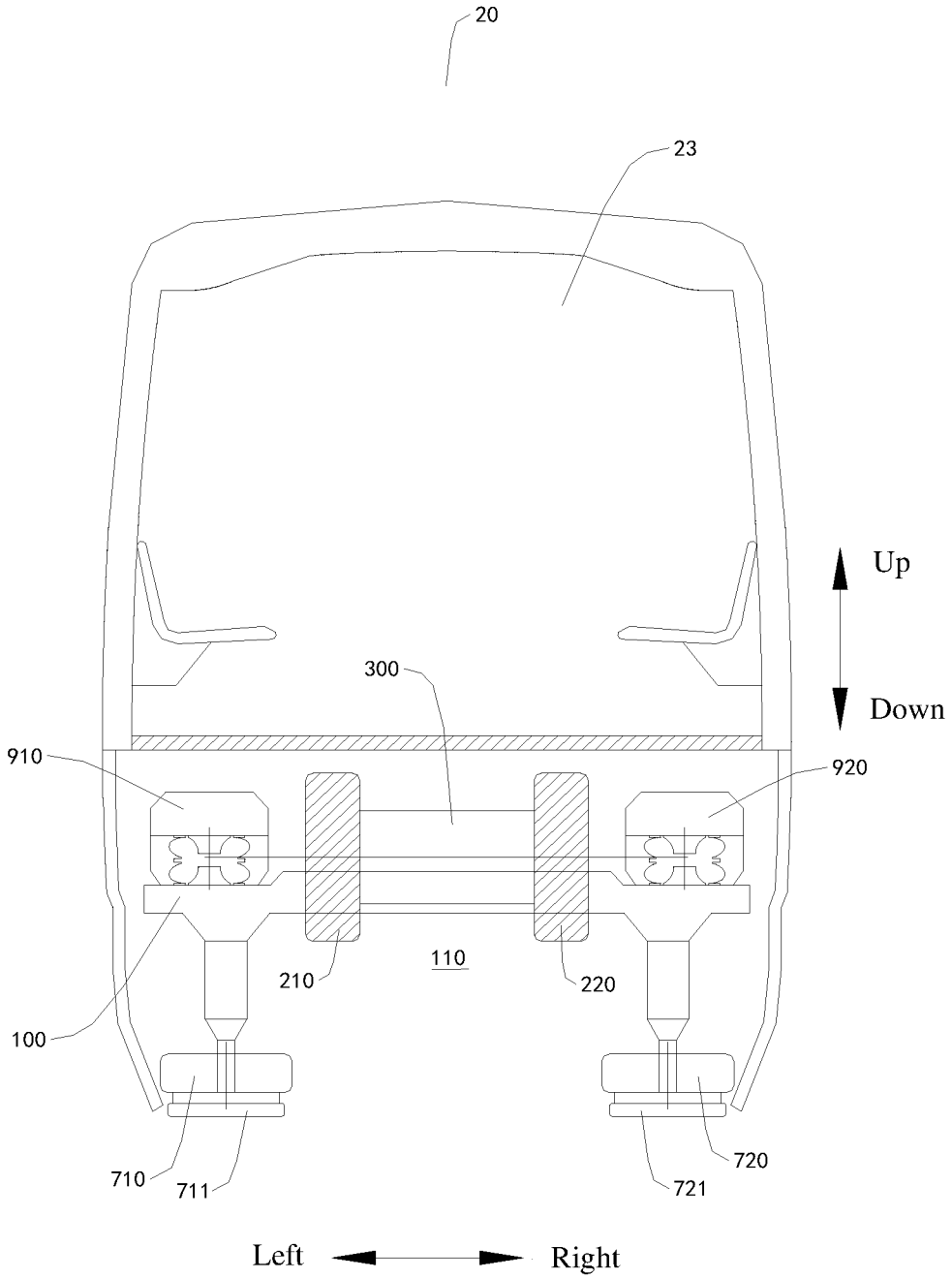
FIG. 7 is a schematic view of a rail vehicle according to an embodiment of the present disclosure.
Figure 10:
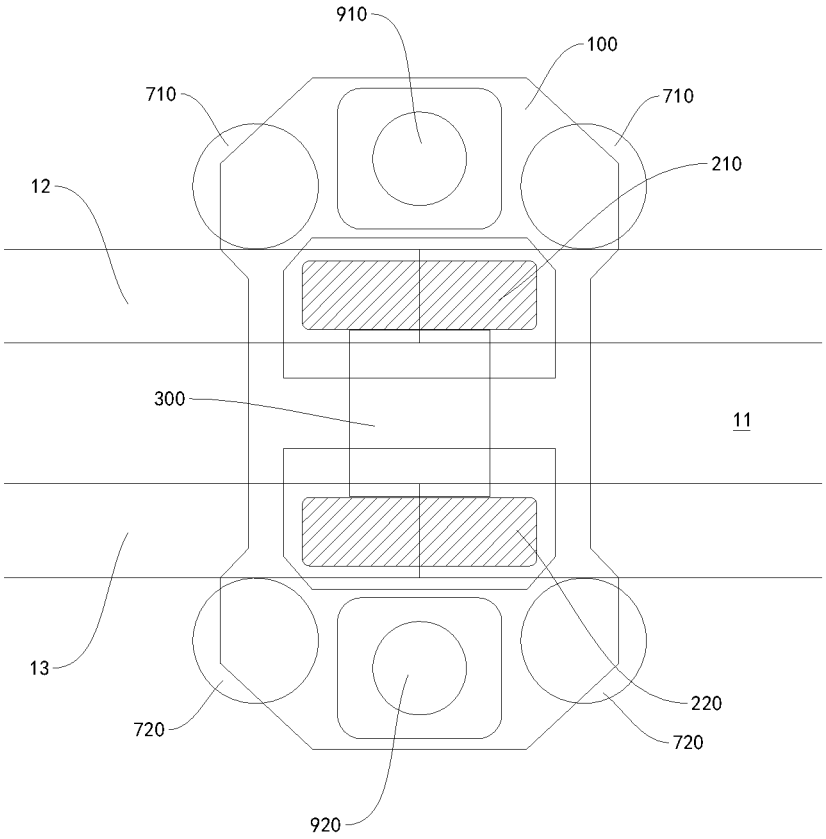
FIG. 10 is a schematic view of a bogie of a rail vehicle according to an embodiment of the present disclosure.

In some specific embodiments of the present disclosure, as shown in FIG. 7 and FIG. 10, the bogie 21 includes a bogie frame 100, a first running wheel 210, a second running wheel 220, and a driving device 300.

The bogie frame 100 has a second concave portion 110 for straddling the rail 10, the second concave portion 110 is formed by a hollow portion defined by a bottom of the bogie frame 100, the first horizontal wheel 710 and the second horizontal wheel 720, and the innermost sides of the first horizontal wheel 710 and the second horizontal wheel 720 are in contact with outer sides of the rail 10. The first running wheel 210 and the second running wheel 220 are pivotably mounted on the bogie frame 100, and the first running wheel 210 and the second running wheel 220 are disposed coaxially and spaced apart. The first running wheel 210 is fit on an upper surface of the first track beam 12. The second running wheel 220 is fit on an upper surface of the second track beam 13. The driving device 300 is mounted on the bogie frame 100. The driving device 300 is located between the first running wheel 210 and the second running wheel 220. The first running wheel 210 and the second running wheel 220 are driven by the driving device 300. The first running wheel 210 and the second running wheel 220 are driven by the driving device 300 to drive the bogie 21 to run along the rail 10, so as to pull the vehicle body 22 to run. In this way, not only a gap between the first running wheel 210 and the second running wheel 220 can be used to mount the driving device 300, so as to save space, improve space utilization, and facilitate center-of-gravity distribution of the vehicle body 22, but also a distance between wheel centers can be increased, so that the driving device 300 can evenly and stably drive the first running wheel 210 and the second running wheel 220, so as to improve the stability and comfort of the rail transport system 1.

In some other embodiments of the present disclosure, as shown in FIG. 45 to FIG. 49, the bogie 21 includes a bogie frame 100, a first running wheel 210, a second running wheel 220, a third running wheel 230, a fourth running wheel 240 and a driving device.

The bogie frame 100 has the second concave portion 110 for straddling the rail 10, i.e the second concave portion 110 is disposed on the bogie frame 100. The first running wheel 210 and the second running wheel 220 are respectively pivotably mounted on the bogie frame 100 and are disposed coaxially and spaced apart. The first running wheel 210 is fit on an upper surface of the first track beam 12. The second running wheel 220 is fit on an upper surface of the second track beam 13. The third running wheel 230 and the fourth running wheel 240 are respectively pivotably mounted on the bogie frame 100 and are disposed coaxially and spaced apart. The third running wheel 230 is fit on the upper surface of the first track beam 12 and is spaced apart from the first running wheel 210 in a lengthwise direction of the first track beam 12. The fourth running wheel 240 is fit on the upper surface of the second track beam 13 and is spaced apart from the second running wheel 220 in a lengthwise direction of the second track beam 13. The driving device is mounted on the bogie frame 100. The driving device is located between the first running wheel 210 and the second running wheel 220 and/or the driving device is located between the third running wheel 230 and the fourth running wheel 240. The first running wheel 210 and the second running wheel 220 are driven by the driving device and/or the third running wheel 230 and the fourth running wheel 240 are driven by the driving device. In this way, a requirement of a relatively large load can be satisfied, four running wheels can bear more load, a quantity of passengers of the rail vehicle 20 and a size of a vehicle body are both improved advantageously, and space utilization efficiency of the bogie 21 can be effectively improved, thereby reducing a duty area of an entire vehicle.

Figure 46:
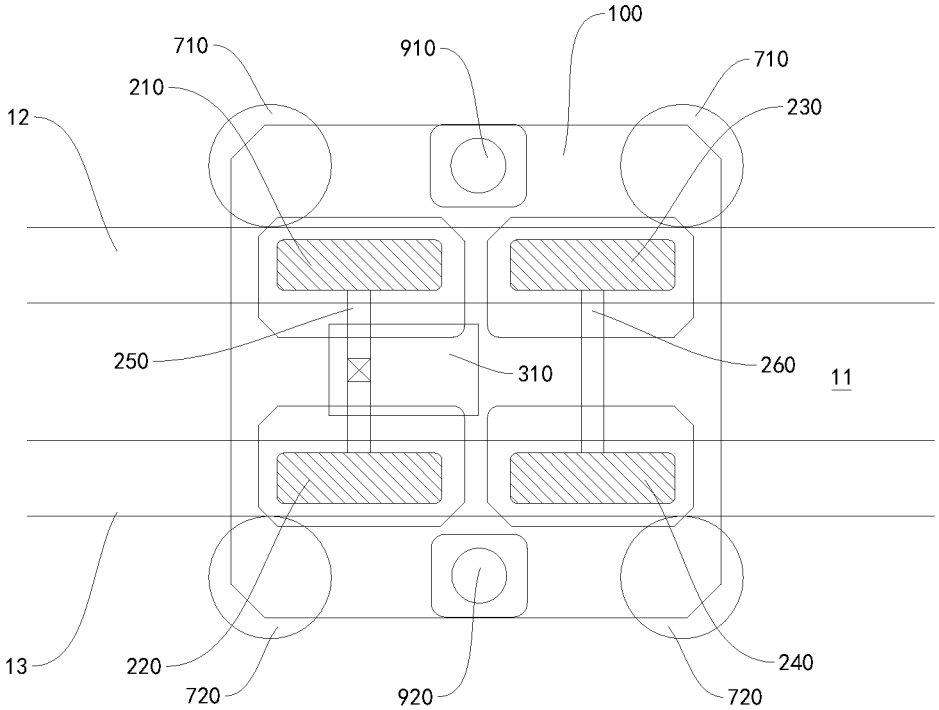
FIG. 46 is a schematic view of a bogie of a rail vehicle according to another embodiment of the present disclosure.

For example, as shown in FIG. 46, one driving device may exist and is defined as a first driving device 310. The first driving device 310 is disposed between the first running wheel 210 and the second running wheel 220, and the first running wheel 210 and the second running wheel 220 are driven by the first driving device 310.

Figure 47:
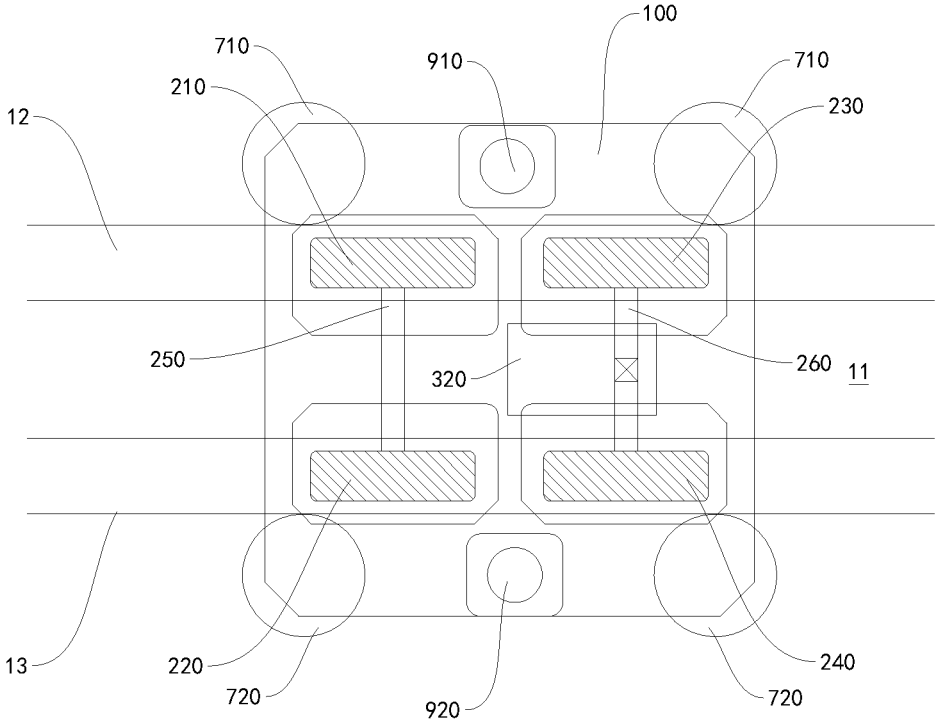
FIG. 47 is a schematic view of a bogie of a rail vehicle according to another embodiment of the present disclosure.

As shown in FIG. 47, one driving device exists and is defined as a second driving device 320. The second driving device 320 is disposed between the third running wheel 230 and the fourth running wheel 240, and the third running wheel 230 and the fourth running wheel 240 are driven by the second driving device 320.

Figure 48:
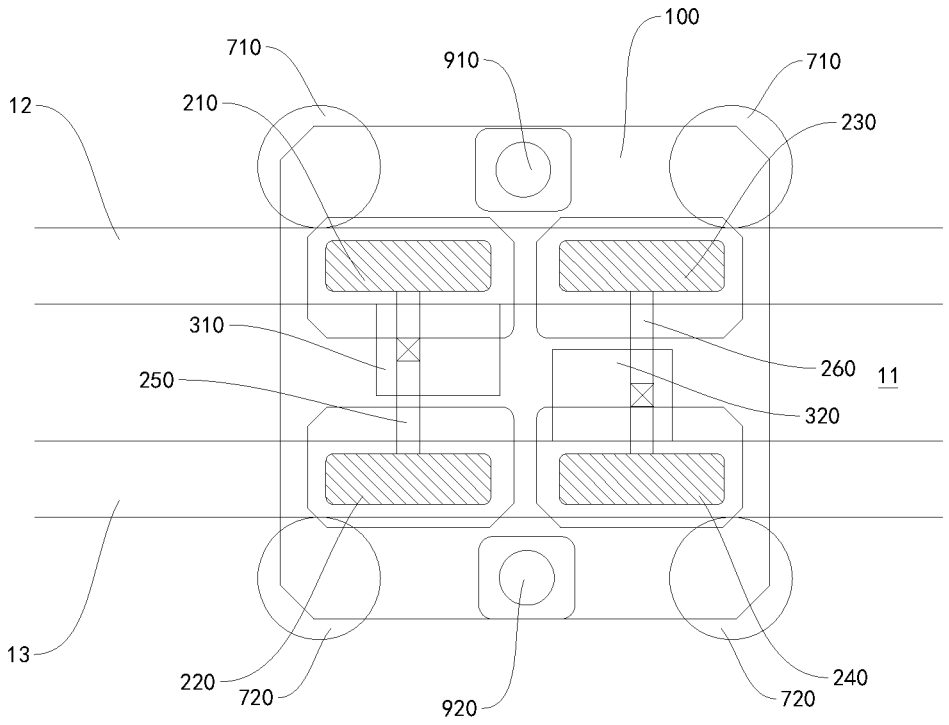
FIG. 48 is a schematic view of a bogie of a rail vehicle according to another embodiment of the present disclosure.

As shown in FIG. 48, two driving devices exist and are respectively defined as the first driving device 310 and the second driving device 320. The first driving device 310 is disposed between the first running wheel 210 and the second running wheel 220, and the first running wheel 210 and the second running wheel 220 are driven by the first driving device 310. The second driving device 320 is disposed between the third running wheel 230 and the fourth running wheel 240, and the third running wheel 230 and the fourth running wheel 240 are driven by the second driving device 320. The first driving device 310 is closer to the first running wheel 210 than to the second running wheel 220, and/or the second driving device 320 is closer to the fourth running wheel 240 than to the third running wheel 230. Preferably, the first driving device 310 is closer to the first running wheel 210 than to the second running wheel 220 and the second driving device 320 is closer to the fourth running wheel 240 than to the third running wheel 230. That is, the first driving device 310 and the second driving device 320 are disposed diagonally. In this way, the bogie 21 is balanced in a width direction of the rail 10, and a differential can be omitted, so as to reduce a cost.

Optionally, the first running wheel 210 and the second running wheel 220 are connected through a first connecting shaft 250 and/or the third running wheel 230 and the fourth running wheel 240 are connected through a second connecting shaft 260, and the driving device has a transmission connection to the first connecting shaft 250 and/or the second connecting shaft 260.

Figure 49:
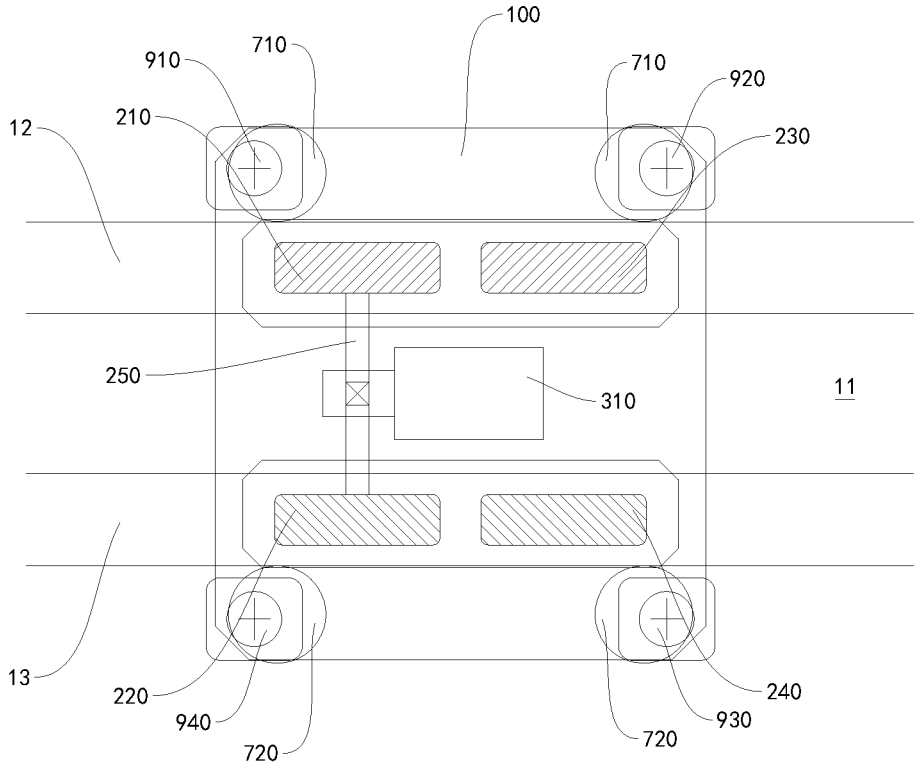
FIG. 49 is a schematic view of a bogie of a rail vehicle according to another embodiment of the present disclosure.

For example, as shown in FIG. 49, the first running wheel 210 and the second running wheel 220 are connected through the first connecting shaft 250. No connecting shaft is configured to connect the third running wheel 230 with the fourth running wheel 240, and the third running wheel 230 and the fourth running wheel 240 are configured to be driven wheels. One driving device exists and is defined as the first driving device 310. The first driving device 310 has a transmission connection to the first connecting shaft 250.

In other words, FIG. 10 shows a bogie 21 having two running wheels. FIG. 46 to FIG. 49 show a bogie 21 having four running wheels. The bogie 21 having four running wheels may have a single connecting shaft or may have double connecting shafts. The double connecting shafts are preferable, so that the stability performance and safety performance of the system can be significantly improved.

In some specific embodiments of the present disclosure, the bogie 21 further includes a first horizontal wheel 710 and a second horizontal wheel 720, and the bogie 21 may include one first horizontal wheel 710 or a plurality of first horizontal wheels 710, and/or one second horizontal wheel 720 or a plurality of second horizontal wheels 720.

The first horizontal wheel 710 is pivotably mounted on the bogie frame 100 and fit on a side surface of the first track beam 12. The second horizontal wheel 720 is pivotably mounted on the bogie frame 100 and fit on a side surface of the second track beam 13. In an aspect, when the rail 10 has a change in direction, the first horizontal wheel 710 and the second horizontal wheel 720 are fit on side surfaces of the rail 10, so as to produce passive steering along the rail 10, to drive the rail vehicle 20 to make a turn. In another aspect, the stability of the rail vehicle 20 during running can be improved.

Figure 4:
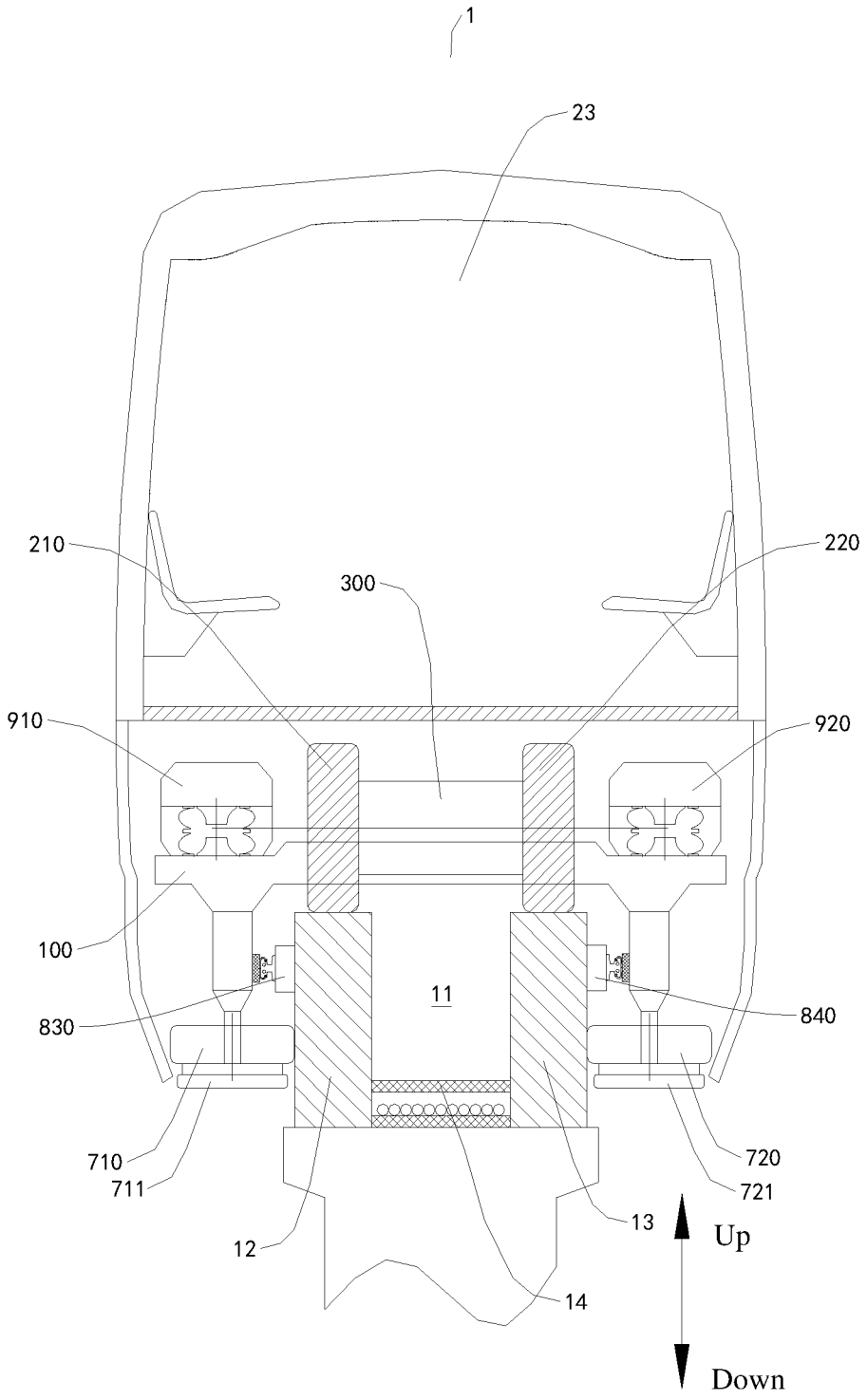
FIG. 4 is a sectional view of a rail transport system according to an embodiment of the present disclosure.
Figure 5:
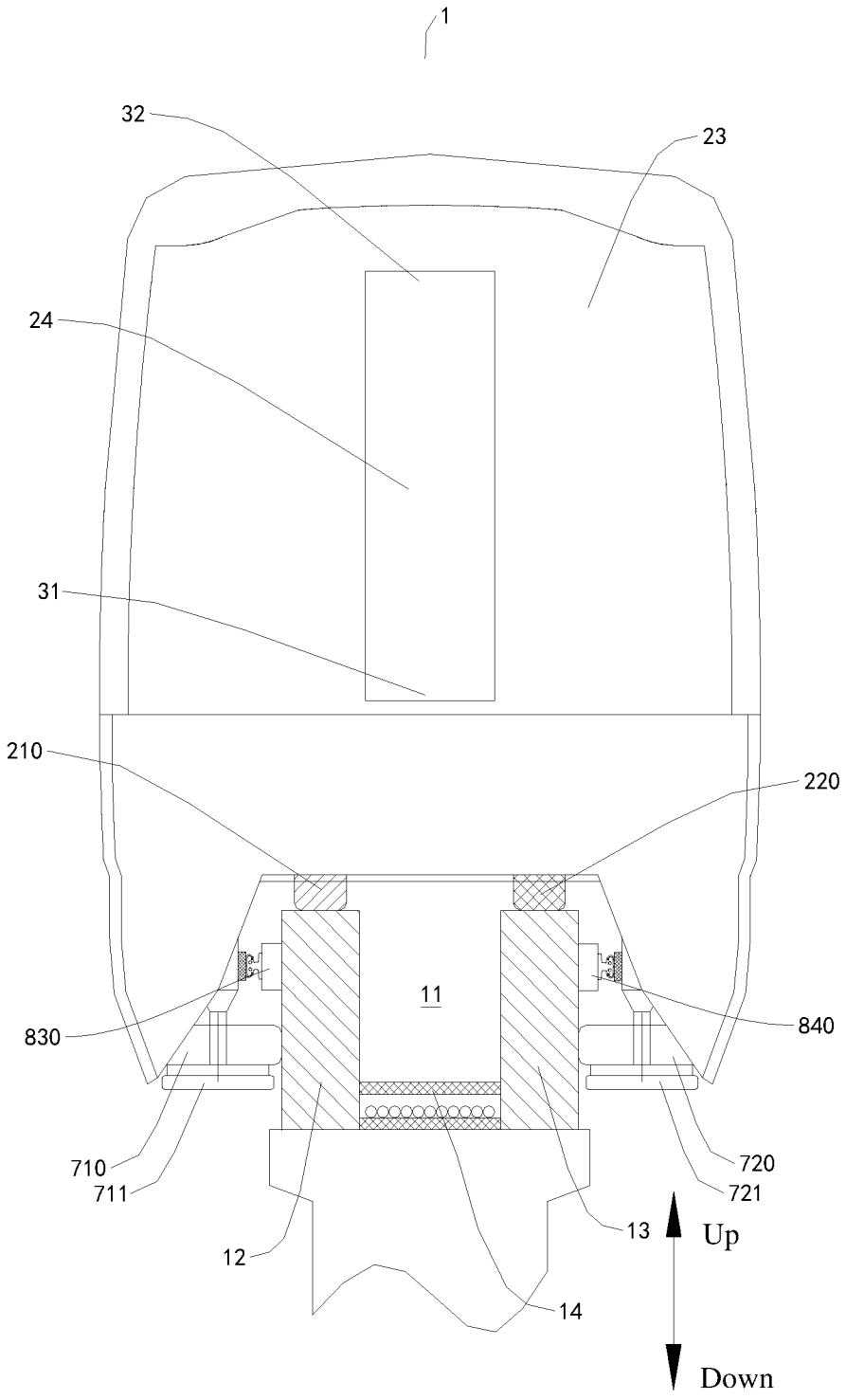
FIG. 5 is a sectional view of a rail transport system according to another embodiment of the present disclosure.

Furthermore, the bogie 21 further includes: a first horizontal safety wheel 711 that moves synchronously with the first horizontal wheel 710 and is connected to the first horizontal wheel and a second horizontal safety wheel 721 that moves synchronously with the second horizontal wheel 720 and is connected to the second horizontal wheel. An external diameter of the first horizontal safety wheel 711 is less than an external diameter of the first horizontal wheel 710. An external diameter of the second horizontal safety wheel 721 is less than an external diameter of the second horizontal wheel 720. Specifically, as shown in FIG. 4, FIG. 5, and FIG. 7, the first horizontal safety wheel 711 that moves synchronously with the first horizontal wheel 710 is connected below the first horizontal wheel 710. The external diameter of the first horizontal safety wheel 711 is less than the external diameter of the first horizontal wheel 710. The second horizontal safety wheel 721 that moves synchronously with the second horizontal wheel 720 is connected below the second horizontal wheel 720. The external diameter of the second horizontal safety wheel 721 is less than the external diameter of the second horizontal wheel 720. Normally, the first horizontal safety wheel 711 and the second horizontal safety wheel 721 are not in contact with a track beam. When a horizontal wheel encounters a blowout, a horizontal safety wheel is in contact with a track beam to replace a horizontal wheel, so as to ensure the stability of running of the rail vehicle 20. For example, when the first horizontal wheel 710 is normal, the first horizontal safety wheel 711 is not in contact with the first track beam 12. When the first horizontal wheel 710 encounters a blowout, the first horizontal safety wheel 711 is in contact with a side surface of the first track beam 12 to replace the first horizontal wheel 710.

Figure 11:
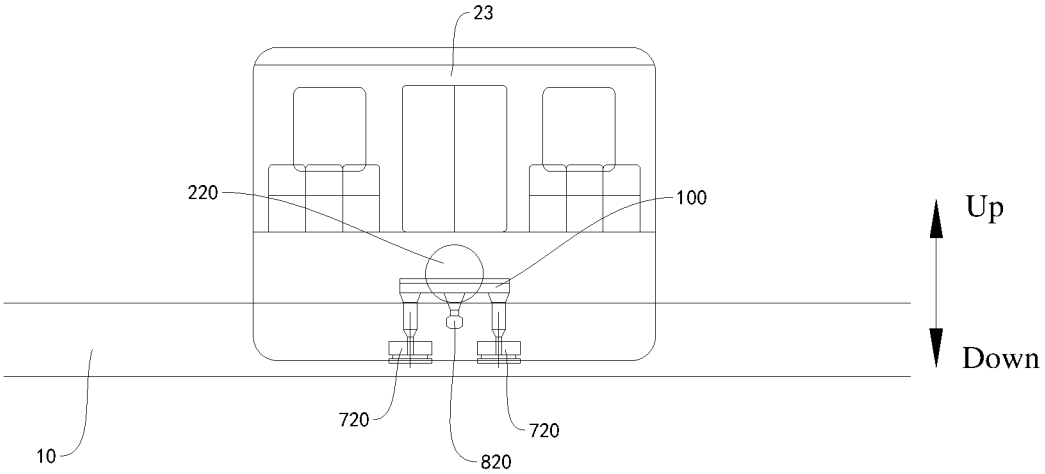
FIG. 11 is a partially schematic view of a rail transport system according to an embodiment of the present disclosure.
Figure 50:
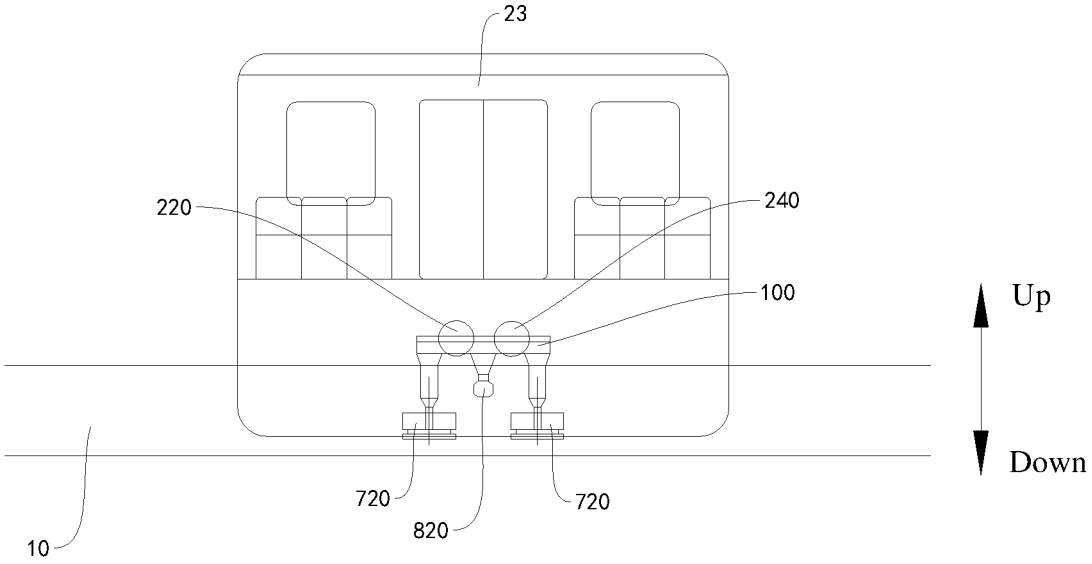
FIG. 50 is a partially schematic view of a rail transport system according to another embodiment of the present disclosure.

In some specific examples of the present disclosure, as shown in FIG. 11 and FIG. 50, the first horizontal wheel 710 and the second horizontal wheel 720 are located at a same height in an up-down direction. FIG. 11 shows an example in which the first horizontal wheel 710 and the second horizontal wheel 720 of the bogie 21 having two running wheels are located at a same height. FIG. 50 shows an example in which the first horizontal wheel 710 and the second horizontal wheel 720 of the bogie 21 having four running wheels are located at a same height. In this way, the balance of overall steering performance of the rail vehicle 20 may be facilitated, and the rail vehicle 20 subjects to even forces when running forwards and backwards, so as to improve the turning performance of the rail vehicle 20.

Figure 12:
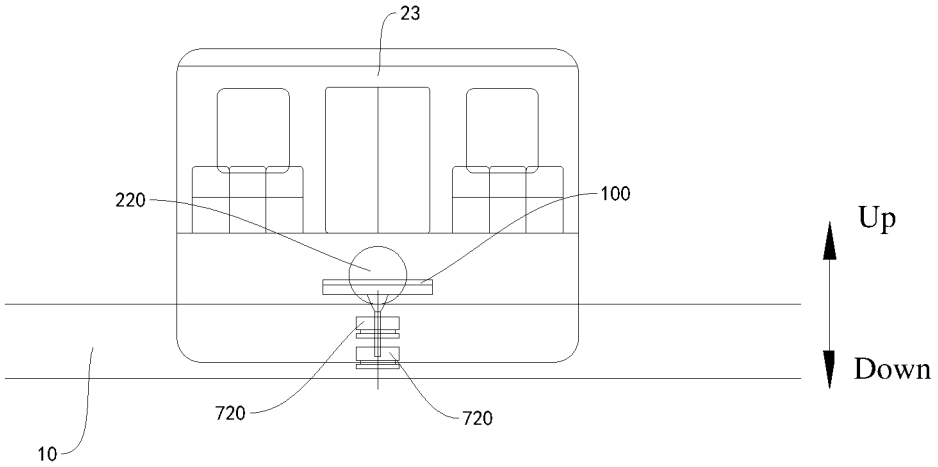
FIG. 12 is a partially schematic view of a rail transport system according to another embodiment of the present disclosure.
Figure 51:
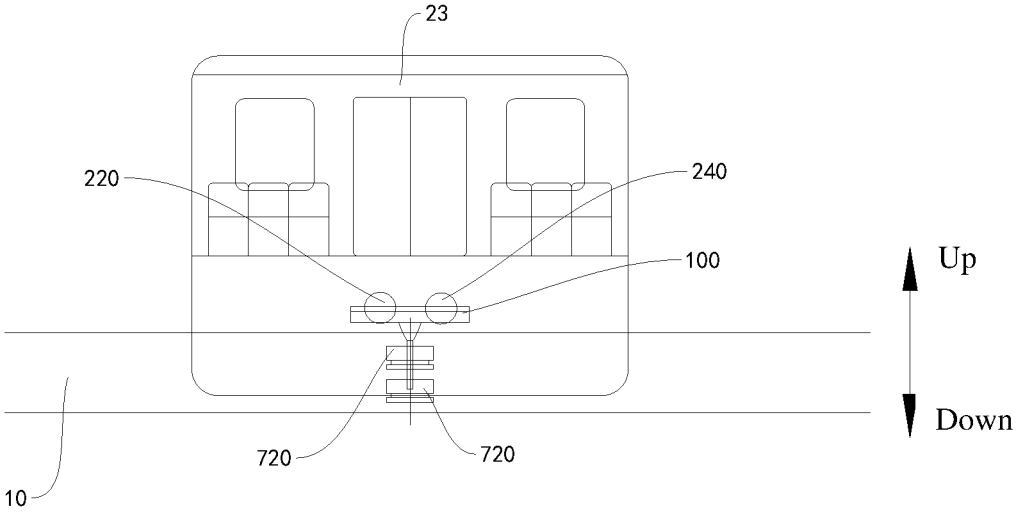
FIG. 51 is a partially schematic view of a rail transport system according to another embodiment of the present disclosure.

In some specific examples of the present disclosure, as shown in FIG. 12 and FIG. 51, a plurality of first horizontal wheels 710 exist and are coaxial and spaced apart in an un-down direction, and a plurality of second horizontal wheels 720 exist and are coaxial and spaced apart in an un-down direction. FIG. 12 shows an example in which the plurality of first horizontal wheels 710 of the bogie 21 having two running wheels are disposed coaxially in the un-down direction and the plurality of second horizontal wheels 720 of the bogie 21 having two running wheels are disposed coaxially in the un-down direction. FIG. 51 shows an example in which the plurality of first horizontal wheels 710 of the bogie 21 having four running wheels are disposed coaxially in the un-down direction and the plurality of second horizontal wheels 720 of the bogie 21 having four running wheels are disposed coaxially in the un-down direction. In this way, the stability performance of an entire vehicle can be improved, and horizontal wheels below have an effect of achieving stabilization, thereby reducing a risk that the rail vehicle 20 overturns during turning or high-speed running.

Figure 13:
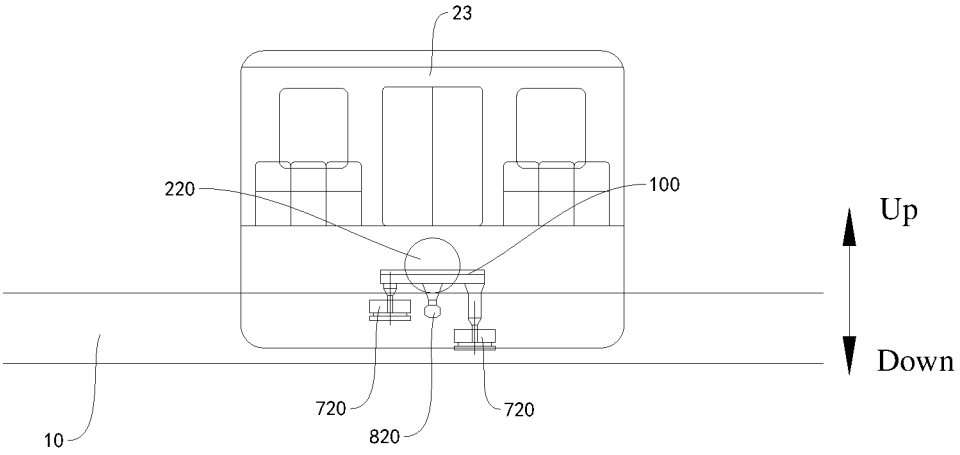
FIG. 13 is a partially schematic view of a rail transport system according to another embodiment of the present disclosure.
Figure 14:
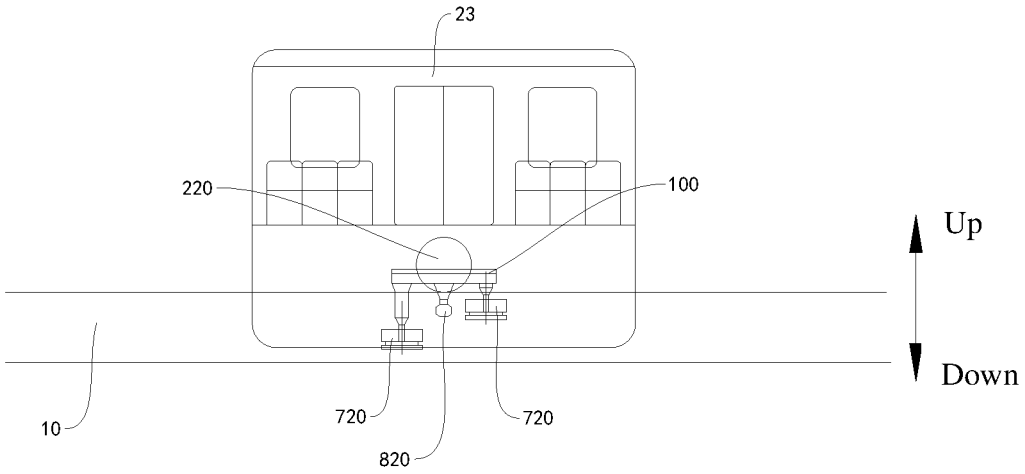
FIG. 14 is a partially schematic view of a rail transport system according to another embodiment of the present disclosure.
Figure 52:
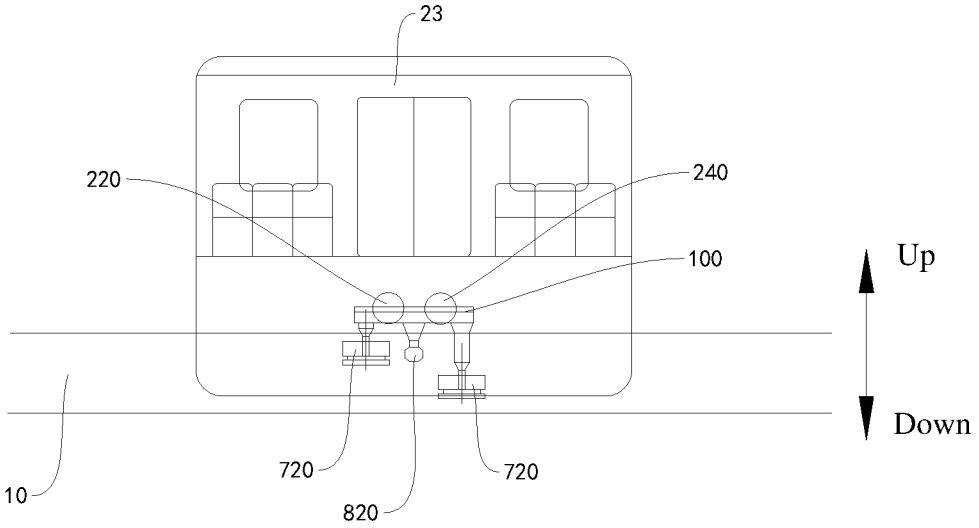
FIG. 52 is a partially schematic view of a rail transport system according to another embodiment of the present disclosure.
Figure 53:
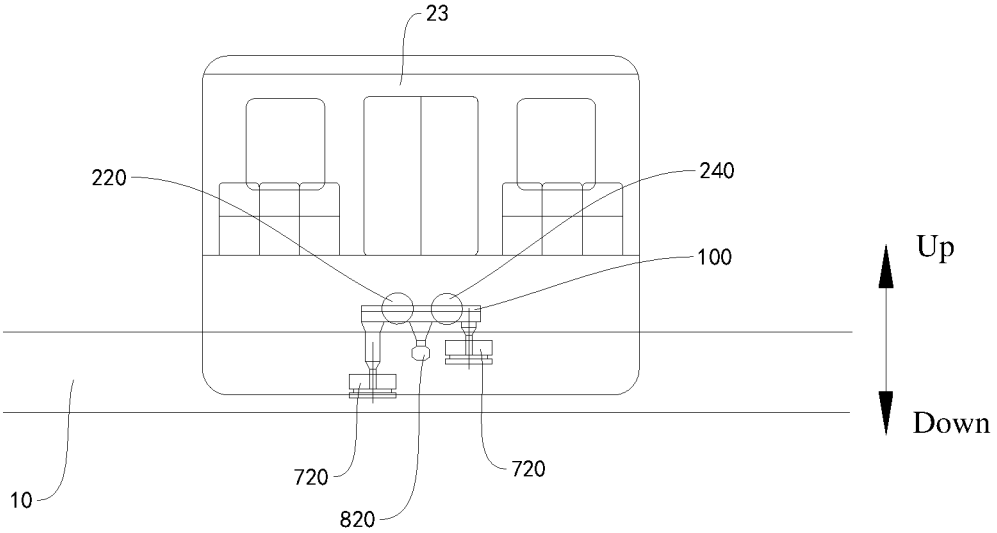
FIG. 53 is a partially schematic view of a rail transport system according to another embodiment of the present disclosure.
Figure 54:
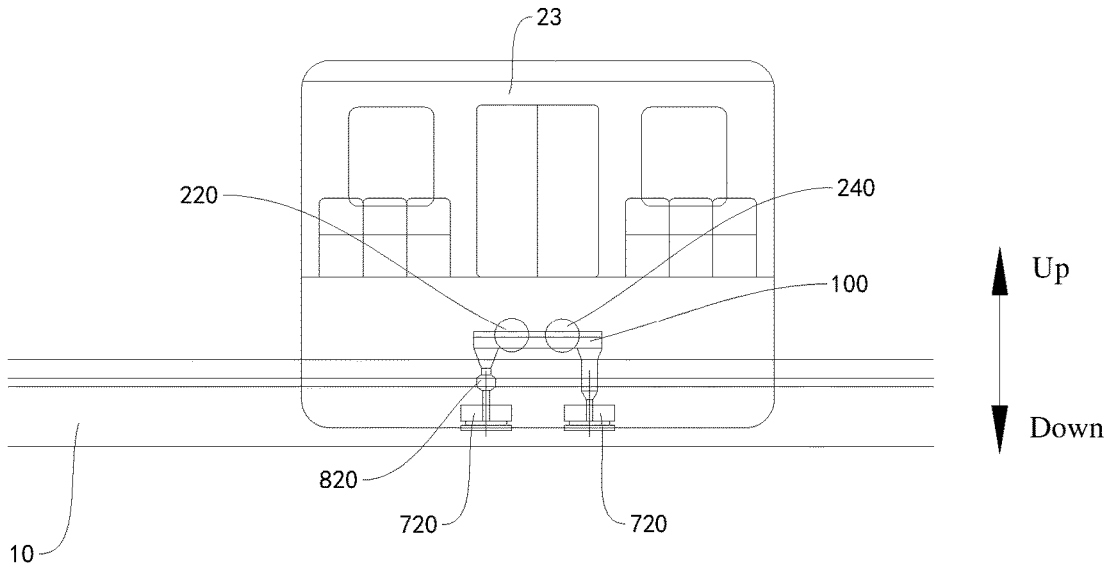
FIG. 54 is a partially schematic view of a rail transport system according to another embodiment of the present disclosure.
Figure 55:
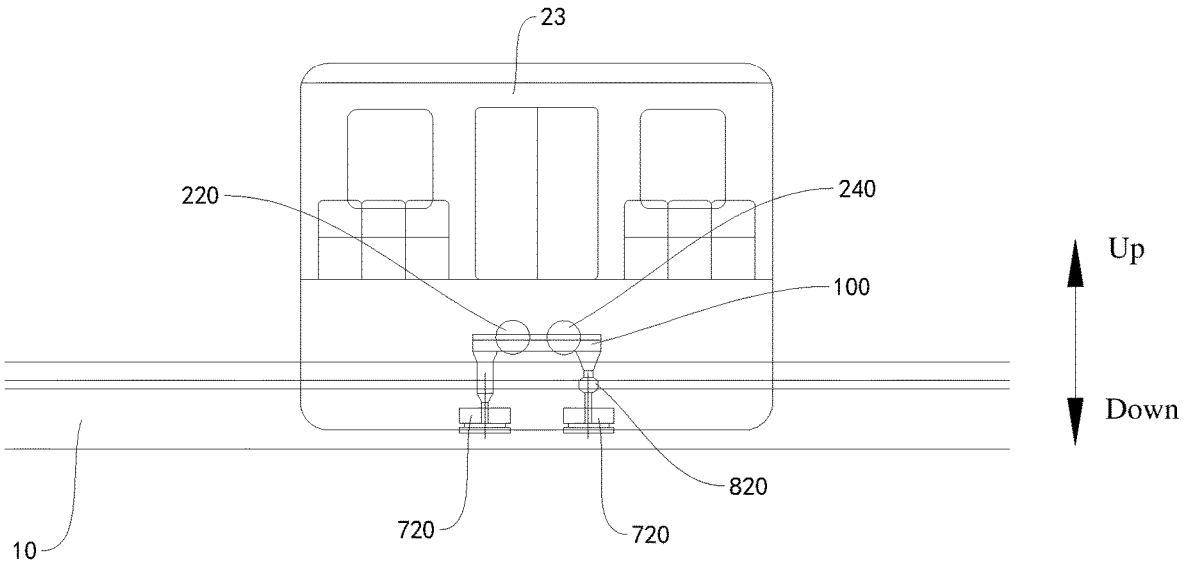
FIG. 55 is a partially schematic view of a rail transport system according to another embodiment of the present disclosure.
Figure 56:
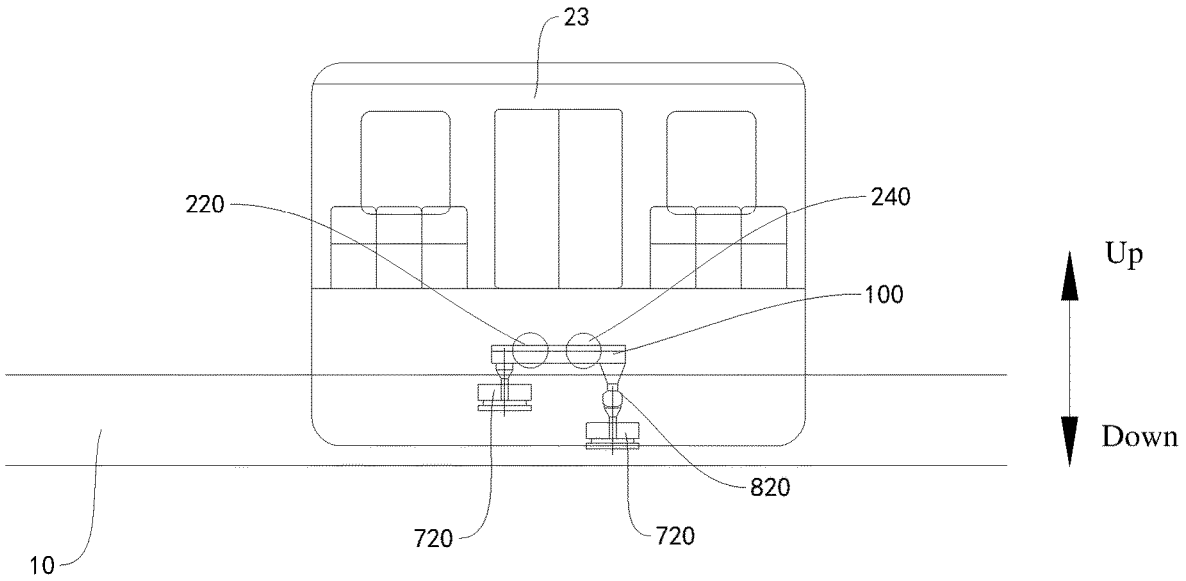
FIG. 56 is a partially schematic view of a rail transport system according to another embodiment of the present disclosure.
Figure 57:
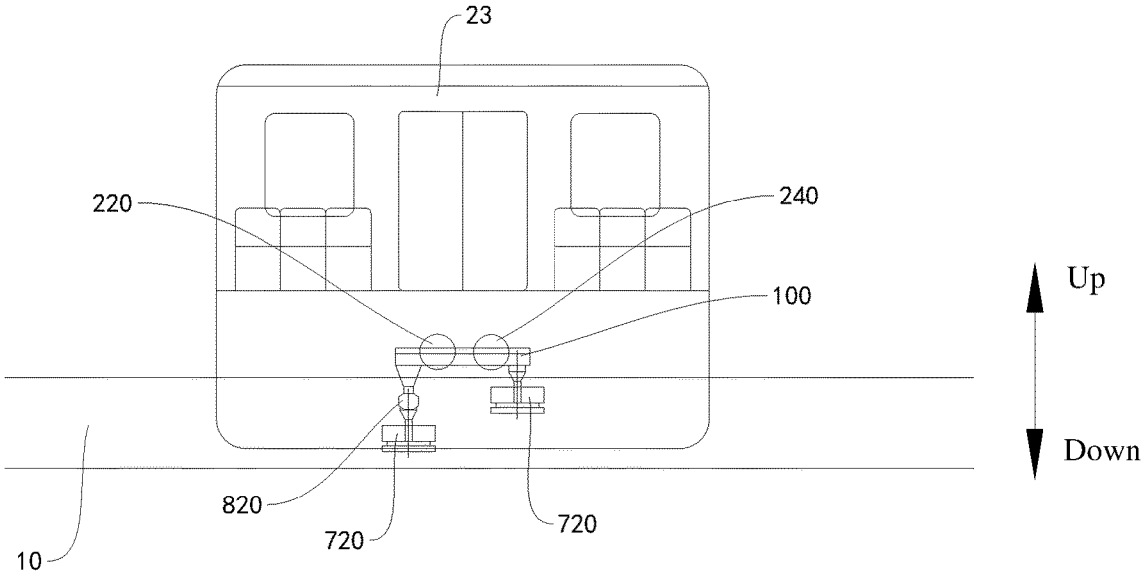
FIG. 57 is a partially schematic view of a rail transport system according to another embodiment of the present disclosure.

In some specific examples of the present disclosure, as shown in FIG. 13, FIG. 14, FIG. 52, and FIG. 53, a plurality of first horizontal wheels 710 exist and are spaced apart in an up-down direction and the lengthwise direction of the first track beam 12 respectively. A plurality of second horizontal wheels 720 exist and are spaced apart in an up-down direction and the lengthwise direction of the second track beam 13 respectively. That is, the plurality of first horizontal wheels 710 are disposed in a staggered manner in the up-down direction, and the plurality of second horizontal wheels 720 are disposed in a staggered manner in the up-down direction. That is the nth horizontal wheel 710 may be located above/below the (n+1)th horizontal wheel 710, the (n+2)th horizontal wheel 710 may be located above/ below the (n+1)th horizontal wheel 710, in an embodiment, the nth horizontal wheel 710 and the (n+2)th horizontal wheel 710 are located at a same height, in which n represents an integer equal to or greater than 1. The first horizontal wheels 710 may be located above the second horizontal wheel 720, or the first horizontal wheels 710 may be located below the second horizontal wheel 720. FIG. 13 and FIG. 14 show an example in which the plurality of first horizontal wheels 710 of the bogie 21 having two running wheels are disposed in a staggered manner in the up-down direction and the plurality of second horizontal wheels 720 of the bogie 21 having two running wheels are disposed in a staggered manner in the up-down direction. FIG. 52 and FIG. 53 show an example in which the plurality of first horizontal wheels 710 of the bogie 21 having four running wheels are disposed in a staggered manner in the up-down direction and the plurality of second horizontal wheels 720 of the bogie 21 having four running wheels are disposed in a staggered manner in the up-down direction. In this way, during running in a corresponding direction, the horizontal wheels above can have a guiding effect, and the horizontal wheels below are relatively far away from the vehicle body 22 and can achieve an effect of stabilization and overturning prevention.

Figure 15:
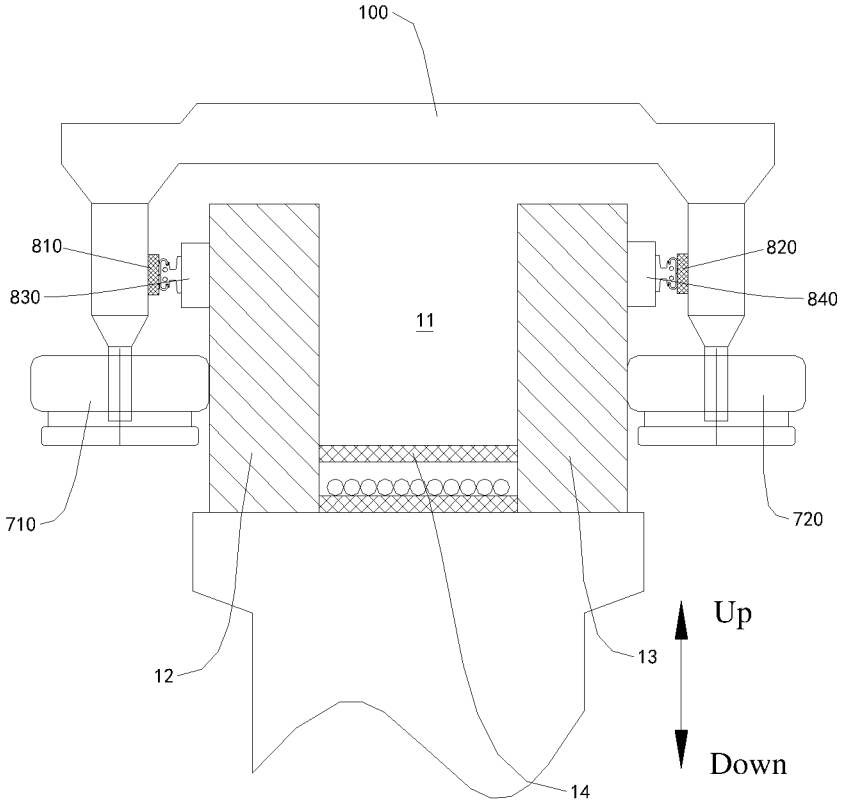
FIG. 15 is a schematic view of a rail of a bogie of a rail vehicle according to an embodiment of the present disclosure.

In some specific embodiments of the present disclosure, as shown in FIG. 15, the first horizontal wheel 710 is fit on the outer side surface of the first track beam 12, and the second horizontal wheel 720 is fit on the outer side surface of the second track beam 13. That is, the horizontal wheels are both fit on outer side surfaces of the rail 10. In this way, a center-to-center distance between two horizontal wheels is designed to be a distance as large as possible, so that the stability performance of the system can be improved, and the center-of-gravity distribution of the bogie 21 and the entire vehicle are facilitated.

Figure 16:
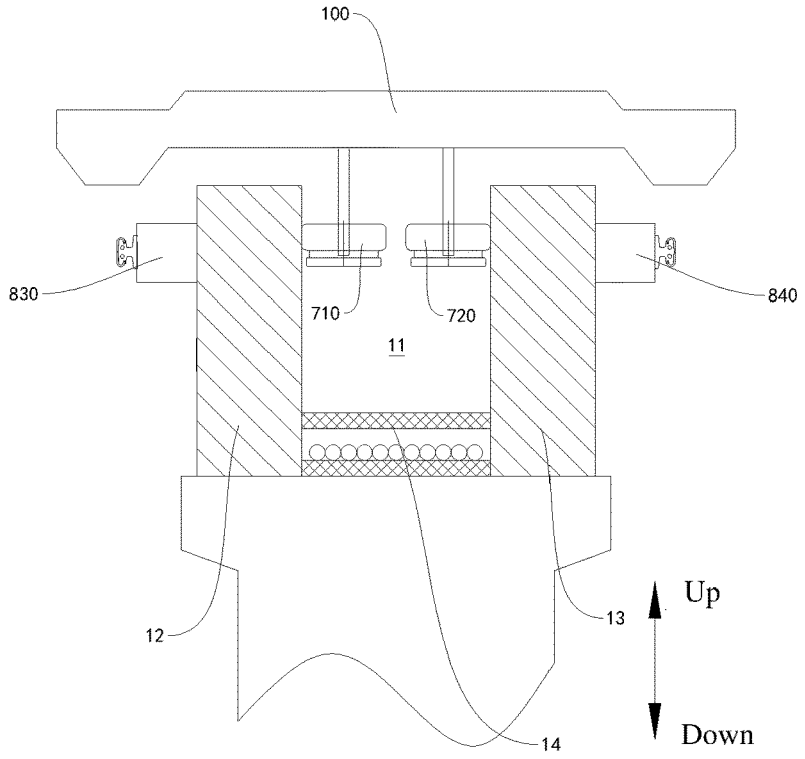
FIG. 16 is a schematic view of a rail of a bogie of a rail vehicle according to another embodiment of the present disclosure.

In some specific embodiments of the present disclosure, as shown in FIG. 16, the first horizontal wheel 710 is fit on the inner side surface of the first track beam 12. The second horizontal wheel 720 is fit on the inner side surface of the second track beam 13. That is, the horizontal wheels are both fit on inner side surfaces of the rail 10. In this way, space inside the rail 10 can be effectively utilized, thereby improving space utilization of the entire vehicle. Moreover, the horizontal wheels and a conductor rail are respectively located on two sides of a track beam, so that space at a lower portion of the vehicle body 22 can be effectively reduced, thereby reducing the height of the entire vehicle.

Figure 17:
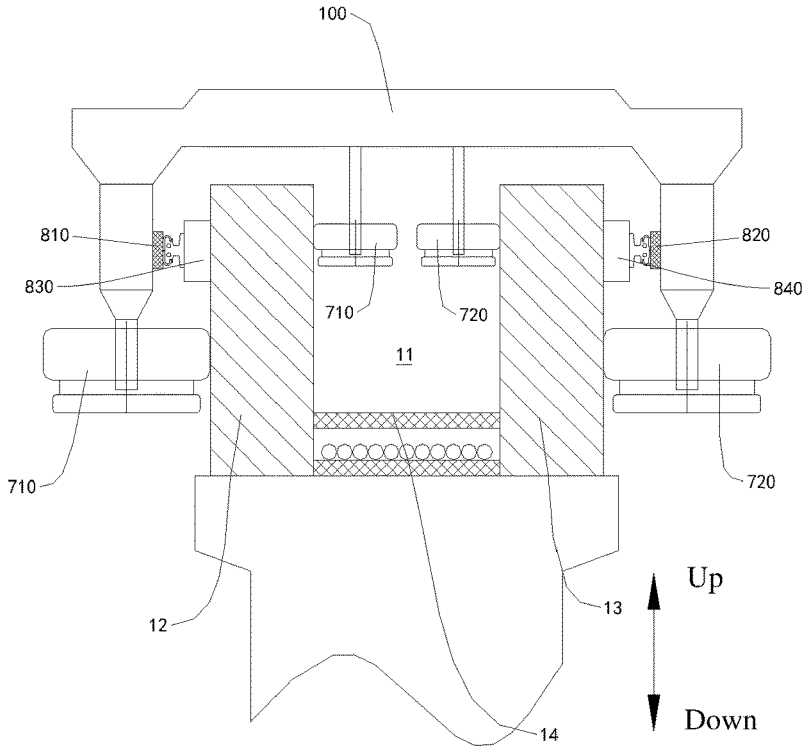
FIG. 17 is a schematic view of a rail of a bogie of a rail vehicle according to another embodiment of the present disclosure.
Figure 18:
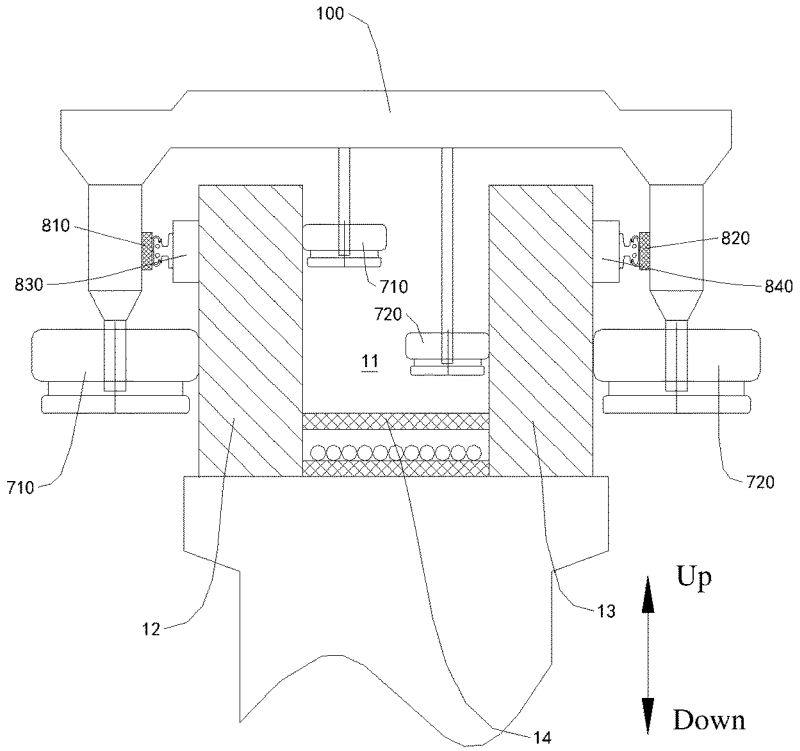
FIG. 18 is a schematic view of a rail of a bogie of a rail vehicle according to another embodiment of the present disclosure.
Figure 19:
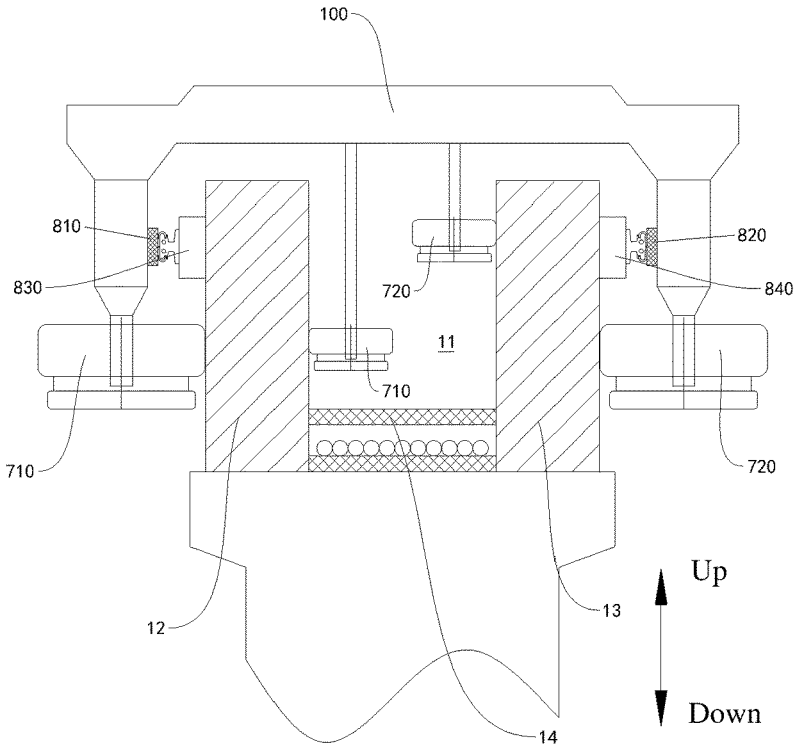
FIG. 19 is a schematic view of a rail of a bogie of a rail vehicle according to another embodiment of the present disclosure.
Figure 20:
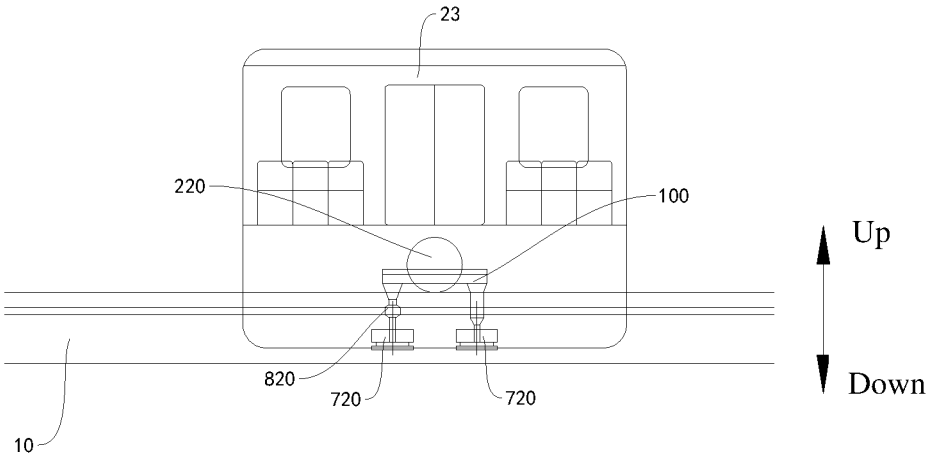
FIG. 20 is a partially schematic view of a rail transport system according to another embodiment of the present disclosure.
Figure 21:
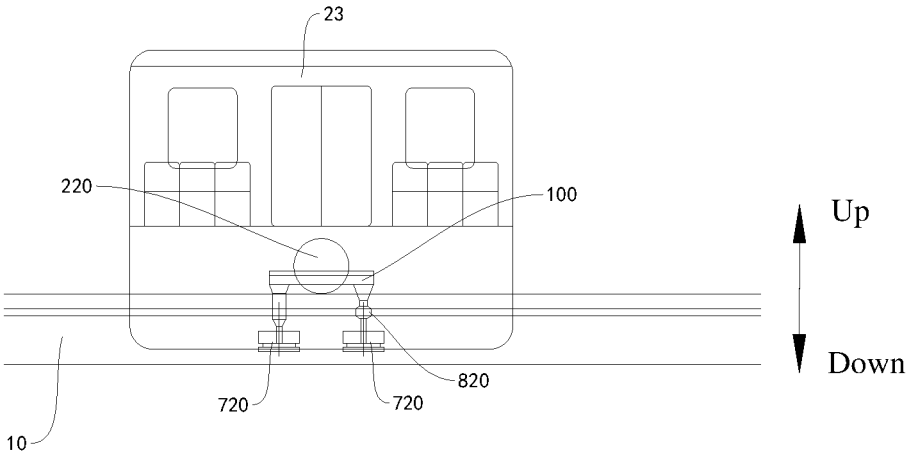
FIG. 21 is a partially schematic view of a rail transport system according to another embodiment of the present disclosure.
Figure 22:
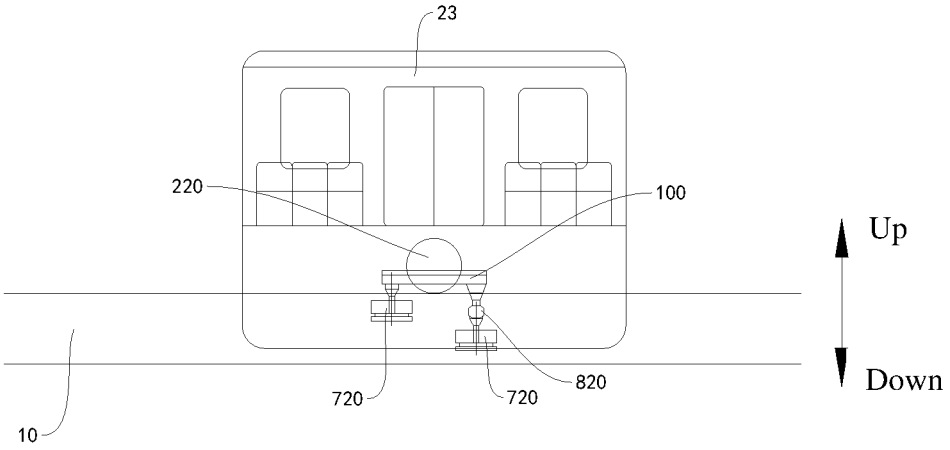
FIG. 22 is a partially schematic view of a rail transport system according to another embodiment of the present disclosure.
Figure 23:
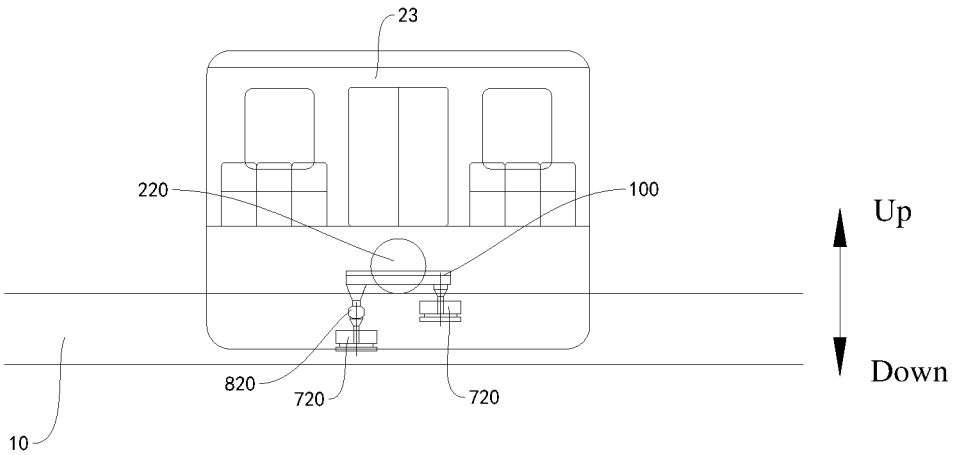
FIG. 23 is a partially schematic view of a rail transport system according to another embodiment of the present disclosure.

In some other specific embodiments of the present disclosure, as shown in FIG. 17 to FIG. 19, a plurality of first horizontal wheels 710 exist and are respectively fit on the outer side surface and the inner side surface of the first track beam 12. A plurality of second horizontal wheels 720 exist and are respectively fit on the outer side surface and the inner side surface of the second track beam 13. That is, horizontal wheels are fit on both an outer side surface and an inner side surface of the rail 10, and the horizontal wheels are arranged on both an inner side and an outer side at the same time. The horizontal wheels on the inner side achieve effects of stabilization and overturning prevention, so that the stability performance and safety performance of the rail vehicle 20 can be significantly improved.

Optionally, as shown in FIG. 17, the first horizontal wheel 710 that is fit on the inner side surface of the first track beam 12 and the second horizontal wheel 720 that is fit on the inner side surface of the second track beam 13 are located at a same height in an up-down direction. As shown in FIG. 18 and FIG. 19, the first horizontal wheel 710 that is fit on the inner side surface of the first track beam 12 and the second horizontal wheel 720 that is fit on the inner side surface of the second track beam 13 are located at different heights in an up-down direction. For example, as shown in FIG. 18, the first horizontal wheel 710 that is fit on the inner side surface of the first track beam 12 is higher than the second horizontal wheel 720 that is fit on the inner side surface of the second track beam 13. For another example, as shown in FIG. 19, the first horizontal wheel 710 that is fit on the inner side surface of the first track beam 12 is lower than the second horizontal wheel 720 that is fit on the inner side surface of the second track beam 13.

In an embodiment, the first horizontal wheel 710 that is fit on the inner side surface of the first track beam 12 and the second horizontal wheel 720 that is fit on the inner side surface of the second track beam 13 may be located at a same height or at different heights in an up-down direction, at the same time, the first horizontal wheel 710 that is fit on the outer side surface of the first track beam 12 and the second horizontal wheel 720 that is fit on the outer side surface of the second track beam 13 may be located at a same height or at different heights in an up-down direction.

In some examples of the present disclosure, as shown in FIG. 11 to FIG. 41 and FIG. 50 to FIG. 57, the bogie 21 further includes a first collector shoe 810 and a second collector shoe 820.

A first conductor rail 830 extending in the lengthwise direction of the first track beam 12 is disposed on the outer side surface of the first track beam 12. A second conductor rail 840 extending in the lengthwise direction of the second track beam 13 is disposed on the outer side surface of the second track beam 13. The first collector shoe 810 is disposed on the bogie frame 100 and is fit with the first conductor rail 830. The second collector shoe 820 is disposed on the bogie frame 100 and is fit with the second conductor rail 840. The first collector shoe 810 draws electricity through the first conductor rail 830, and the second collector shoe 820 draws electricity through the second conductor rail 840, so that the electricity is supplied for use by the rail vehicle 20.

In some specific examples of the present disclosure, as shown in FIG. 11, FIG. 13, FIG. 14, FIG. 50, FIG. 52, and FIG. 53, a plurality of first horizontal wheels 710 exist and are spaced apart in the lengthwise direction of the first track beam 12. The first collector shoe 810 is located between adjacent first horizontal wheels 710 in the lengthwise direction of the first track beam 12. A plurality of second horizontal wheels 720 exist and are spaced apart in the lengthwise direction of the second track beam 13. The second collector shoe 820 is located between adjacent second horizontal wheels 720 in the lengthwise direction of the second track beam 13. In this way, a force applied on the first horizontal wheel 710 does not affect the first collector shoe 810 and a force applied on the second horizontal wheel 720 does not affect the second collector shoe 820, space utilization can be improved, and the structure of the bogie 21 is simplified.

For example, FIG. 11, FIG. 13, and FIG. 14 show an example in which the first collector shoe 810 of the bogie 21 having two running wheels is located between adjacent first horizontal wheels 710 in the lengthwise direction of the first track beam 12 and the second collector shoe 820 of the bogie 21 having two running wheels is located between adjacent second horizontal wheels 720 in the lengthwise direction of the second track beam 13. The plurality of first horizontal wheels 710 and the plurality of second horizontal wheels 720 may be located at a same height. The plurality of first horizontal wheels 710 may be disposed in a staggered manner in the up-down direction and the plurality of second horizontal wheels 720 may also be disposed in a staggered manner in the up-down direction.

FIG. 50, FIG. 52, and FIG. 53 show example in which the first collector shoe 810 of the bogie 21 having four running wheels is located between adjacent first horizontal wheels 710 in the lengthwise direction of the first track beam 12 and the second collector shoe 820 of the bogie 21 having four running wheels is located between adjacent second horizontal wheels 720 in the lengthwise direction of the second track beam 13. The plurality of first horizontal wheels 710 and the plurality of second horizontal wheels 720 may be located at a same height. The plurality of first horizontal wheels 710 may be disposed in a staggered manner in the up-down direction and the plurality of second horizontal wheels 720 may also be disposed in a staggered manner in the up-down direction.

In some specific examples of the present disclosure, as shown in FIG. 20 to FIG. 23 and FIG. 54 to FIG. 57, a plurality of first horizontal wheels 710 exist and are spaced apart in the lengthwise direction of the first track beam 12. The first collector shoe 810 and one of the plurality of first horizontal wheels 710 are aligned in the up-down direction. For example, a central axis of the first collector shoe 810 and a central axis of the one of the plurality of first horizontal wheels 710 coincide. A plurality of second horizontal wheels 720 exist and are spaced apart in the lengthwise direction of the second track beam 13. The second collector shoe 820 and one of the plurality of second horizontal wheels 720 are aligned in the up-down direction. For example, a central axis of the second collector shoe 820 and a central axis of the one of the plurality of second horizontal wheels 720 coincide. In other words, collector shoes are disposed in the front or in the rear. In this way, mounting space of the horizontal wheels can be fully utilized, no additional mounting mechanism is needed, so that the structure of the bogie 21 is simplified and the weight of the bogie 21 is reduced.

For example, FIG. 20 to FIG. 23 show examples in which collector shoes of the bogie 21 having two running wheels are disposed in the front or in the rear. The plurality of first horizontal wheels 710 and the plurality of second horizontal wheels 720 may be located at a same height. The plurality of first horizontal wheels 710 may also be located at different heights and the plurality of second horizontal wheels 720 may also be located at different heights.

FIG. 54 to FIG. 57 show examples in which collector shoes of the bogie 21 having four running wheels are disposed in the front or in the rear. The plurality of first horizontal wheels 710 and the plurality of second horizontal wheels 720 may be located at a same height. The plurality of first horizontal wheels 710 may also be located at different heights and the plurality of second horizontal wheels 720 may also be located at different heights.

In some specific embodiments of the present disclosure, as shown in FIG. 24 to FIG. 28, the first collector shoe 810 is located above each first horizontal wheel 710, and the second collector shoe 820 is located above each second horizontal wheel 720. A distance between the collector shoe and the driving device 300 is reduced, which facilitates energy transfer and improves space utilization.

Figure 24:
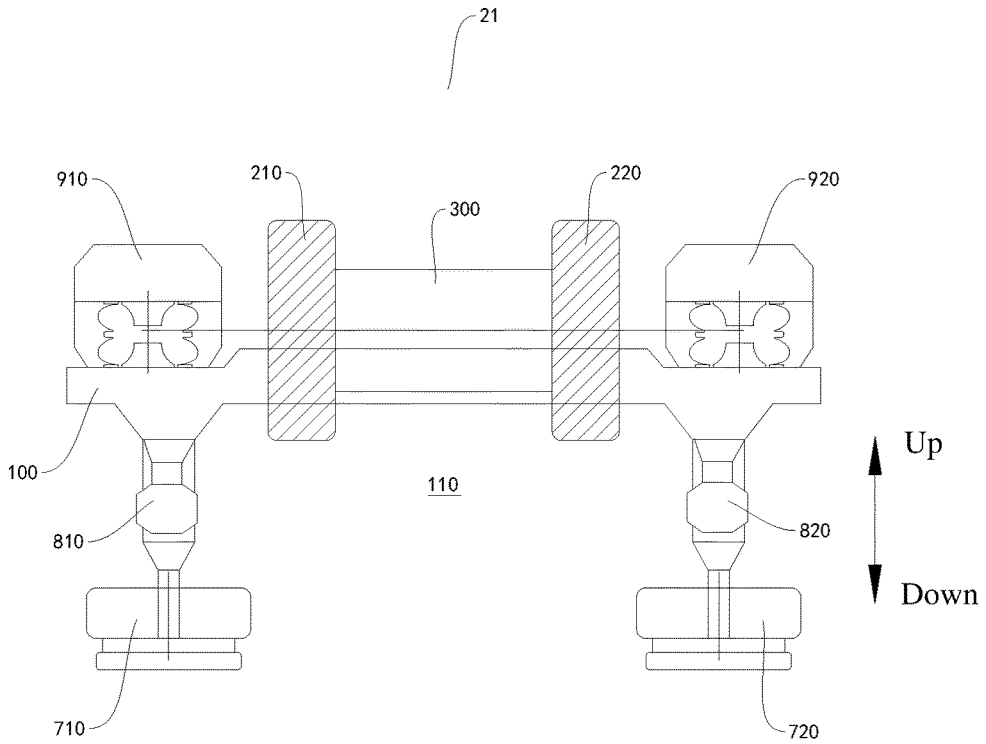
FIG. 24 is a sectional view of a bogie of a rail vehicle according to an embodiment of the present disclosure.
Figure 25:
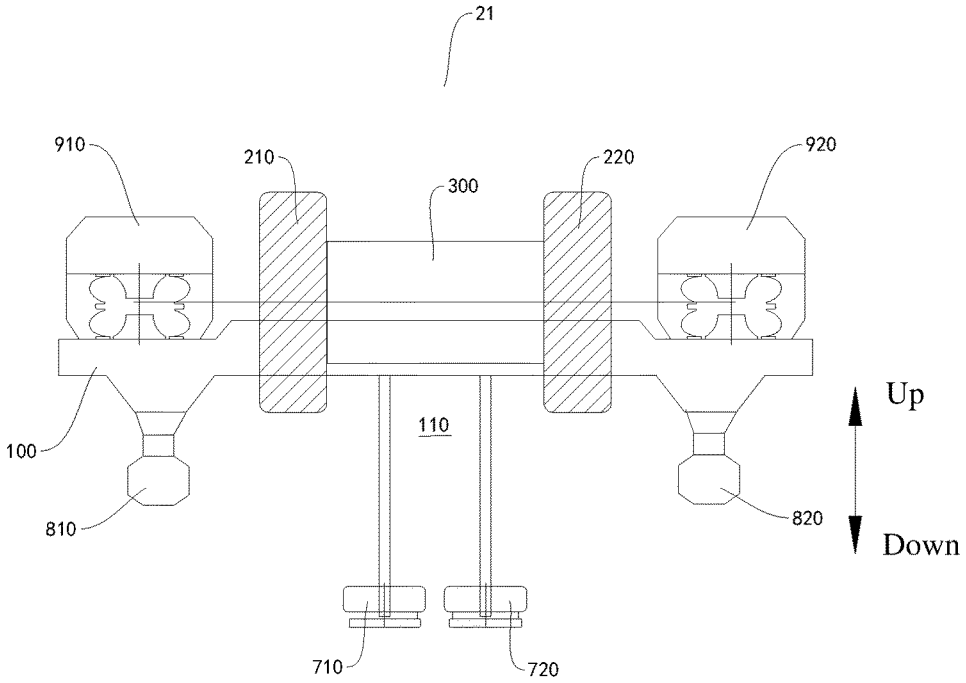
FIG. 25 is a sectional view of a bogie of a rail vehicle according to another embodiment of the present disclosure.
Figure 26:
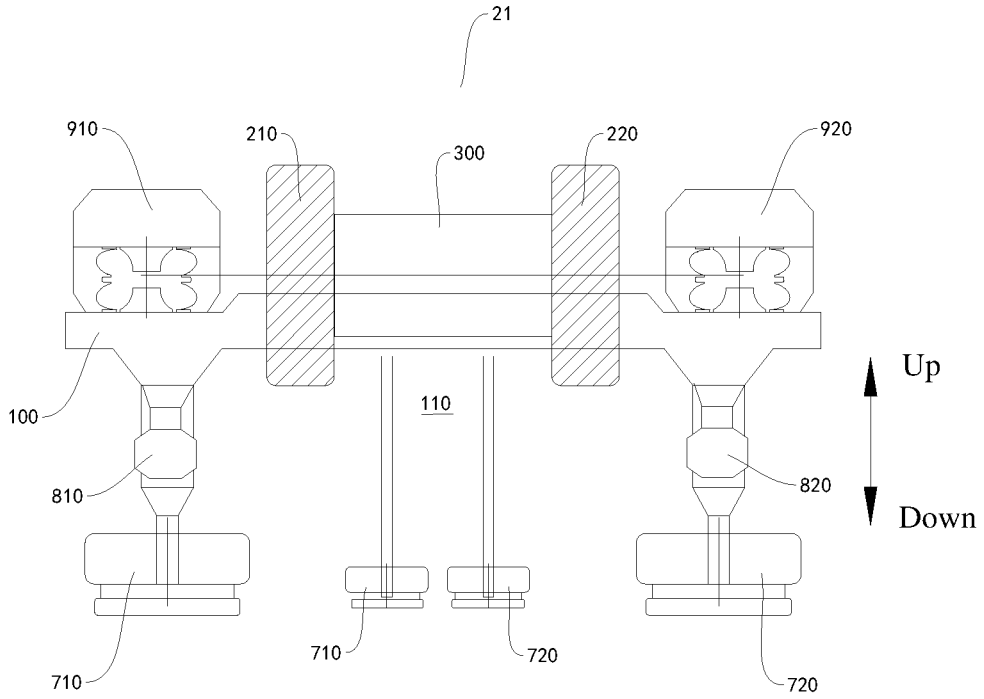
FIG. 26 is a sectional view of a bogie of a rail vehicle according to another embodiment of the present disclosure.
Figure 27:
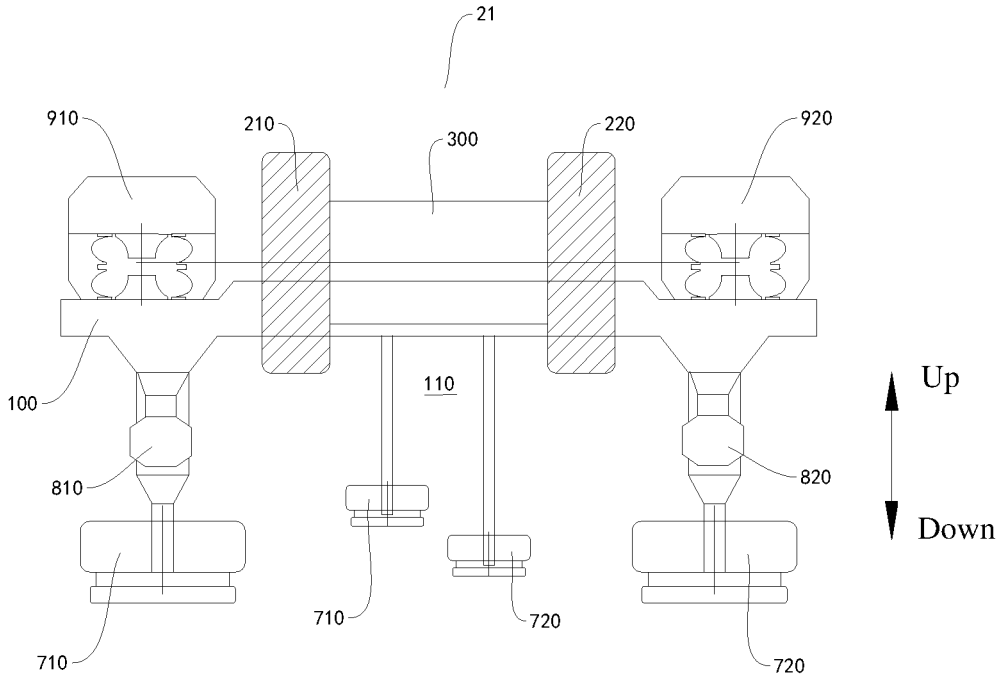
FIG. 27 is a sectional view of a bogie of a rail vehicle according to another embodiment of the present disclosure.
Figure 28:
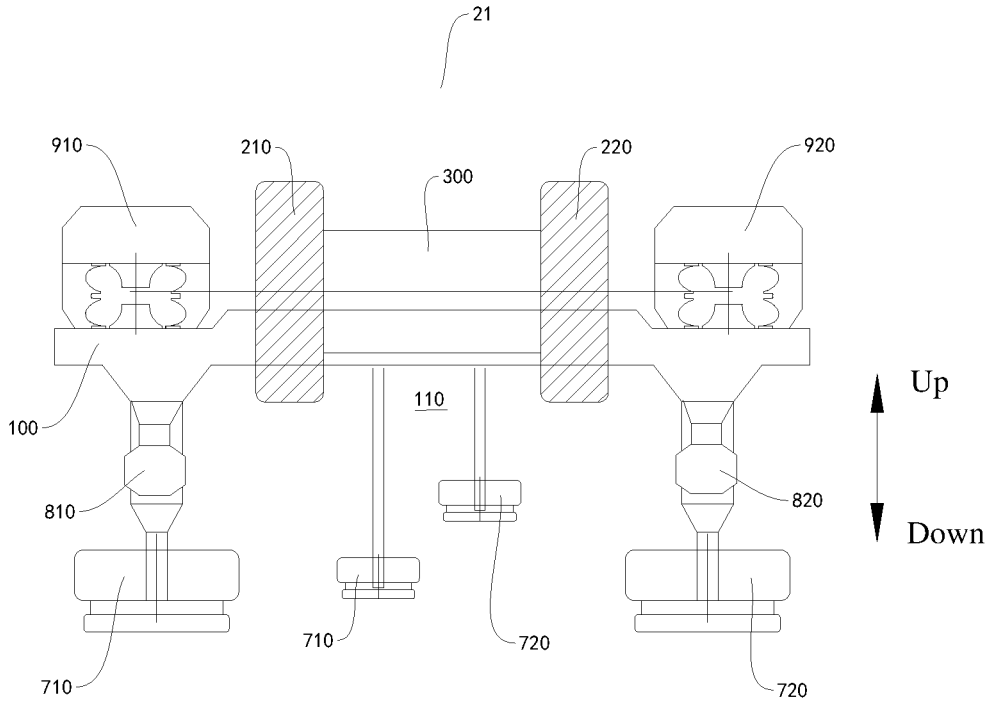
FIG. 28 is a sectional view of a bogie of a rail vehicle according to another embodiment of the present disclosure.

For example, the first horizontal wheel 710 may be fit on the outer side surface of the first track beam 12 and the second horizontal wheel 720 may be fit on the outer side surface of the second track beam 13 (as shown in FIG. 24). The first horizontal wheel 710 may also be fit on the inner side surface of the first track beam 12 and the second horizontal wheel 720 may also be fit on the inner side surface of the second track beam 13 (as shown in FIG. 25). The plurality of first horizontal wheels 710 may be further respectively fit on the inner side surface and the outer side surface of the first track beam 12 and the plurality of second horizontal wheels 720 may be further respectively fit on the inner side surface and the outer side surface of the second track beam 13 (as shown in FIG. 26 to FIG. 28). The first horizontal wheel 710 that is fit on the inner side surface of the first track beam 12 and the second horizontal wheel 720 that is fit on the inner side surface of the second track beam 13 are located at a same height or located at different heights.

In some specific embodiments of the present disclosure, as shown in FIG. 29 to FIG. 33, the first collector shoe 810 is located below each first horizontal wheel 710, and the second collector shoe 820 is located below each second horizontal wheel 720. In this way, a horizontal wheel is arranged at a position near an upper portion of a track beam, to facilitate stability of the rail vehicle 20 during running.

Figure 29:
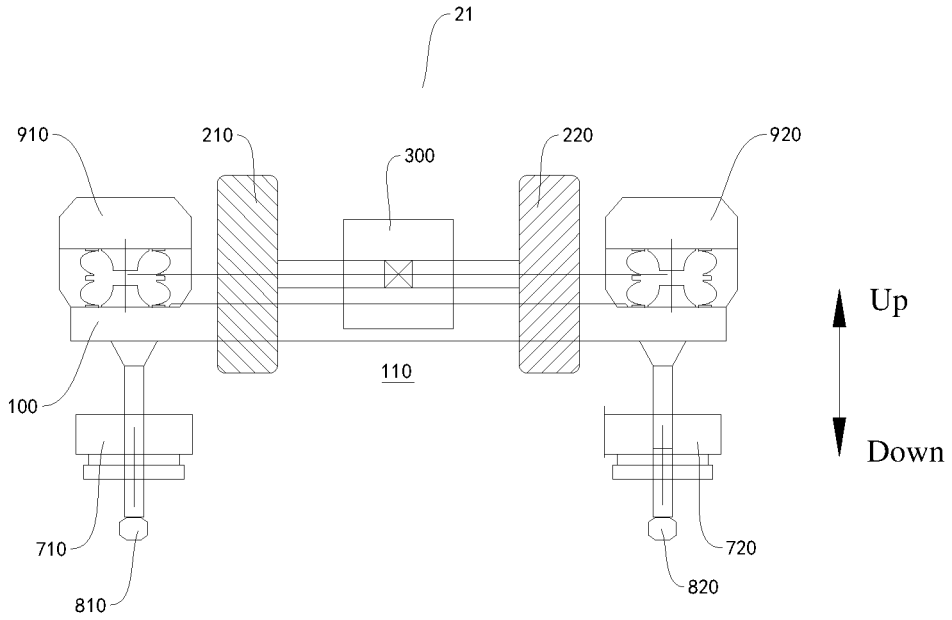
FIG. 29 is a sectional view of a bogie of a rail vehicle according to another embodiment of the present disclosure.
Figure 30:
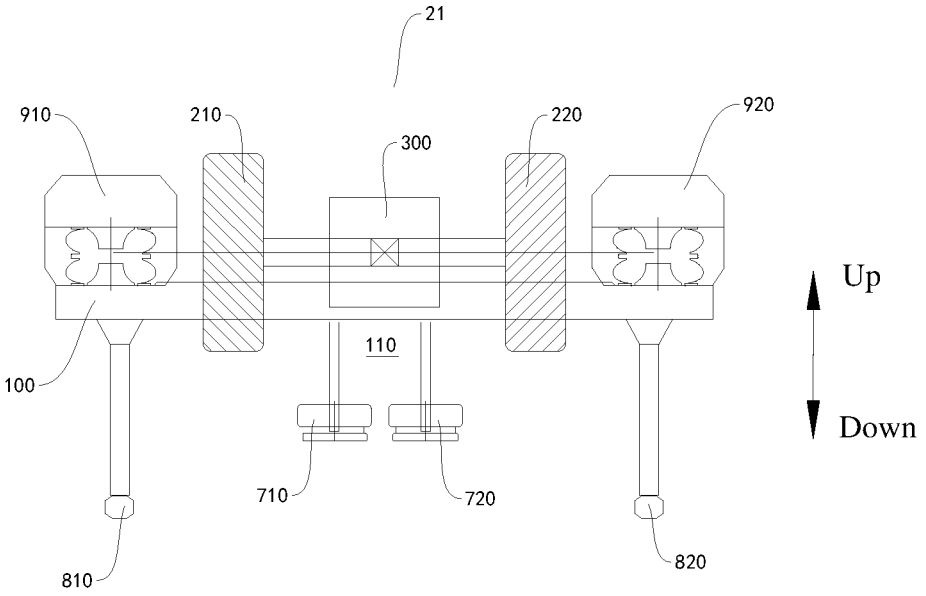
FIG. 30 is a sectional view of a bogie of a rail vehicle according to another embodiment of the present disclosure.
Figure 31:
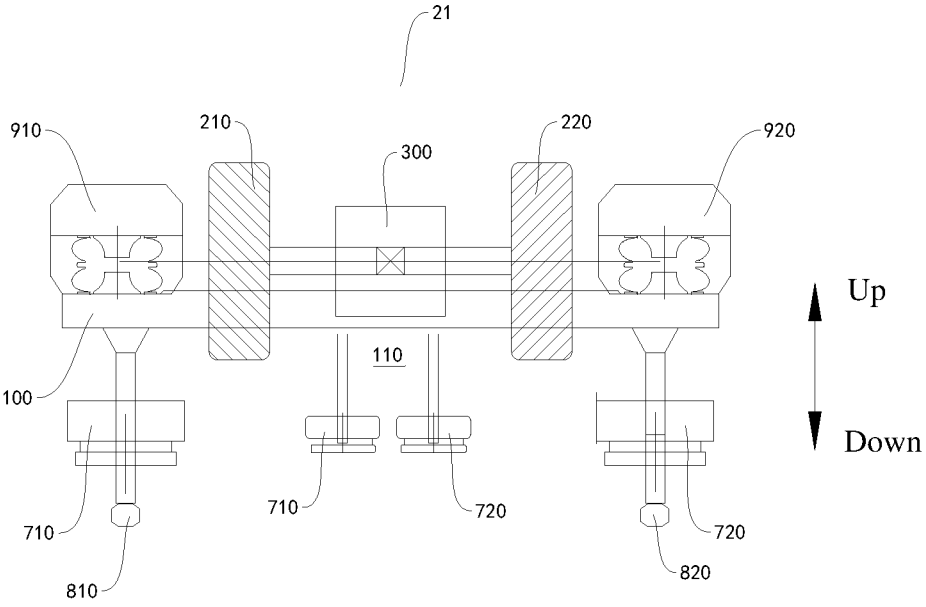
FIG. 31 is a sectional view of a bogie of a rail vehicle according to another embodiment of the present disclosure.
Figure 32:
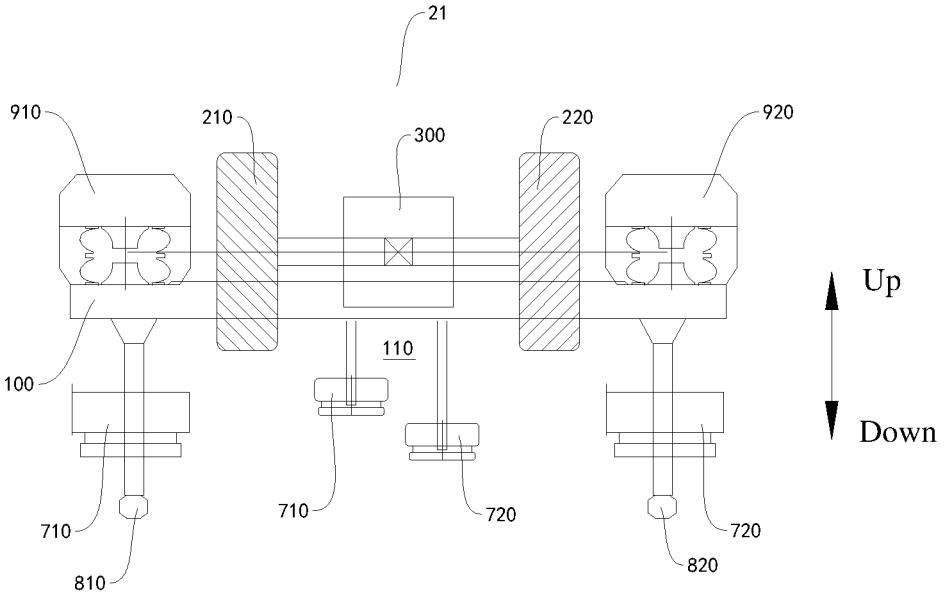
FIG. 32 is a sectional view of a bogie of a rail vehicle according to another embodiment of the present disclosure.
Figure 33:
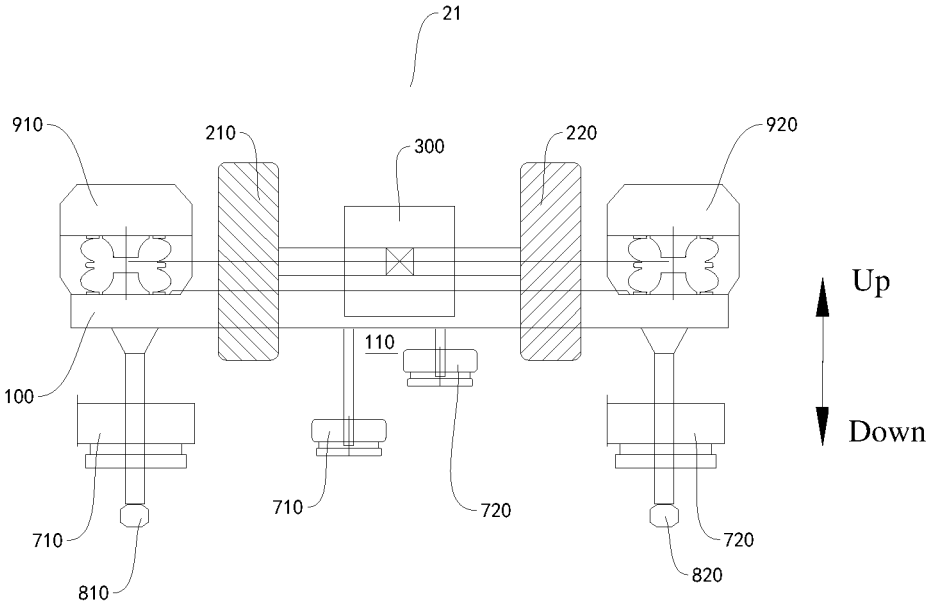
FIG. 33 is a sectional view of a bogie of a rail vehicle according to another embodiment of the present disclosure.

For example, the first horizontal wheel 710 may be fit on the outer side surface of the first track beam 12 and the second horizontal wheel 720 may be fit on the outer side surface of the second track beam 13 (as shown in FIG. 29). The first horizontal wheel 710 may also be fit on the inner side surface of the first track beam 12 and the second horizontal wheel 720 may also be fit on the inner side surface of the second track beam 13 (as shown in FIG. 30). The plurality of first horizontal wheels 710 may be further respectively fit on the inner side surface and the outer side surface of the first track beam 12 and the plurality of second horizontal wheels 720 may be further respectively fit on the inner side surface and the outer side surface of the second track beam 13 (as shown in FIG. 31 to FIG. 33). The first horizontal wheel 710 that is fit on the inner side surface of the first track beam 12 and the second horizontal wheel 720 that is fit on the inner side surface of the second track beam 13 are located at a same height or located at different heights.

Figure 34:
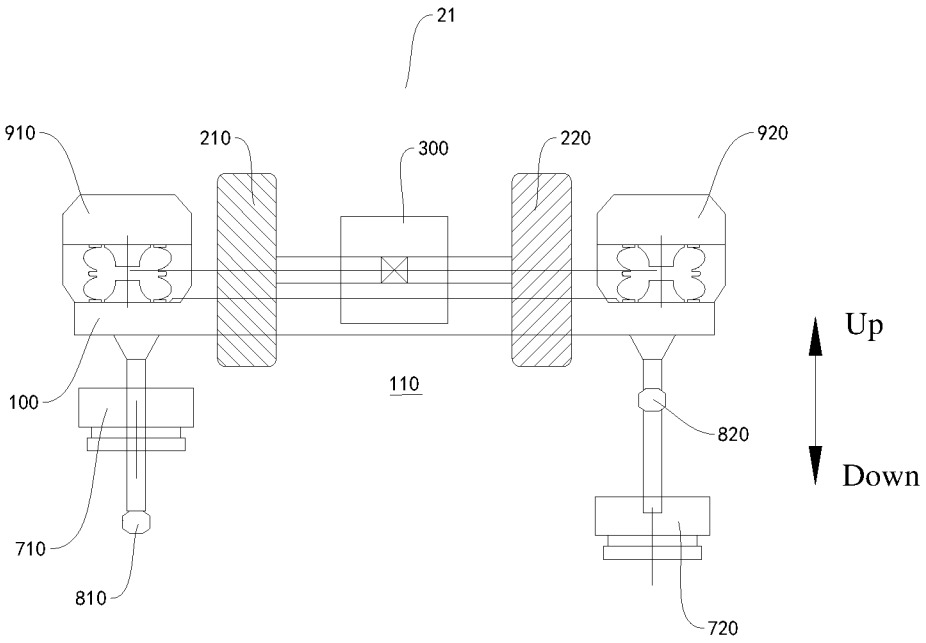
FIG. 34 is a sectional view of a bogie of a rail vehicle according to another embodiment of the present disclosure.
Figure 35:
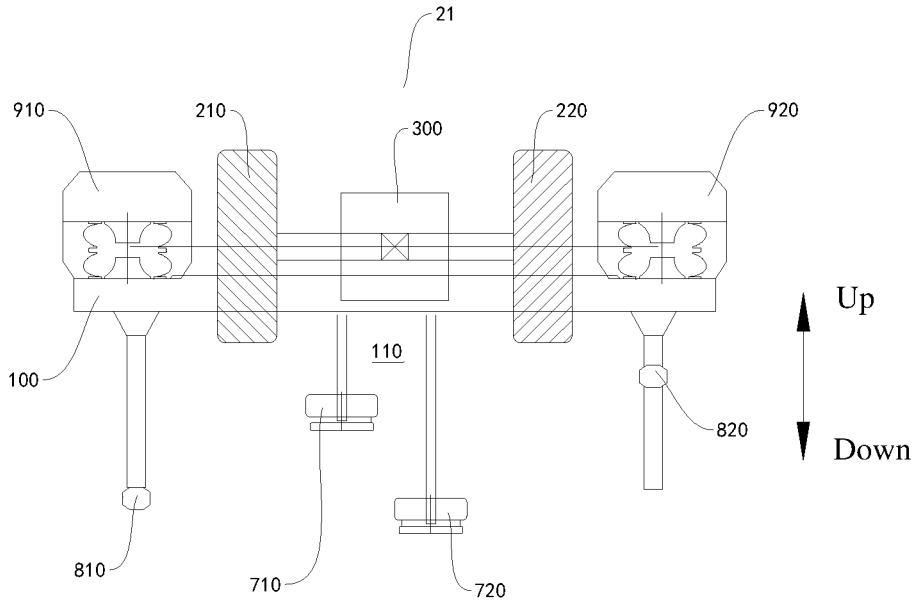
FIG. 35 is a sectional view of a bogie of a rail vehicle according to another embodiment of the present disclosure.
Figure 36:
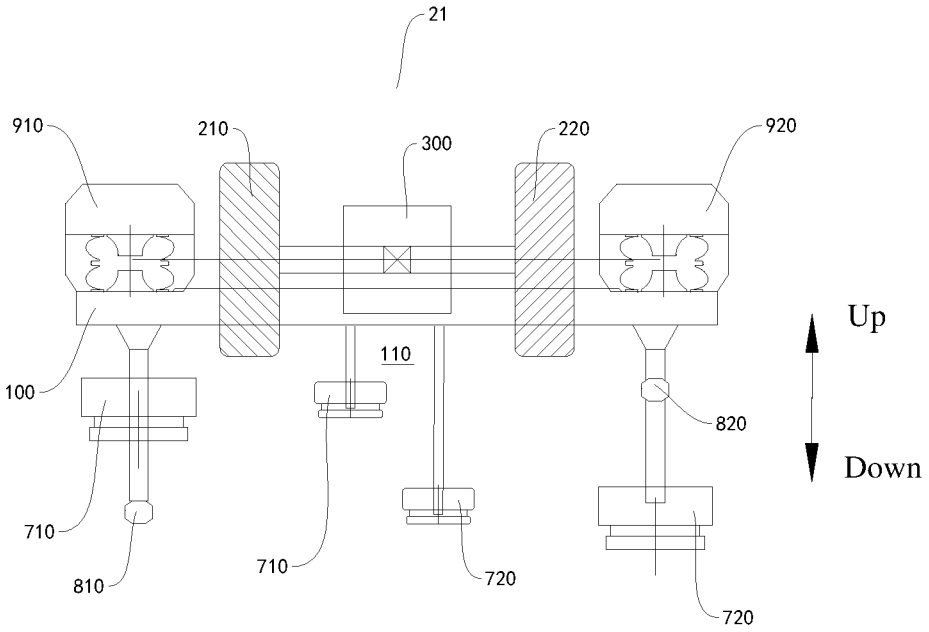
FIG. 36 is a sectional view of a bogie of a rail vehicle according to another embodiment of the present disclosure.

In some specific embodiments of the present disclosure, as shown in FIG. 34 to FIG. 36, the first collector shoe 810 is located below each first horizontal wheel 710, and the second collector shoe 820 is located above each second horizontal wheel 720. In this way, collector shoes are arranged in the up-down direction according to polarities for receiving currents. For example, a collector shoe at an upper portion is connected to a positive electrode of a current, and a collector shoe at a lower portion on an opposite side is connected a negative electrode of the current. In this way, thereby facilitating space distribution and improving the safety of current reception.

For example, the first horizontal wheel 710 may be fit on the outer side surface of the first track beam 12 and the second horizontal wheel 720 may be fit on the outer side surface of the second track beam 13 (as shown in FIG. 34). The first horizontal wheel 710 may also be fit on the inner side surface of the first track beam 12 and the second horizontal wheel 720 may also be fit on the inner side surface of the second track beam 13 (as shown in FIG. 35). The plurality of first horizontal wheels 710 may be further respectively fit on the inner side surface and the outer side surface of the first track beam 12 and the plurality of second horizontal wheels 720 may be further respectively fit on the inner side surface and the outer side surface of the second track beam 13 (as shown in FIG. 36). The first horizontal wheel 710 that is fit on the inner side surface of the first track beam 12 and the second horizontal wheel 720 that is fit on the inner side surface of the second track beam 13 are located at a same height or located at different heights.

In some specific embodiments of the present disclosure, as shown in FIG. 37 to FIG. 41, a plurality of first horizontal wheels 710 exist and are spaced apart in an up-down direction. The first collector shoe 810 is located between adjacent first horizontal wheels 710 in the up-down direction. A plurality of second horizontal wheels 720 exist and are spaced apart in an up-down direction. The second collector shoe 820 is located between adjacent second horizontal wheels 720 in the up-down direction. In this way, space distribution and stabilization of an overall structure can be facilitated.

Figure 37:
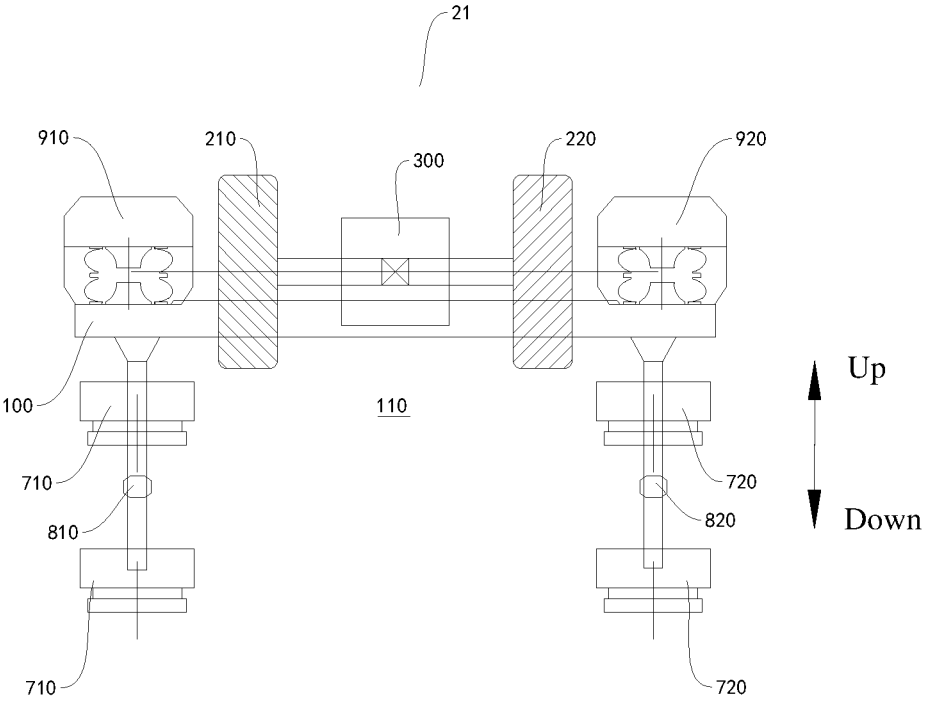
FIG. 37 is a sectional view of a bogie of a rail vehicle according to another embodiment of the present disclosure.
Figure 38:
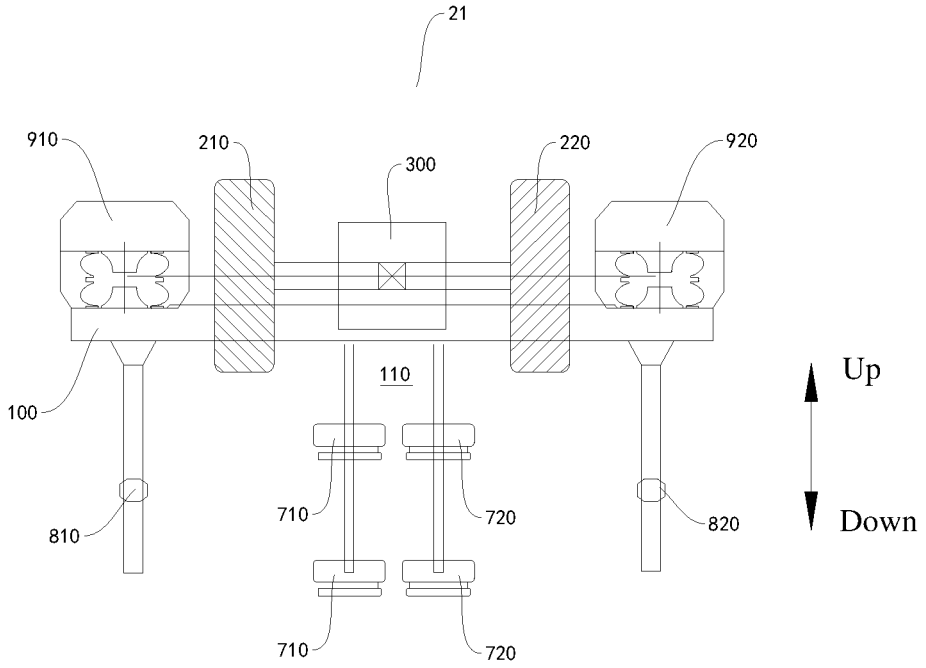
FIG. 38 is a sectional view of a bogie of a rail vehicle according to another embodiment of the present disclosure.
Figure 39:
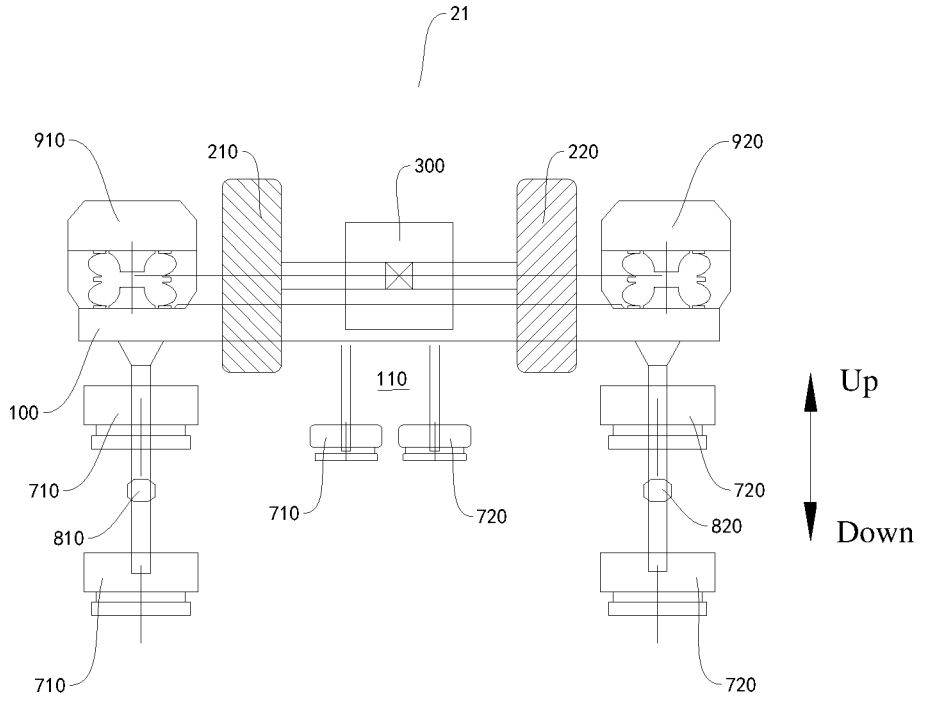
FIG. 39 is a sectional view of a bogie of a rail vehicle according to another embodiment of the present disclosure.
Figure 40:
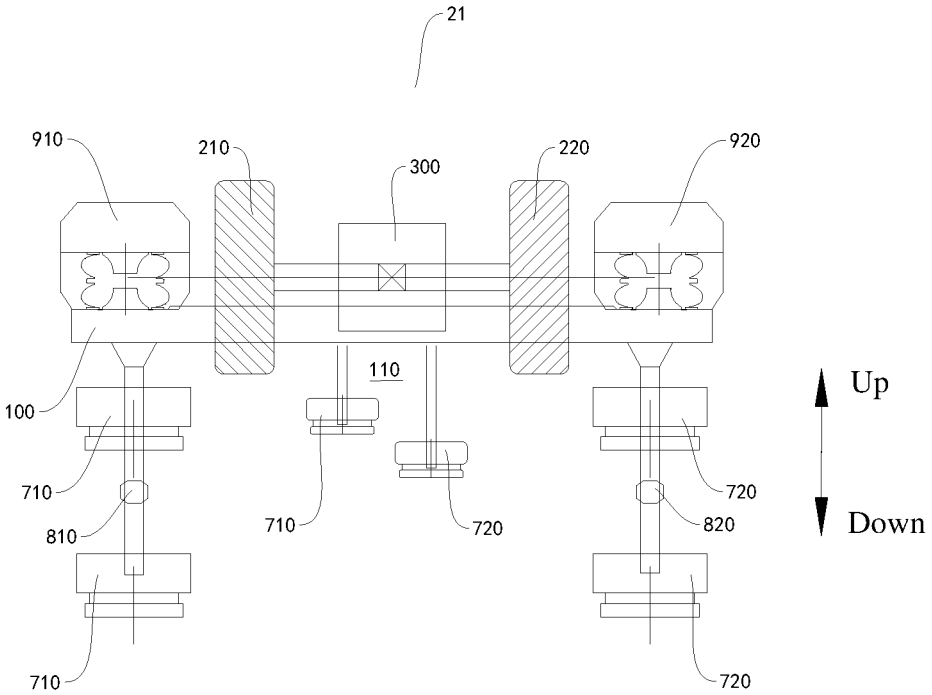
FIG. 40 is a sectional view of a bogie of a rail vehicle according to another embodiment of the present disclosure.
Figure 41:
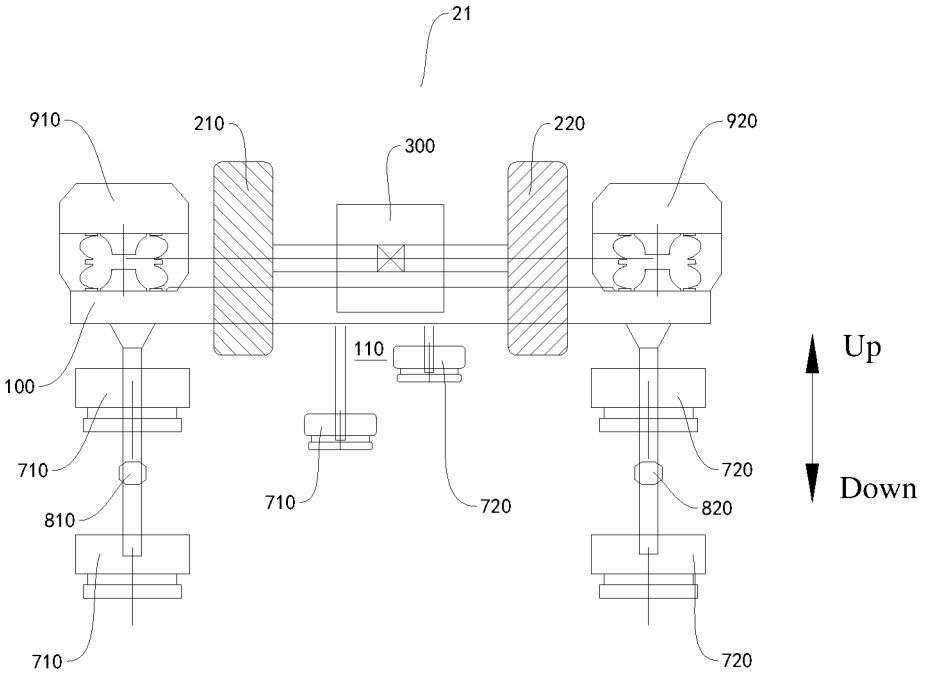
FIG. 41 is a sectional view of a bogie of a rail vehicle according to another embodiment of the present disclosure.

In a specific implementation, the plurality of first horizontal wheels 710 may be fit on the outer side surface of the first track beam 12 and the plurality of second horizontal wheels 720 may be fit on the outer side surface of the second track beam 13 (as shown in FIG. 37). The plurality of first horizontal wheels 710 may also be fit on the inner side surface of the first track beam 12 and the plurality of second horizontal wheels 720 may also be fit on the inner side surface of the second track beam 13 (as shown in FIG. 38). The plurality of first horizontal wheels 710 may be further respectively fit on the inner side surface and the outer side surface of the first track beam 12 and the plurality of second horizontal wheels 720 may be further respectively fit on the inner side surface and the outer side surface of the second track beam 13 (as shown in FIG. 39 to FIG. 41). The first horizontal wheel 710 that is fit on the inner side surface of the first track beam 12 and the second horizontal wheel 720 that is fit on the inner side surface of the second track beam 13 are located at a same height or located at different heights. The first collector shoe 810 is located between adjacent first horizontal wheels 710 that are fit on the outer side surface of the first track beam 12 in an up-down direction. The second collector shoe 820 is located between adjacent second horizontal wheels 720 that are fit on the outer side surface of the second track beam 13 in an up-down direction.

Figure 69:
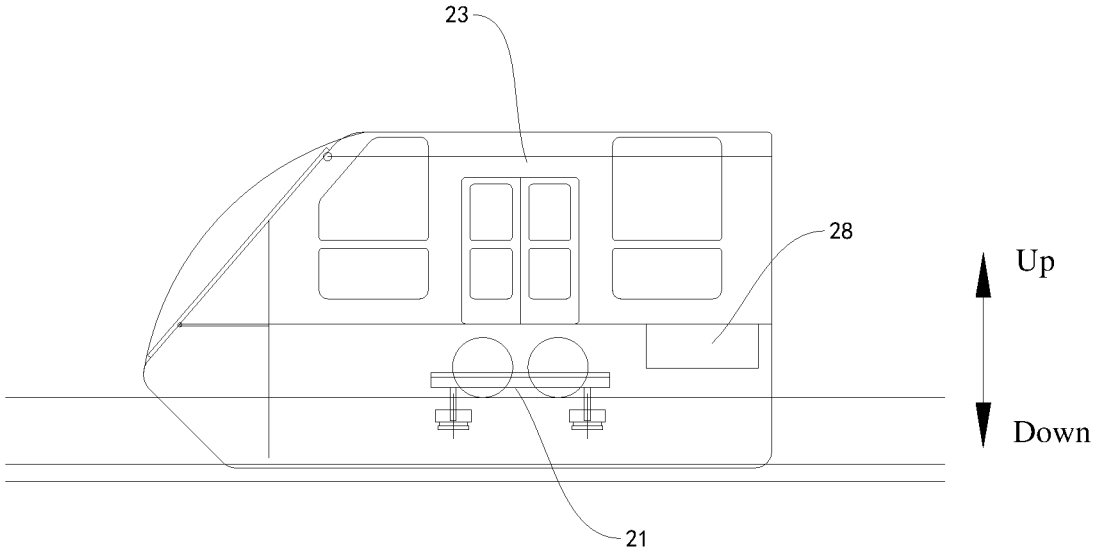
FIG. 69 is a partially schematic view of a rail transport system according to another embodiment of the present disclosure.

In another embodiment of the present disclosure, as shown in FIG. 69, the rail transport system 1 according to this embodiment of the present disclosure may be applied to transport connections between a main line and community areas. Therefore, a volume of a rail vehicle 20 is smaller than a volume of a mainline rail vehicle, so that a conductor rail and a collector shoe can be cancelled, and a power battery 28 is used to supply power. The power battery 28 supplies power for running the rail vehicle 20, and certainly may also supply power to another part needing power of the rail vehicle 20. In this way, the structure and power supply lines can be simplified, thereby reducing a cost.

Specifically, the power battery 28 may be disposed at a portion other than the bogie 21, for example, may be mounted on a bottom portion of a carriage 23, or may be mounted inside a carriage 23. The power battery 28 can ensure normal operation at a needed speed, and is automatically charged when a passenger flow is relatively small.

In some specific examples of the present disclosure, as shown in FIG. 42, FIG. 43 and FIG. 58 to FIG. 63, the bogie 21 further includes a first support suspension device 910 and a second support suspension device 920.

The first support suspension device 910 and the second support suspension device 920 are mounted on the bogie frame 100 and are connected to the vehicle body 22. The first support suspension device 910 and the second support suspension device 920 are spaced apart in the lengthwise direction of the rail 10. In a horizontal plane, a central axis of the first support suspension device 910 and a central axis of the second support suspension device 920 are located on a central axis of the bogie frame 100, and the central axis of the bogie frame 100 equally divides the bogie frame 100 in the width direction of the rail 10.

Alternatively, the first support suspension device 910 and the second support suspension device 920 are spaced apart in the width direction of the rail 10. In a horizontal plane, a central axis of the first support suspension device 910 and a central axis of the second support suspension device 920 are located on a central axis of the bogie frame 100, and the central axis of the bogie frame 100 equally divides the bogie frame 100 in the lengthwise direction of the rail 10.

The first support suspension device 910 and the second support suspension device 920 are configured to support the vehicle body 22 and achieve an effect of shock absorption. The first support suspension device 910 and the second support suspension device 920 are subject to even forces and have even supporting effects, so that the stability and comfort of the rail vehicle 20 are ensured and a cost is relatively low.

Figure 42:
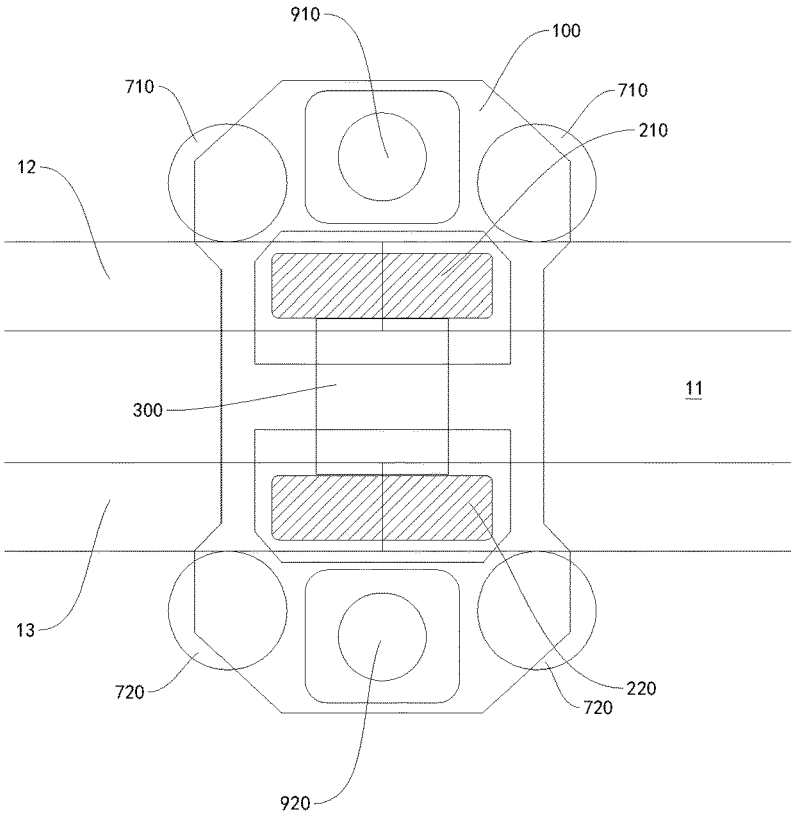
FIG. 42 is a schematic view of a bogie of a rail vehicle according to another embodiment of the present disclosure.
Figure 43:
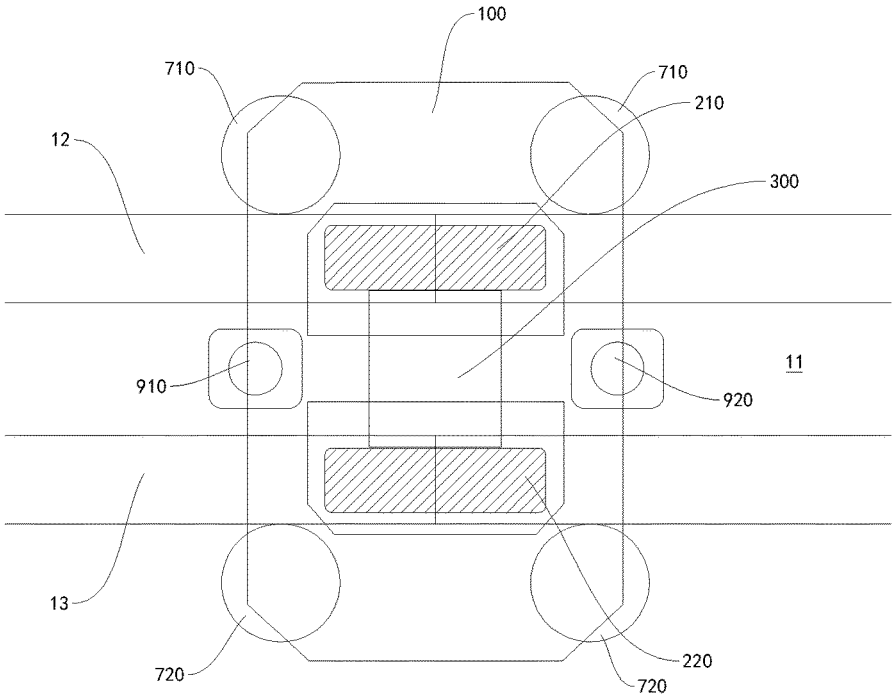
FIG. 43 is a schematic view of a bogie of a rail vehicle according to another embodiment of the present disclosure.

In a specific implementation, FIG. 42 and FIG. 43 show a bogie 21 that has two running wheels and two support suspension devices. The first support suspension device 910 and the second support suspension device 920 may be spaced apart in the lengthwise direction of the rail 10 and located on a central axis that equally divides the bogie frame 100 in the width direction of the rail 10 (as shown in FIG. 43). The first support suspension device 910 and the second support suspension device 920 may also be spaced apart in the width direction of the rail 10 and located on a central axis that equally divides the bogie frame 100 in the lengthwise direction of the rail 10 (as shown in FIG. 42).

Figure 58:
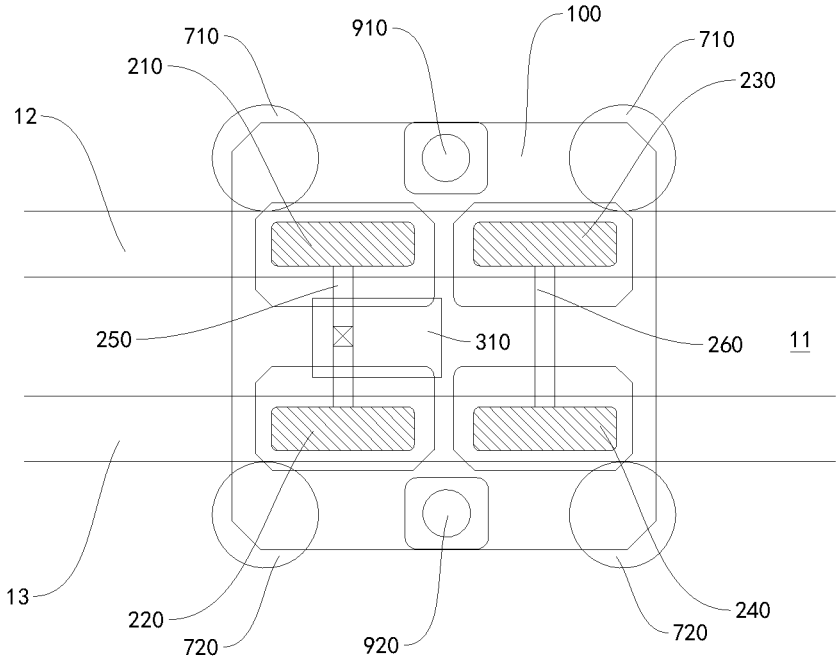
FIG. 58 is a schematic view of a bogie of a rail vehicle according to another embodiment of the present disclosure.
Figure 59:
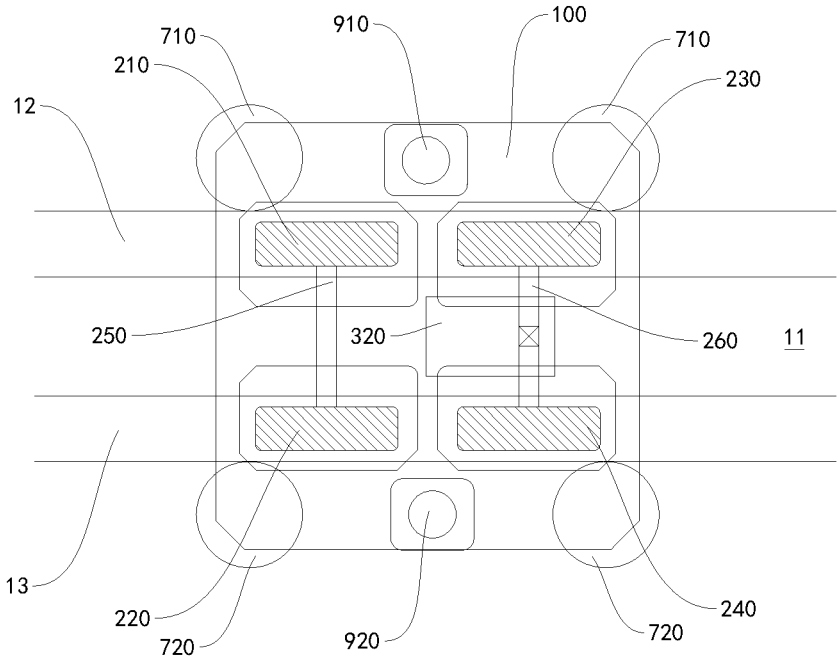
FIG. 59 is a schematic view of a bogie of a rail vehicle according to another embodiment of the present disclosure.
Figure 60:
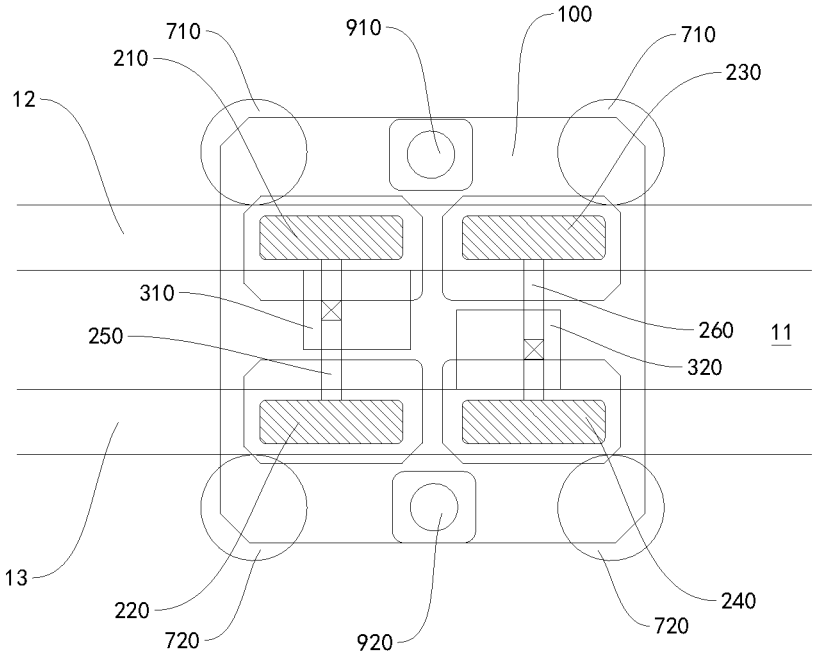
FIG. 60 is a schematic view of a bogie of a rail vehicle according to another embodiment of the present disclosure.
Figure 61:
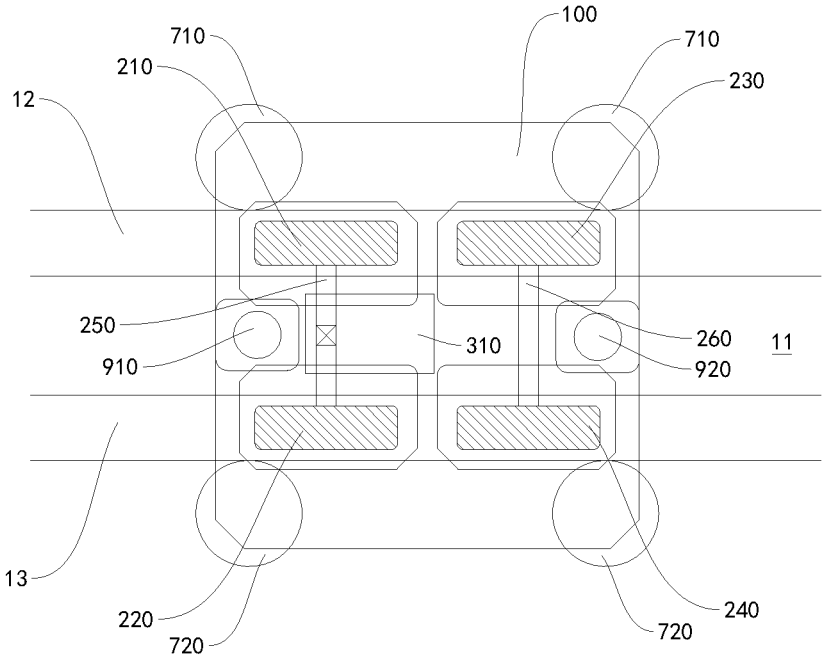
FIG. 61 is a schematic view of a bogie of a rail vehicle according to another embodiment of the present disclosure.
Figure 62:
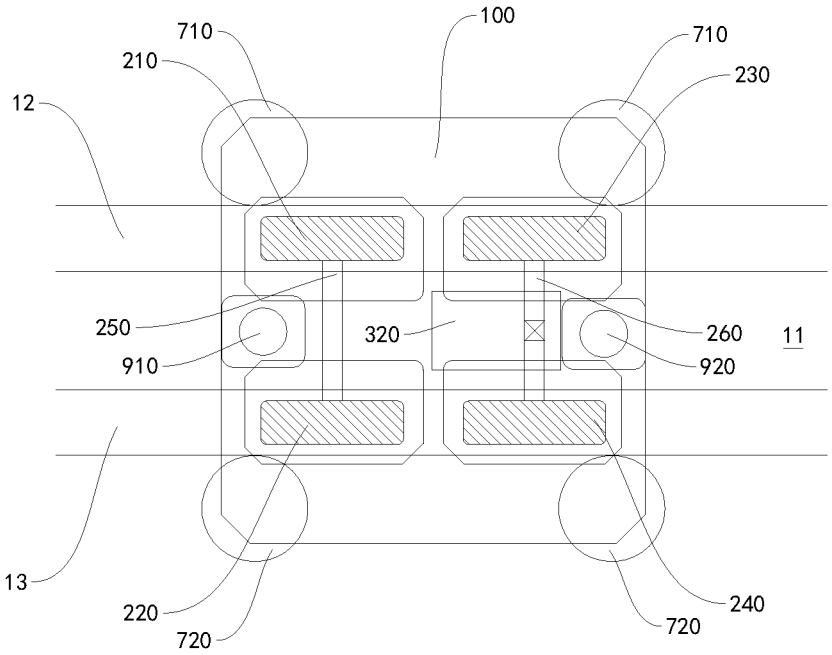
FIG. 62 is a schematic view of a bogie of a rail vehicle according to another embodiment of the present disclosure.
Figure 63:
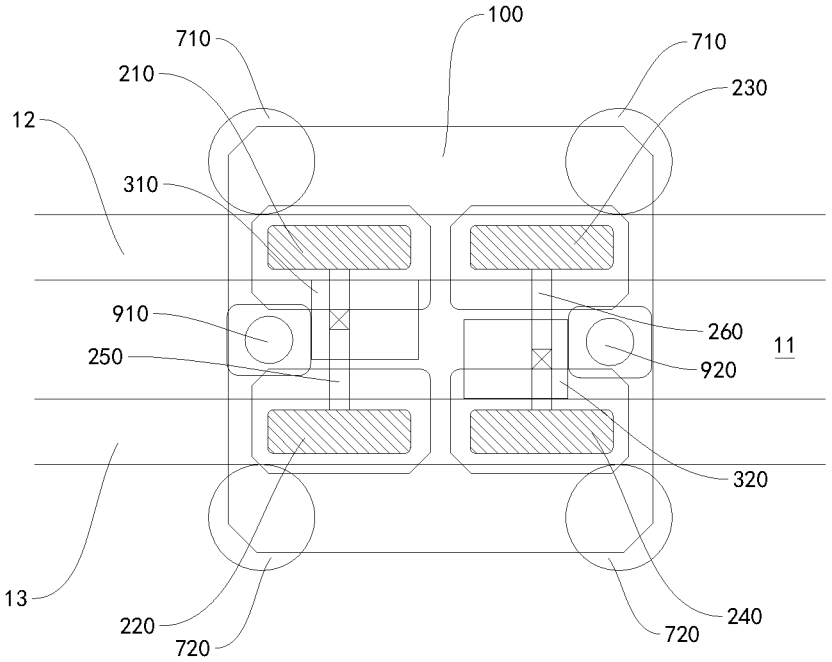
FIG. 63 is a schematic view of a bogie of a rail vehicle according to another embodiment of the present disclosure.

FIG. 58 to FIG. 63 show a bogie 21 that has four running wheels and two support suspension devices. The first support suspension device 910 and the second support suspension device 920 may be spaced apart in the lengthwise direction of the rail 10 and located on a central axis that equally divides the bogie frame 100 in the width direction of the rail 10 (as shown in FIG. 61 to FIG. 63). The first support suspension device 910 and the second support suspension device 920 may also be spaced apart in the width direction of the rail 10 and located on a central axis that equally divides the bogie frame 100 in the lengthwise direction of the rail 10 (as shown in FIG. 58 to FIG. 60).

One driving device may exist and is defined as a first driving device 310, and the first driving device 310 is disposed between the first running wheel 210 and the second running wheel 220 (as shown in FIG. 58 and FIG. 61). One driving device may exist and is defined as a second driving device 320, and the second driving device 320 is disposed between the third running wheel 230 and the fourth running wheel 240 (as shown in FIG. 59 and FIG. 62). Two driving devices exist and are respectively defined as the first driving device 310 and the second driving device 320, and the first driving device 310 is disposed between the first running wheel 210 and the second running wheel 220 and the second driving device 320 is disposed between the third running wheel 230 and the fourth running wheel 240. The first driving device 310 is closer to the first running wheel 210 than to the second running wheel 220, and the second driving device 320 is closer to the fourth running wheel 240 than to the third running wheel 230 (as shown in FIG. 60 and FIG. 63).

In some other specific embodiments of the present disclosure, as shown in FIG. 44 and FIG. 64 to FIG. 66, the bogie 21 further includes a first support suspension device 910, a second support suspension device 920, a third support suspension device 930, and a fourth support suspension device 940.

The first support suspension device 910, the second support suspension device 920, the third support suspension device 930, and the fourth support suspension device 940 are mounted on the bogie frame 100 and are connected to the vehicle body 22. The first support suspension device 910, the second support suspension device 920, the third support suspension device 930, and the fourth support suspension device 940 are respectively located in a horizontal plane at four corners of a rectangle, and the rectangle is symmetric about the center of the bogie frame 100. In other words, in the horizontal plane, after the rectangle rotates by 180° about the center of the bogie frame 100, the rectangle before the rotation and the rectangle after the rotation coincide. The first support suspension device 910, the second support suspension device 920, the third support suspension device 930, and the fourth support suspension device 940 are configured to support the vehicle body 22 and achieve an effect of shock absorption. The first support suspension device 910, the second support suspension device 920, the third support suspension device 930, and the fourth support suspension device 940 are subject to even forces and have even supporting effects, so as to improve the stability and comfort of the rail vehicle 20.

Figure 44:
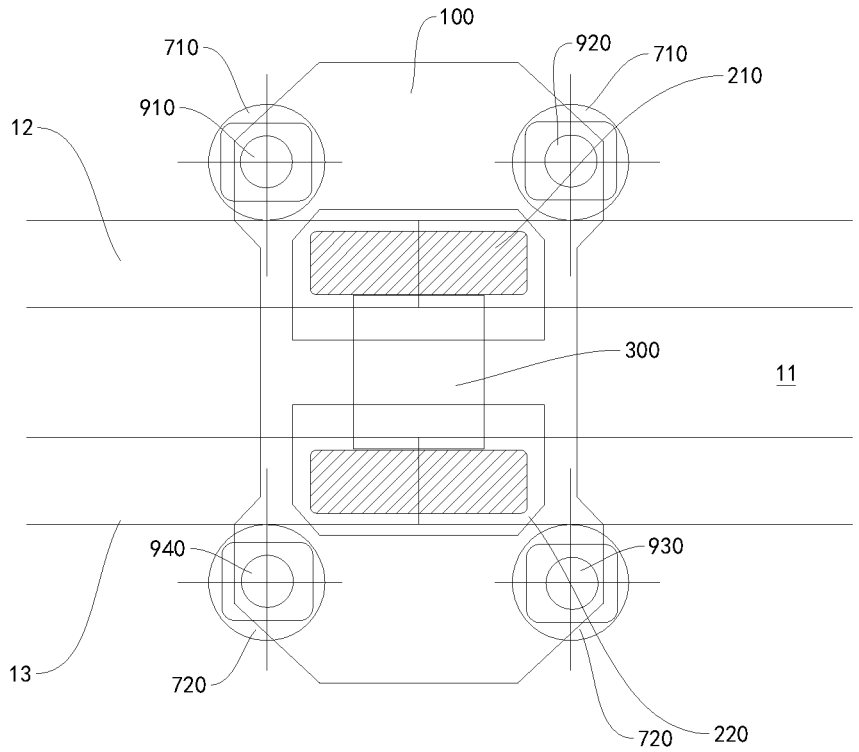
FIG. 44 is a schematic view of a bogie of a rail vehicle according to another embodiment of the present disclosure.

In a specific implementation, FIG. 44 shows a bogie 21 that has two running wheels and four support suspensions. The first support suspension device 910, the second support suspension device 920, the third support suspension device 930, and the fourth support suspension device 940 are symmetric about the center of the bogie frame 100.

Figure 64:
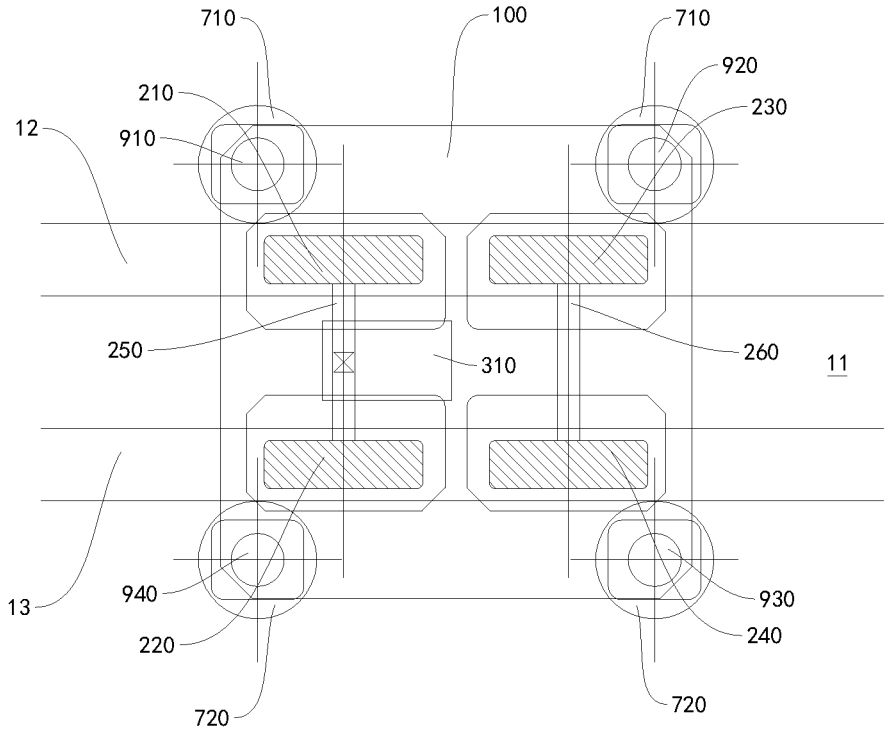
FIG. 64 is a schematic view of a bogie of a rail vehicle according to another embodiment of the present disclosure.
Figure 65:
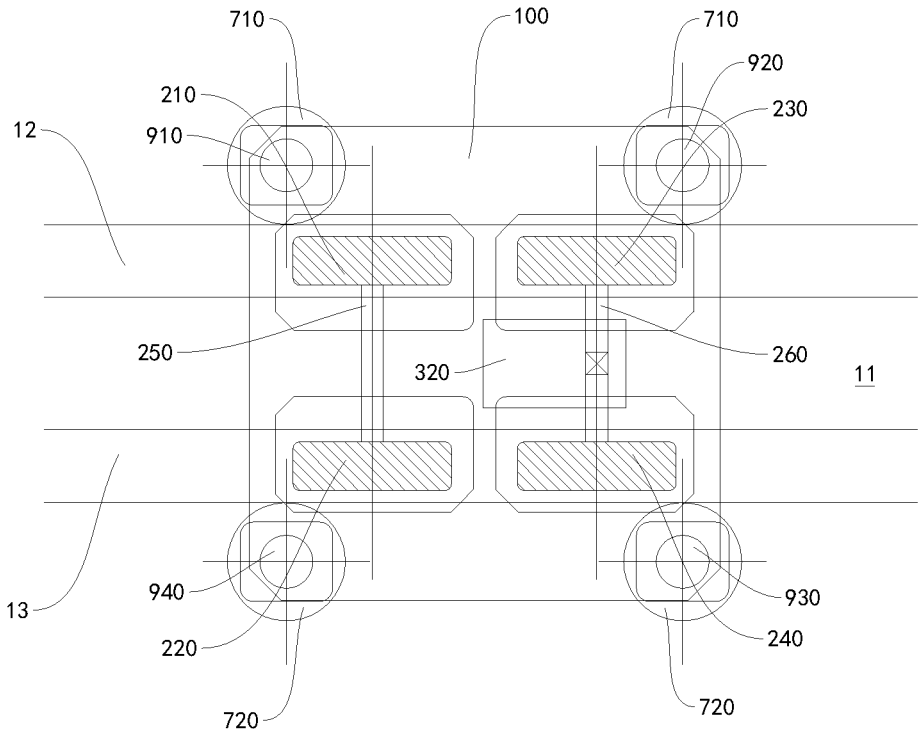
FIG. 65 is a schematic view of a bogie of a rail vehicle according to another embodiment of the present disclosure.

FIG. 64 and FIG. 65 show a bogie 21 that has four running wheels and four support suspensions. The first support suspension device 910, the second support suspension device 920, the third support suspension device 930, and the fourth support suspension device 940 are symmetric about the center of the bogie frame 100.

Figure 66:
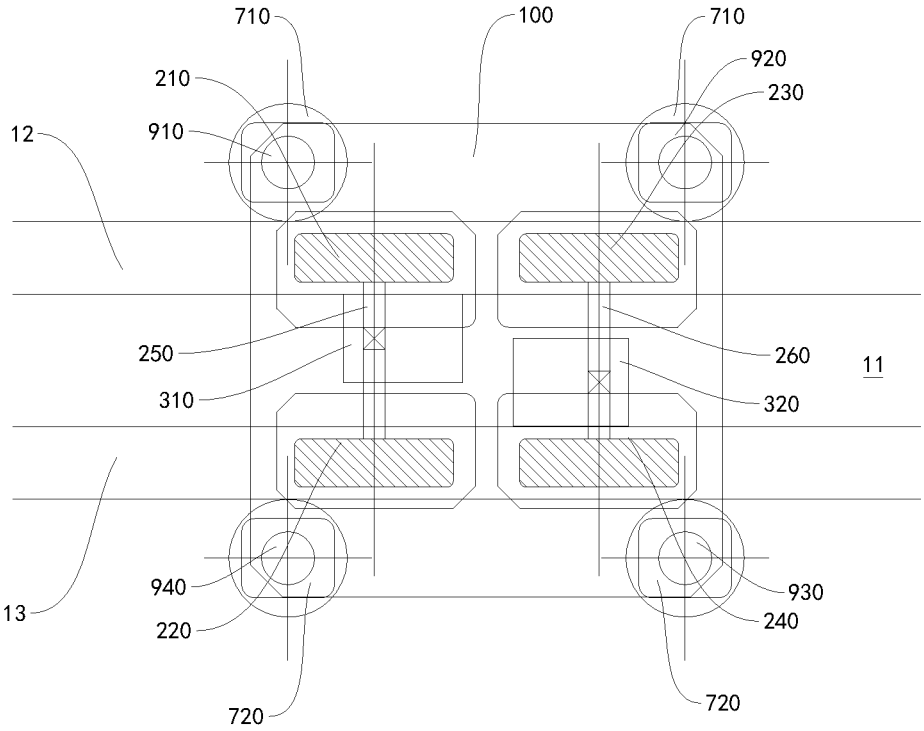
FIG. 66 is a schematic view of a bogie of a rail vehicle according to another embodiment of the present disclosure.

One driving device may exist and is defined as the first driving device 310, and the first driving device 310 is disposed between the first running wheel 210 and the second running wheel 220 (as shown in FIG. 64). One driving device may exist and is defined as the second driving device 320, and the second driving device 320 is disposed between the third running wheel 230 and the fourth running wheel 240 (as shown in FIG. 65). Two driving devices exist and are respectively defined as the first driving device 310 and the second driving device 320. The first driving device 310 is disposed between the first running wheel 210 and the second running wheel 220 and the second driving device 320 is disposed between the third running wheel 230 and the fourth running wheel 240. The first driving device 310 is closer to the first running wheel 210 than to the second running wheel 220, and the second driving device 320 is closer to the fourth running wheel 240 than to the third running wheel 230 (as shown in FIG. 66).

In some specific embodiments of the present disclosure, as shown in FIG. 10, FIG. 42 to FIG. 44, FIG. 46 to FIG. 49, and FIG. 58 to FIG. 66, two first horizontal wheels 710 exist and are spaced apart in the lengthwise direction of the first track beam 12, and two second horizontal wheels 720 exist and are spaced apart in the lengthwise direction of the second track beam 13. Central axes of the two first horizontal wheels 710 and central axes of the two second horizontal wheels 720 are respectively located in a horizontal plane at four corners of a rectangle, and the rectangle is symmetric about the center of the bogie frame 100. In other words, in the horizontal plane, after the rectangle rotates by 180° about the center of the bogie frame 100, the rectangle before the rotation and the rectangle after the rotation coincide. In this way, four horizontal wheels may be evenly arranged in the horizontal plane, thereby ensuring the stability when the horizontal wheels drive the rail vehicle 20 to make a turn and run in a straight line.

A person skilled in the art may understand that the foregoing rectangles are all assumed virtual rectangles. The rectangles are used to clearly depict an arrangement manner of the first support suspension device 910, the second support suspension device 920, the third support suspension device 930, and the fourth support suspension device 940 in a horizontal plane, and an arrangement manner of the two first horizontal wheels 710 and the two second horizontal wheels 720 a horizontal plane.

In the example shown in FIG. 44 and FIG. 64 to FIG. 66, the central axes of the two first horizontal wheels 710 and the central axes of the two second horizontal wheels 720 may respectively coincide with a central axis of the first support suspension device 910, a central axis of the second support suspension device 920, a central axis of the third support suspension device 930, and a central axis of the fourth support suspension device 940.

In some specific embodiments of the present disclosure, as shown in FIG. 70, one first horizontal wheel 710 and one second horizontal wheel 720 respectively exist. The first horizontal wheel 710 and the second horizontal wheel 720 are spaced apart in the width direction of the rail 10, and the first horizontal wheel 710 and the second horizontal wheel 720 deviate, towards a running direction of the rail vehicle 20, from the center of the bogie frame 100 in the lengthwise direction of the rail 10 (the arrow in FIG. 70 shows the running direction of the rail vehicle 20). In other words, the first horizontal wheel 710 and the second horizontal wheel 720 deviate from the center of the bogie frame 100 in the lengthwise direction of the rail 10 and deviating directions of the first horizontal wheel 710 and the second horizontal wheel 720 are consistent with the running direction of the rail vehicle 20. In a process in which the rail vehicle 20 runs, horizontal wheels on a front side in the running direction mainly exert a guiding effect. When the rail vehicle 20 makes a turn, horizontal wheels on a rear side in the running direction interferes with the bogie frame 100 to produce a side effect. Therefore, for a unidirectional rail transport system 1 or an annular rail transport system 1, the horizontal wheels on the rear side in the running direction are canceled, so that interference with the bogie frame 100 can be eliminated when the rail vehicle 20 makes a turn, the weight of the rail vehicle 20 can be reduced, and a cost of the rail vehicle 20 is reduced.

Figure 45:
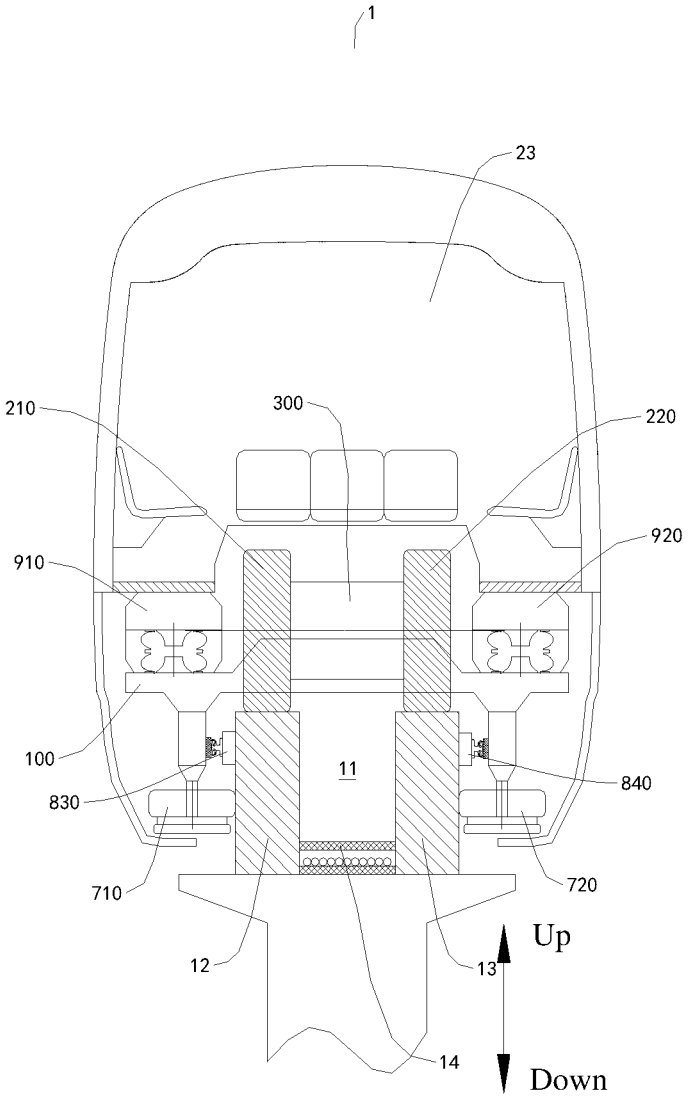
FIG. 45 is a sectional view of a rail transport system according to another embodiment of the present disclosure.

In some specific examples of the present disclosure, as shown in FIG. 45, for a bogie 21 having two running wheels, an external diameter of the first running wheel 210 and an external diameter of the second running wheel 220 are the same and range from 900 millimeters to 1100 millimeters. For a bogie 21 having four running wheels, an external diameter of the first running wheel 210, an external diameter of the second running wheel 220, an external diameter of the third running wheel 230, and an external diameter of the fourth running wheel 240 are the same and range from 900 millimeters to 1100 millimeters. In this way, on the premise of improving the load capability of running wheels, impact of running wheels on space inside a carriage 23 can be minimized, so that a quantity of passengers can be increased.

The rail transport system 1 according to an embodiment of the present disclosure is described below with reference to the accompanying drawings.

As shown in FIG. 71 to FIG. 99, the rail transport system 1 according to an embodiment of the present disclosure includes a rail 10 and a rail vehicle 20.

The rail 10 includes a steering portion 111 and a running portion 112. The running portion 112 is connected at a top portion of the steering portion 111 and a concave portion is built on the running portion 112 to form an escape passage 11. The rail vehicle 20 includes a bogie 21 and a vehicle body 22. The bogie 21 movably straddles the rail 10. The vehicle body 22 is connected to the bogie 21 and is pulled by the bogie 21 to run along the rail 10. The bogie 21 straddles the steering portion 111 and the running portion 112. The bogie 21 is fit with an inner bottom surface of the escape passage 11 of the running portion 112 and the steering portion 111. The bogie 21 runs by means of the running portion 112 and steers by means of the steering portion 111.

A person skilled in the art needs to understand here that the steering portion 111 and the running portion 112 are both parts of the rail 10. The steering portion 111 and the running portion 112 may be formed integrally. The escape passage 11 is disposed on the running portion 112. That is, the escape passage 11 is disposed on the rail 10 itself, but is not disposed on another additional member besides the rail 10. That is, compared with the structure of the escape passage in the prior art, in the rail transport system 1 according to this embodiment of the present disclosure, other members such as a frame and a floor do not need to be disposed on the rail 10, and the escape passage 11 is formed on the rail 10 itself.

For the rail transport system 1 according to this embodiment of the present disclosure, the escape passage 11 is disposed on the rail 10. When an emergency occurs, passengers can be evacuated in time through the escape passage 11. Moreover, because the escape passage 11 is disposed on the rail 10, another additional structure does not need to be added on the rail 10, and only the escape passage 11 needs to be disposed on the rail 10 in a lengthwise direction of the rail 10, so that the workload of a rail transport system can be greatly reduced; therefore, in an aspect, a cost is reduced, and in another aspect, space to occupy is reduced. Moreover, the load on the rail 10 does not increase, so that the stability of the rail 10 is improved. Therefore, the rail transport system 1 according to this embodiment of the present disclosure has advantages such as convenient evacuation of passengers in an emergency, a low cost, small occupied space, light load on a rail, and high stability.

The rail transport system 1 according to a specific embodiment of the present disclosure is described below with reference to the accompanying drawings.

As shown in FIG. 71 to FIG. 99, the rail transport system 1 according to this embodiment of the present disclosure includes the rail 10 and the rail vehicle 20.

A first avoiding groove 120 and a second avoiding groove 130 configured to respectively avoid two side walls of the escape passage 11 are disposed on the bogie 21. In this way, operations of the bogie 21 on the rail 10 become more stable, so that the stability of running of the rail vehicle 20 is improved, and an overall height of the rail vehicle 20 can be reduced.

In some specific embodiments of the present disclosure, as shown in FIG. 71 to FIG. 74 and FIG. 1 to FIG. 3, a vehicle body 22 includes a plurality of carriages 23 sequentially hinged in the lengthwise direction of the rail 10. An emergency door 24 that can be opened and closed is disposed on a surface, opposite an adjacent carriage 23, of a carriage 23 that is located at least one end of the vehicle body 22 in the lengthwise direction of the rail 10. In other words, the emergency door 24 is disposed on an end face of at least one carriage 23 of two carriages 23 that are located at two ends of the vehicle body 22. Further in other words, the emergency door 24 is disposed on a carriage 23 that is located at least one end of the vehicle body 22 in the lengthwise direction of the rail 10. Specifically, the emergency door 24 is disposed on a first end face of the carriage that is located at the at least one end 23, and the first end face is a surface away from an adjacent carriage. The emergency door 24 has a first end 31 and a second end 32. The first end 31 of the emergency door 24 is pivotably mounted on a corresponding carriage 23. When being open, the emergency door 24 slants relative to a horizontal plane, and the second end 32 of the emergency door 24 slants downwards and is inserted in the escape passage 11. In this way, when an emergency occurs, the rail vehicle 20 actively or passively stops, the emergency door 24 is opened and the second end is inserted in the escape passage 11. Passengers inside the carriage 23 can slide down to the escape passage 11 through the emergency door 24, so as to evacuate from the escape passage 11.

In a specific implementation, in the lengthwise direction of the rail 10, emergency doors 24 are disposed on both carriages 23 located at two ends of the vehicle body 22. When a sudden emergency occurs, the emergency doors 24 are opened at both ends of the vehicle body 22, and a wide air convection passage can be formed, to enable toxic gas such as smog inside the vehicle body 22 to disperse rapidly.

Specifically, the first end 31 of the emergency door 24 is disposed close to the bottom of the vehicle, and the second end 32 of the emergency door 24 is disposed close to the top of the vehicle when the emergency door 24 is closed. In other words, when the emergency door 24 is closed, the second end 32 of the emergency door 24 is located above the first end 31 of the emergency door 24. When the emergency door 24 is open, the second end 32 of the emergency door 24 is located below the first end 31 of the emergency door 24. In this way, the emergency door 24 turns downwards to switch from a closed state to an open state. The emergency door 24 has a turnable structure, so that passengers inside a vehicle only need to perform simple operations to rapidly open the emergency door 24, thereby effectively improving the escape efficiency.

Advantageously, a slideway is disposed on an inner surface of the emergency door 24 to make it convenient for passengers to slide on the slideway to the escape passage 11. It should be understood herein that the inner surface of the emergency door 24 refers to a surface that faces the inside of the vehicle when the emergency door 24 is closed.

Figure 96:
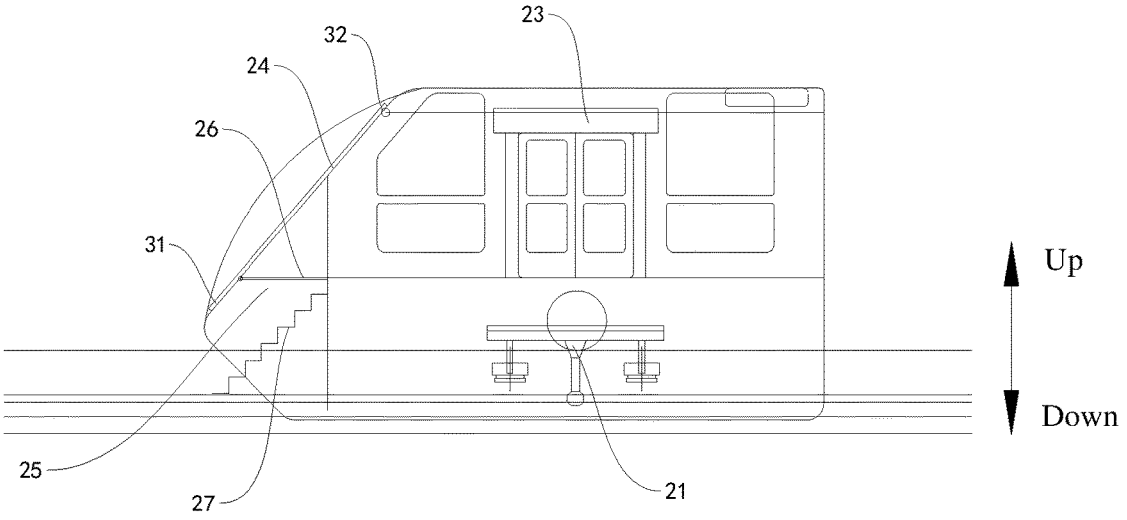
FIG. 96 is a partially schematic view of a rail transport system according to another embodiment of the present disclosure, where an emergency door is in a closed state.
Figure 97:
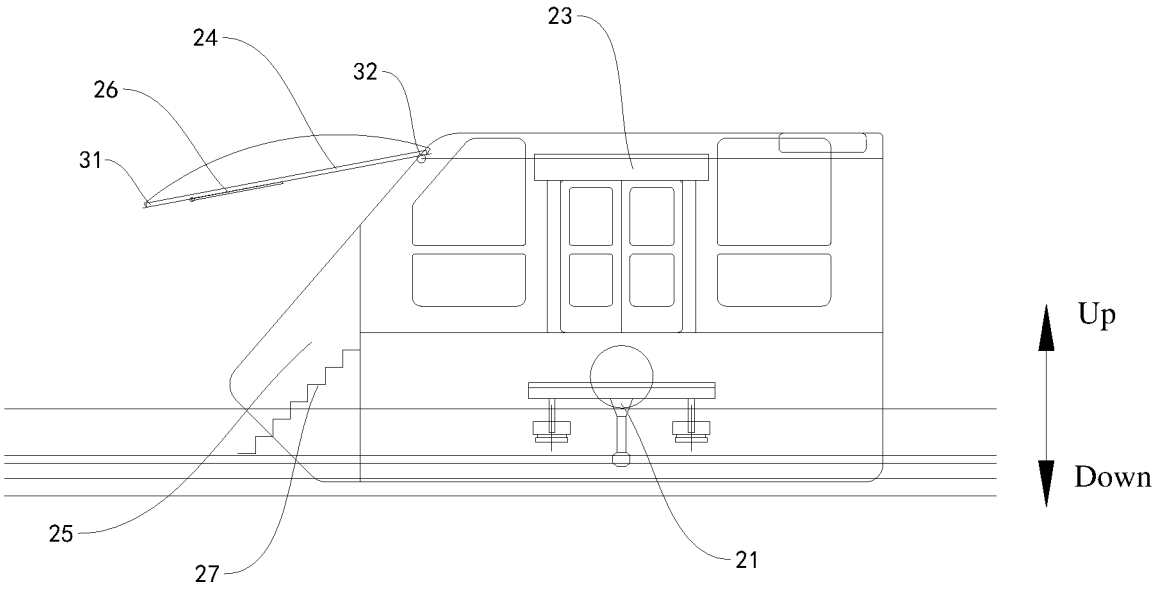
FIG. 97 is a partially schematic view of a rail transport system according to another embodiment of the present disclosure, where an emergency door is in an open state.

In some other specific embodiments of the present disclosure, as shown in FIG. 96 and FIG. 97, the vehicle body 22 includes a plurality of carriages 23 sequentially hinged in the lengthwise direction of the rail 10. An emergency door 24 that can be opened and closed is disposed on a surface, opposite an adjacent carriage 23, of a carriage 23 that is located at least one end of the vehicle body 22 in the lengthwise direction of the rail 10. Moreover, the emergency exit 25 and the cover plate 26 are disposed on an inner floor of the carriage 23 that is located at the at least one end of the vehicle body 22. That is, the emergency exit 25 and the cover plate 26 are disposed on the inner floor of the carriage 23 on which the emergency door 24 is disposed. The cover plate 26 is linked with the emergency door 24 are configured to open and close the emergency exit 25. When the rail vehicle 20 normally operates, the emergency door 24 is closed and the cover plate 26 closes the emergency exit 25 (as shown in FIG. 96). When an emergency occurs, the rail vehicle 20 actively or passively stops, the emergency door 24 is opened and the cover plate 26 opens the emergency exit 25 (as shown in FIG. 97). Passengers inside the carriage 23 can enter the escape passage 11 through the emergency exit 25, so as to evacuate from the escape passage 11. In addition, even though the rail vehicle 20 is forced to stop at a turning point of the rail 10, when being open, the emergency door 24 does not need to fit the rail 10, and therefore, the emergency door 24 does not collide with the rail 10, so that it becomes convenient for passengers to evacuate at the turning point of the rail 10.

In a specific implementation, in the lengthwise direction of the rail 10, emergency doors 24 are disposed on both carriages 23 located at two ends of the vehicle body 22. When a sudden emergency occurs, the emergency doors 24 are opened at both ends of the vehicle body 22, and a wide air convection passage can be formed, to enable toxic gas such as smog inside the vehicle body 22 to disperse rapidly. Moreover, the emergency door 24 has a turnable structure, so that passengers inside a vehicle only need to perform simple operations to rapidly open the emergency door 24, thereby effectively improving the escape efficiency.

Specifically, the emergency door 24 has a first end 31 and a second end 32. The second end 32 of the emergency door 24 is pivotably mounted on a corresponding carriage 23. The second end 32 of the emergency door 24 is disposed close to the top of the vehicle. When the emergency door 24 is closed, the first end 31 of the emergency door 24 is disposed close to the bottom of the vehicle. In other words, when the emergency door 24 is closed, the first end 31 of the emergency door 24 is located below the second end 32 of the emergency door 24. When the emergency door 24 is open, the first end 31 of the emergency door 24 may be located below the second end 32 of the emergency door 24, or may also be located above the second end 32 of the emergency door 24. In this way, the emergency door 24 turns upwards to switch from a closed state to an open state. The emergency door 24 has the turnable structure, so that passengers inside a vehicle only need to perform simple operations to rapidly open the emergency door 24, thereby effectively improving the escape efficiency, and facilitating linkage between the emergency door 24 and the cover plate 26.

Optionally, the linkage between the cover plate 26 and the emergency door 24 may be driven by the emergency door 24 or may be driven by the cover plate 26. Specifically, when evacuating passengers, the emergency door 24 may be actively opened, and the emergency door 24 drives the cover plate 26 to open the emergency exit 25, or the cover plate 26 may be actively opened, and the cover plate 26 drives the emergency door 24 to be opened. Preferably, the linkage is driven by the cover plate 26, that is, the cover plate 26 is opened to drive the emergency door 24 to be opened. In this way, when the cover plate 26 is opened, articles or passengers on the cover plate 26 can be prevented from falling down.

Furthermore, as shown in FIG. 96 and FIG. 97, an escape ladder 27 connected to the escape passage 11 is disposed inside the emergency exit 25. After the emergency exit 25 is opened, passengers inside the vehicle can move to the escape passage 11 through the escape ladder 27.

Optionally, the escape ladder 27 may be in a fixed state and be kept suspended inside the emergency exit 25, and a lower end of the escape ladder 27 is separated from the inner bottom surface of the escape passage 11, to prevent influence on running of the rail vehicle 20.

In a specific implementation, the escape ladder 27 may also have a retracted state and an extended state. The vehicle body further includes a telescopic driving device configured to drive the escape ladder 27 to extend or retract. After the emergency exit 25 is opened, the escape ladder 27 may be manually controlled to extend to the escape passage 11, and may also automatically extend to the escape passage 11 through linkage. In this embodiment, after being extended, the escape ladder 27 may be directly placed on the inner bottom surface of the escape passage 11, or may be separated from the inner bottom surface of the escape passage 11.

Advantageously, the cover plate 26 may be pivotably mounted on the emergency door 24. After the emergency door 24 turns upwards to be opened, the cover plate 26 is rotated through linkage and abuts on the inner surface of the emergency door 24, so as to save space, thereby preventing the cover plate 26 from affecting evacuation of passengers.

Figure 73:
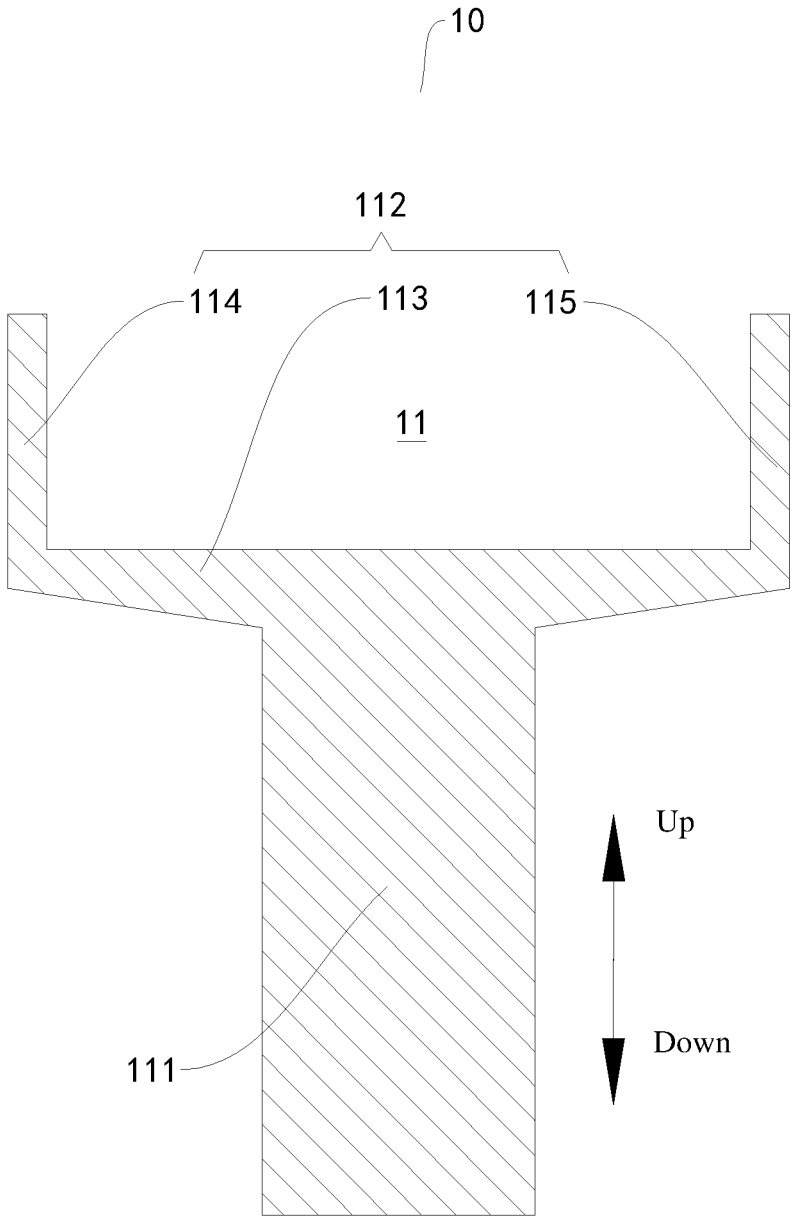
FIG. 73 is a schematic view of a rail of a rail transport system according to an embodiment of the present disclosure.
Figure 74:
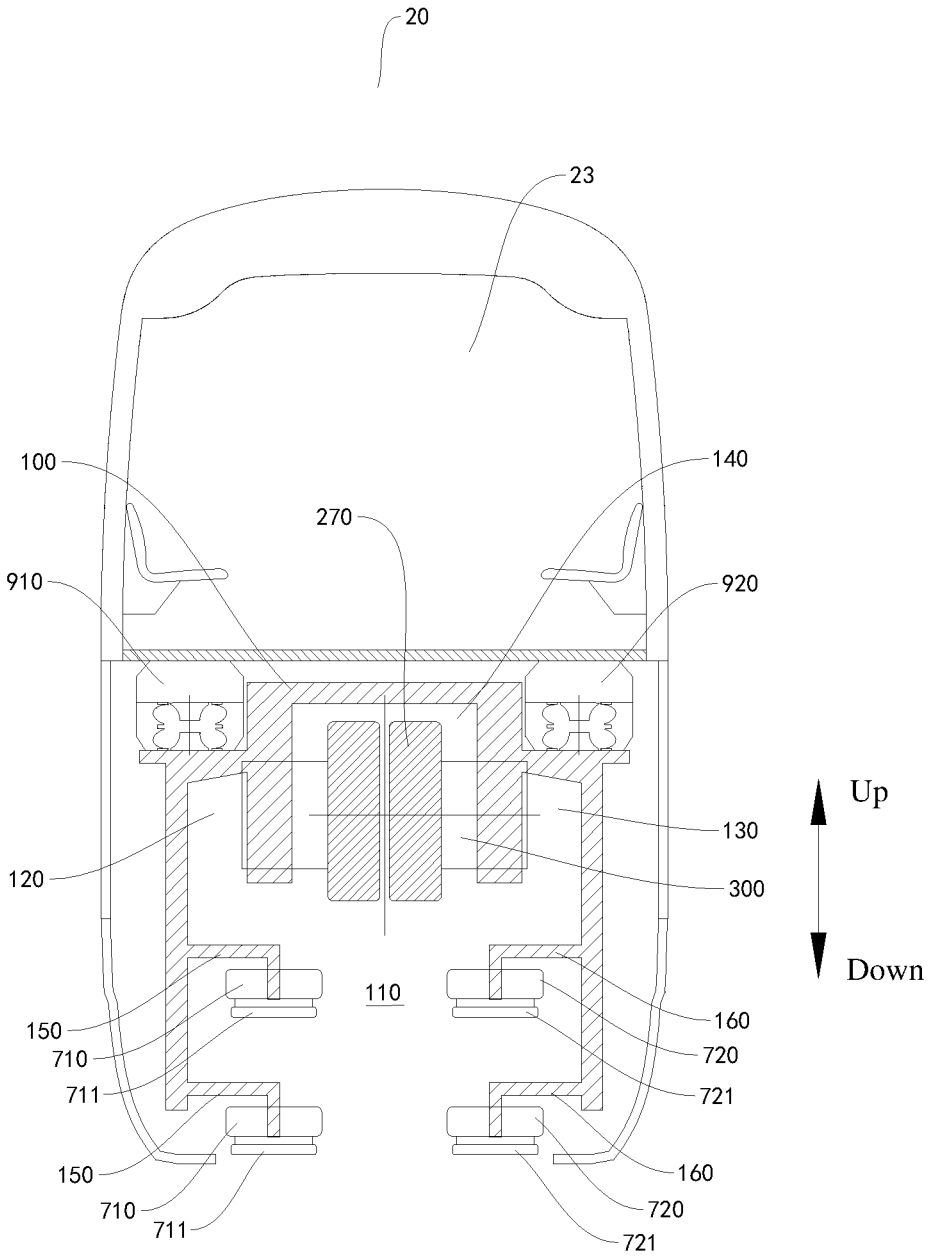
FIG. 74 is a schematic view of a rail vehicle according to an embodiment of the present disclosure.

In some specific embodiments of the present disclosure, as shown in FIG. 73, the running portion 112 includes a bottom plate 113, a first side plate 114, and a second side plate 115.

The bottom plate 113 is connected at a top portion of the steering portion 111. The first side plate 114 and the second side plate 115 are connected on the bottom plate 113 and are spaced apart in a width direction of the bottom plate 113. That is, the first side plate 114 and the second side plate 115 are spaced apart in the width direction of the rail 10. An escape passage 11 is defined among the first side plate 114, the second side plate 115, and the bottom plate 113. The bottom plate 113 forms a bottom wall of the escape passage 11. The first side plate 114 and the second side plate 115 respectively form two side walls of the escape passage 11. In this way, the structure of the rail 10 can be utilized, the escape passage 11 is disposed on the rail 10, no additional member is needed, a cost is low, occupied space is small, and the load on the rail 10 is reduced. Moreover, the escape passage 11 is wide, which facilitates evacuation of passengers, and also facilitates maintenance of lines during routine operation.

Optionally, as shown in FIG. 73, a longitudinal central axis of a cross section of the running portion 112 coincides with a longitudinal central axis of a cross section of the steering portion 111, and a width of the bottom plate 113 is greater than a width of the steering portion 111. A cross section of the running portion 112 refers to a section, orthogonal to a lengthwise direction of the running portion 112, of the running portion 112. Because the bogie 21 relies on the steering portion 111 to steer, a partial structure of the bogie 21 needs to be placed right below the bottom plate 113, so that the bogie 21 can be prevented from falling out of the rail 10, so as to ensure the stability of the rail vehicle 20 in a running condition such as making a turn.

Figure 71:
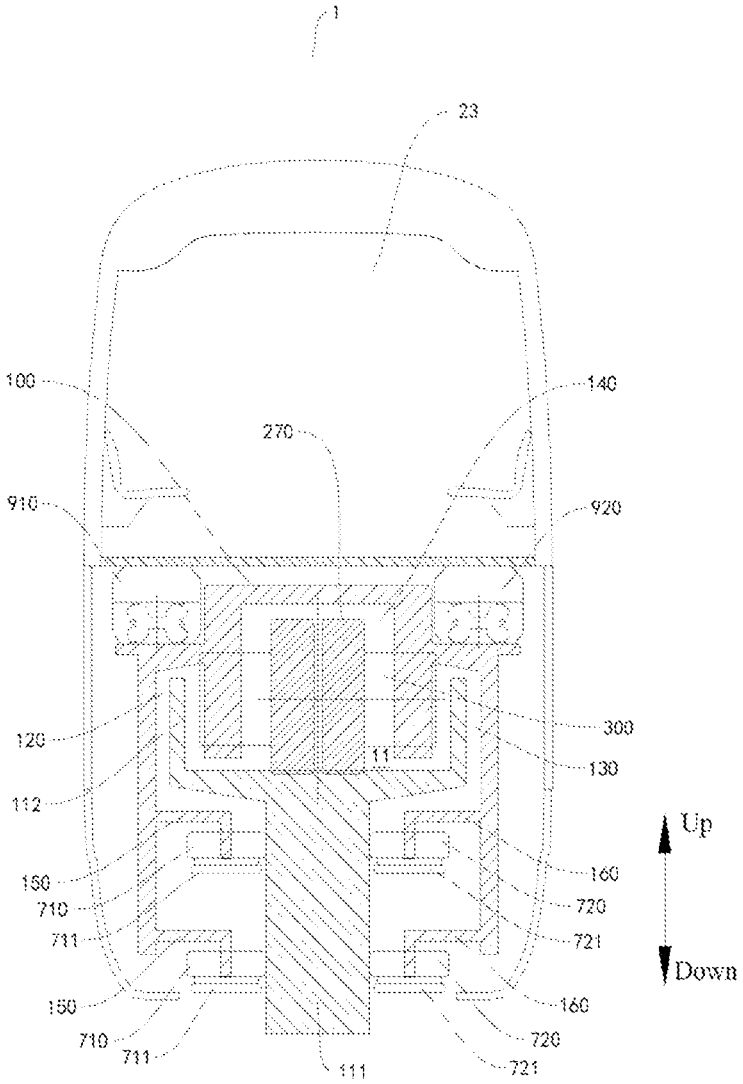
FIG. 71 is a sectional view of a rail transport system according to an embodiment of the present disclosure.
Figure 72:
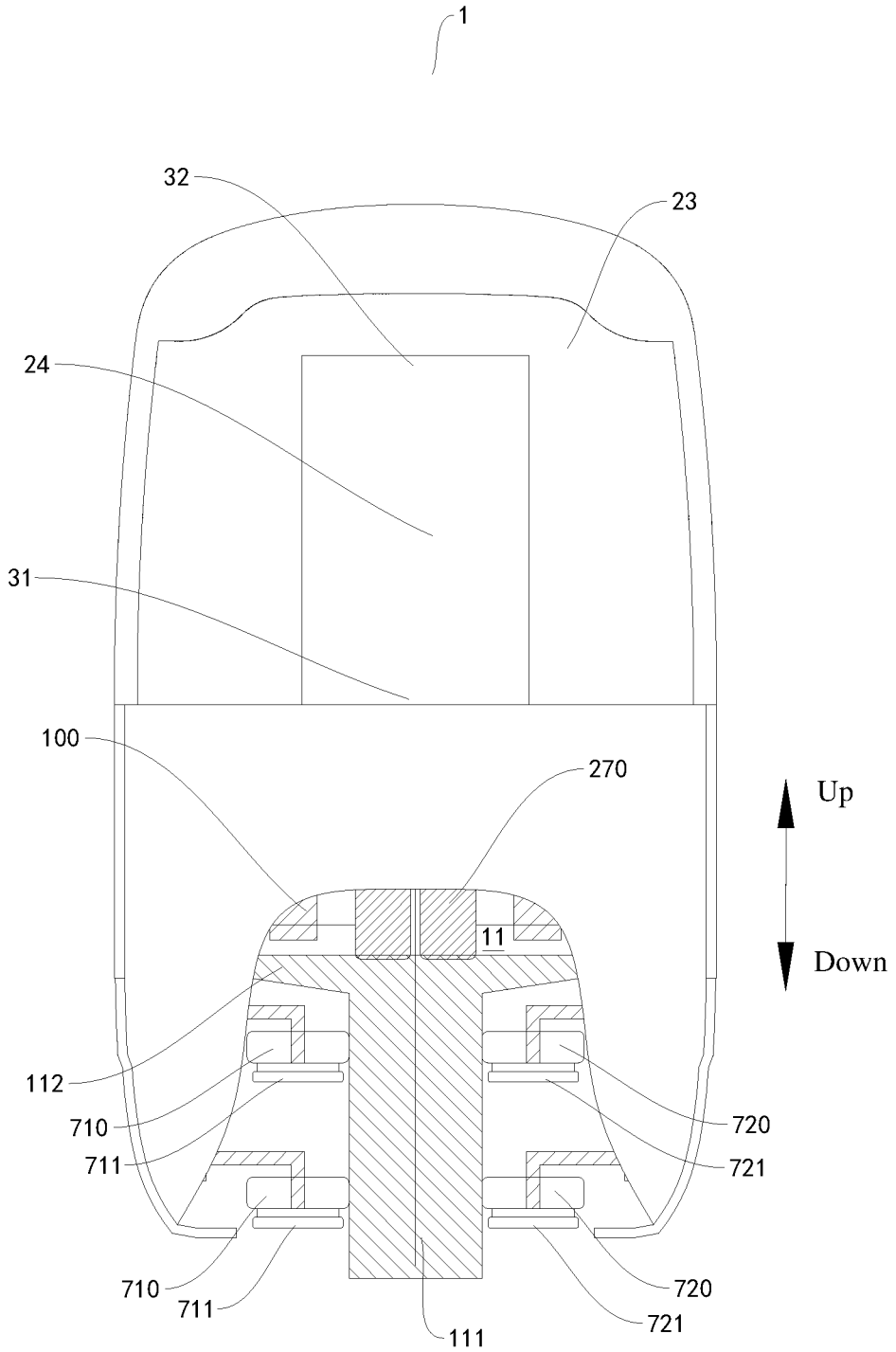
FIG. 72 is a sectional view of a rail transport system according to another embodiment of the present disclosure.

For example, as shown in FIG. 71, the first horizontal wheel 710 of the bogie 21 is fit on a first side surface of the steering portion 111 and is located right below a first side of the bottom plate 113. The second horizontal wheel 720 of the bogie 21 is fit on a second side surface of the steering portion 111 and is located right below a second side of the bottom plate 113. In this way, portions of the bottom plate 113 that extend from two sides of the steering portion 111 may respectively stop the first horizontal wheel 710 and the second horizontal wheel 720 from moving upwards, so as to achieve an anti-falling effect.

Furthermore, the first side plate 114 and the second side plate 115 may be disposed in a vertical state or a slanting state. A minimum distance between the first side plate 114 and the second side plate 115 is greater than a width of the steering portion 111. In this way, in an aspect, it may be convenient for a running wheel 270 of the bogie 21 to be fit on the bottom plate 113. In another aspect, the width of the escape passage 11 can be increased, thereby improving a speed of evacuation of passengers in an emergency. Optionally, as shown in FIG. 73, the first side plate 114 and the second side plate 115 are respectively connected at two side edges of the bottom plate 113.

Optionally, as shown in FIG. 73, the thickness of a portion that is of the bottom plate 113 and is connected to the steering portion 111 is greater than the thickness of a remaining portion of the bottom plate 113. In this way, the structural strength of a connection between the running portion 112 and the steering portion 111 can be increased, thereby improving the load capability at the connection between the running portion 112 and the steering portion 111, and ensuring the stability and reliability of the structure of the rail 10.

Figure 75:
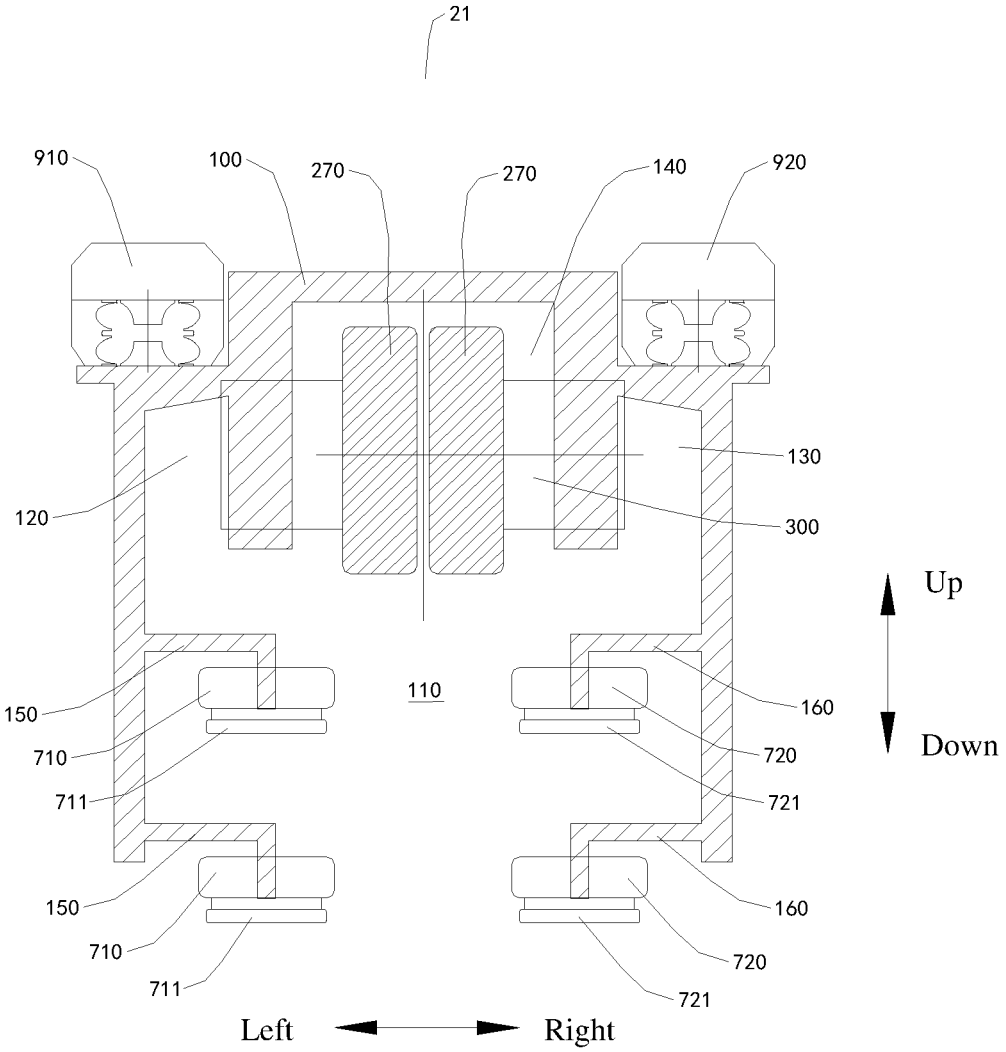
FIG. 75 is a sectional view of a bogie of a rail vehicle according to an embodiment of the present disclosure.
Figure 76:
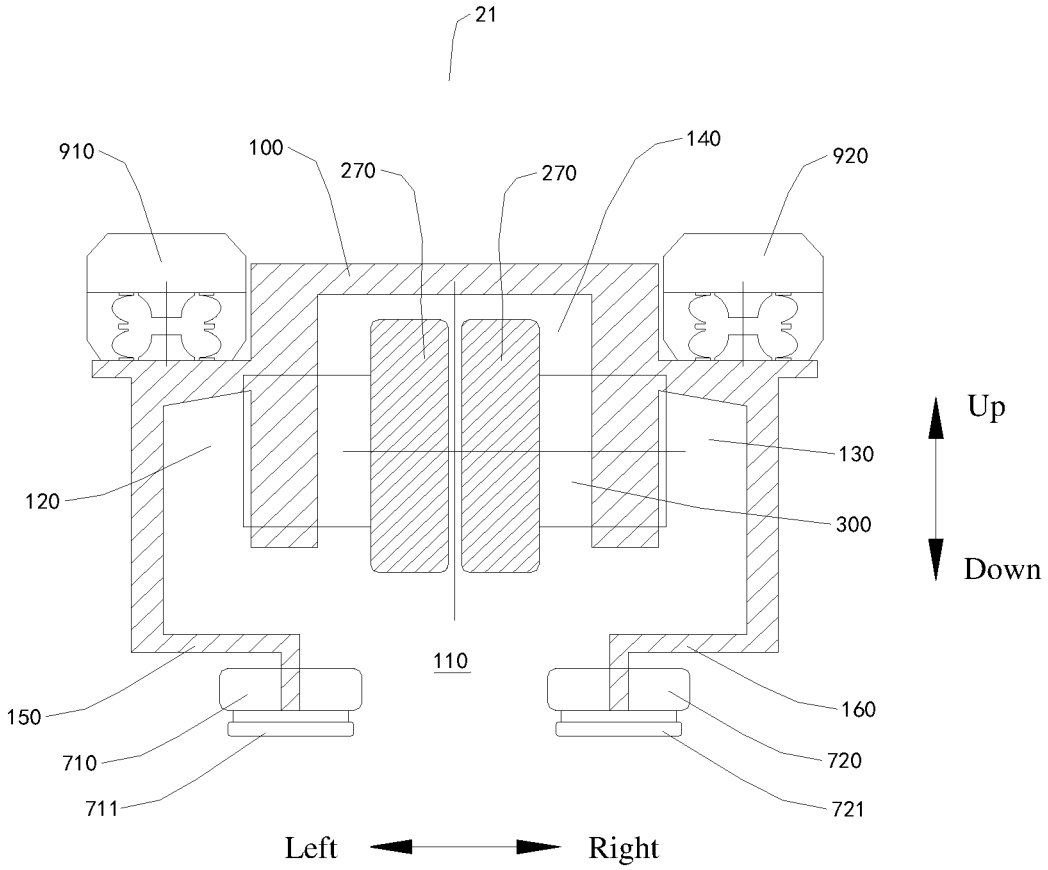
FIG. 76 is a sectional view of a bogie of a rail vehicle according to another embodiment of the present disclosure.

In some specific embodiments of the present disclosure, as shown in FIG. 75 and FIG. 76, the bogie 21 includes a bogie frame 100, a running wheel 270, and a driving device 300.

The bogie frame 100 has the second concave portion 110 for straddling the rail 10, the second concave portion 110 is formed by a hollow portion defined by a bottom of the running wheel 270, the first horizontal wheel 710 and the second horizontal wheel 720, and the innermost sides of the first horizontal wheel 710 and the second horizontal wheel 720 are in contact with outer sides of the steering portion 111. A first avoiding groove 120 and a second avoiding groove 130 are disposed on the bogie frame 100. The first side plate 114 extends into the first avoiding groove 120 and the second side plate 115 extends into the second avoiding groove 130. The running wheel 270 is pivotably mounted on the bogie frame 100 and is fit on an upper surface of the bottom plate 113. The running wheel 270 is located between the first side plate 114 and the second side plate 115 and is located right above the steering portion 111. The driving device 300 is mounted on the bogie frame 100, and the running wheel 270 is driven by the driving device 300. The first avoiding groove 120 and the second avoiding groove 130 configured to respectively avoid the first side plate 114 and the second side plate 115 are disposed at the bogie frame 100. Openings of the first avoiding groove 120 and the second avoiding groove 130 both face downwards, so that adverse impact caused by that the escape passage 11 disposed on the rail 10 can be eliminated. That is, in an aspect, the overall height of the rail vehicle 20 can be reduced. In another aspect, mounting of the running wheel 270 can be facilitated, making it convenient to control the size of the running wheel 270.

Further, as shown in FIG. 75 and FIG. 76, a running wheel mounting groove 140 located between the first avoiding groove 120 and the second avoiding groove 130 is disposed on the bogie frame 100. An opening of the running wheel mounting groove 140 faces downwards. The running wheel 270 is pivotably mounted on two side walls of the running wheel mounting groove 140 and is located inside the running wheel mounting groove 140, so as to facilitate mounting of the running wheel 270, making the structure of the bogie 21 more compact.

Optionally, as shown in FIG. 75 and FIG. 76, a plurality of running wheels 270 exist. The plurality of running wheels 270 are pivotably mounted on the bogie frame 100 and are all fit on an upper surface of the bottom plate 113. The plurality of running wheels 270 are all located between the first side plate 114 and the second side plate 115 and are all located right above the steering portion 111. In this way, the load capability of the bogie 21 can be improved, to support the vehicle body 22 stably.

In some specific embodiments of the present disclosure, as shown in FIG. 75 to FIG. 95 and FIG. 99, the bogie 21 further includes a first horizontal wheel 710 and a second horizontal wheel 720, and the bogie 21 may include one first horizontal wheel 710 or a plurality of first horizontal wheels 710, and/or one second horizontal wheel 720 or a plurality of second horizontal wheels 720.

The first horizontal wheel 710 is pivotably mounted on the bogie frame 100 and is fit on a first side surface of the steering portion 111. The second horizontal wheels 720 is pivotably mounted on the bogie frame 100 and is fit on a second side surface of the steering portion 111. In an aspect, when the rail 10 steers, the first horizontal wheel 710 and the second horizontal wheel 720 are fit on side surfaces of the rail 10, to form passive steering along the rail 10, so as to drive the rail vehicle 20 to steer. In another aspect, the stability of the rail vehicle 20 during running can be improved. In addition, the first horizontal wheel 710 and the second horizontal wheel 720 are both located right below the running portion 112, so that the bogie 21 can be prevented from falling out of the rail 10.

Optionally, as shown in FIG. 75 and FIG. 76, a first horizontal wheel mounting limb 150 that extends from a first side of the steering portion 111 to a portion right below the bottom plate 113 and a second horizontal wheel mounting limb 160 that extends from a second side of the steering portion 111 to a portion right below the bottom plate 113 are disposed on the bogie frame 100. The first horizontal wheel 710 is pivotably mounted on the first horizontal wheel mounting limb 150 and the second horizontal wheels 720 is pivotably mounted on the second horizontal wheel mounting limb 160. In this way, it may be convenient for the first horizontal wheel 710 to be fit on the first side surface of the steering portion 111 and be located right below the first side of the bottom plate 113, and it may be convenient for the second horizontal wheel 720 to be fit on the second side surface of the steering portion 111 and be located right below the second side of the bottom plate 113. In this way, the bogie frame 100 has complete and secure protection, so that safety performance when the rail vehicle 20 operates on the rail 10 can be ensured.

Furthermore, the bogie 21 further includes: a first horizontal safety wheel 711 that moves synchronously with the first horizontal wheel 710 and is connected to the first horizontal wheel and a second horizontal safety wheel 721 that moves synchronously with the second horizontal wheel 720 and is connected to the second horizontal wheel. An external diameter of the first horizontal safety wheel 711 is less than an external diameter of the first horizontal wheel 710, and an external diameter of the second horizontal safety wheel 721 is less than an external diameter of the second horizontal wheel 720. Specifically, as shown in FIG. 75 and FIG. 76, the first horizontal safety wheel 711 that moves synchronously with the first horizontal wheel 710 is connected below the first horizontal wheel 710, and the external diameter of the first horizontal safety wheel 711 is less than the external diameter of the first horizontal wheel 710. The second horizontal safety wheel 721 that moves synchronously with the second horizontal wheel 720 is connected below the second horizontal wheel 720, and the external diameter of the second horizontal safety wheel 721 is less than the external diameter of the second horizontal wheel 720. Normally, the first horizontal safety wheel 711 and the second horizontal safety wheel 721 are not in contact with the steering portion 111. When a horizontal wheel encounters a blowout, a horizontal safety wheel is in contact with the steering portion 111 to replace a horizontal wheel, so as to ensure the stability of running of the rail vehicle 20.

Figure 88:
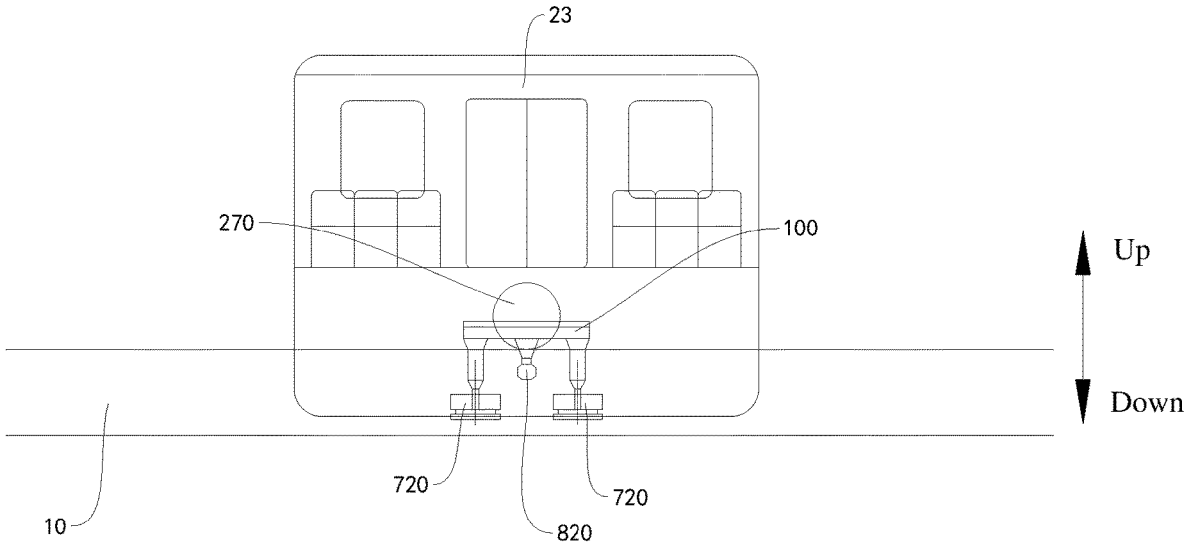
FIG. 88 is a partially schematic view of a rail transport system according to an embodiment of the present disclosure.

In some specific examples of the present disclosure, as shown in FIG. 88, the first horizontal wheel 710 and the second horizontal wheel 720 are located at a same height in an up-down direction. In this way, the balance of overall steering performance of the rail vehicle 20 may be facilitated, and the rail vehicle 20 subjects to even forces when running forwards and backwards, so as to improve the turning performance of the rail vehicle 20.

Figure 89:
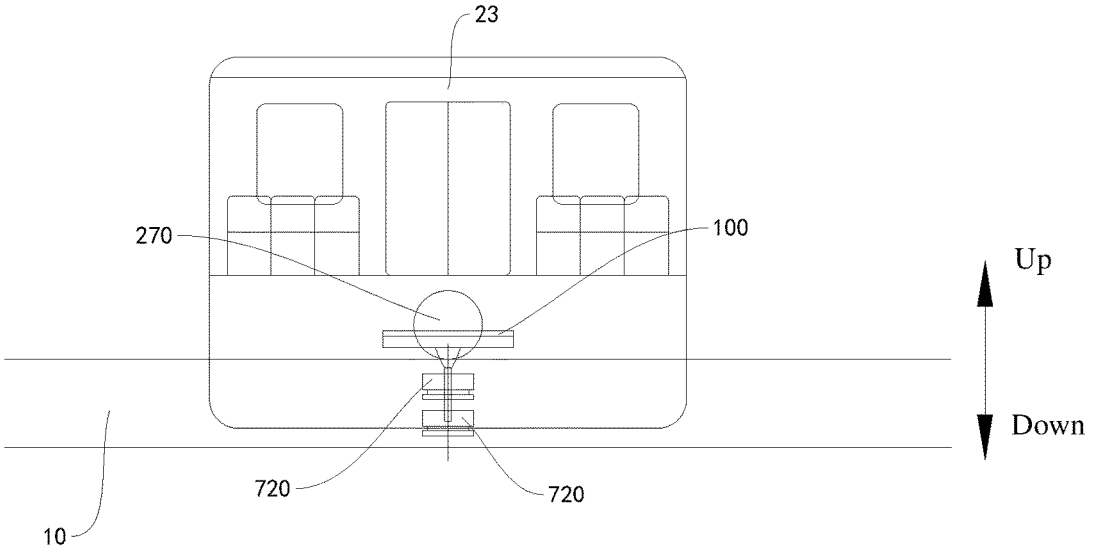
FIG. 89 is a partially schematic view of a rail transport system according to an embodiment of the present disclosure.

In some specific examples of the present disclosure, as shown in FIG. 89, a plurality of first horizontal wheels 710 exist and are spaced apart and coaxial in an up-down direction, and a plurality of second horizontal wheels 720 exist and are spaced apart and coaxial in an up-down direction. In this way, the stability performance of an entire vehicle can be improved, and horizontal wheels below have an effect of achieving stabilization, thereby reducing a risk that the rail vehicle 20 overturns during turning or high-speed running.

Figure 90:
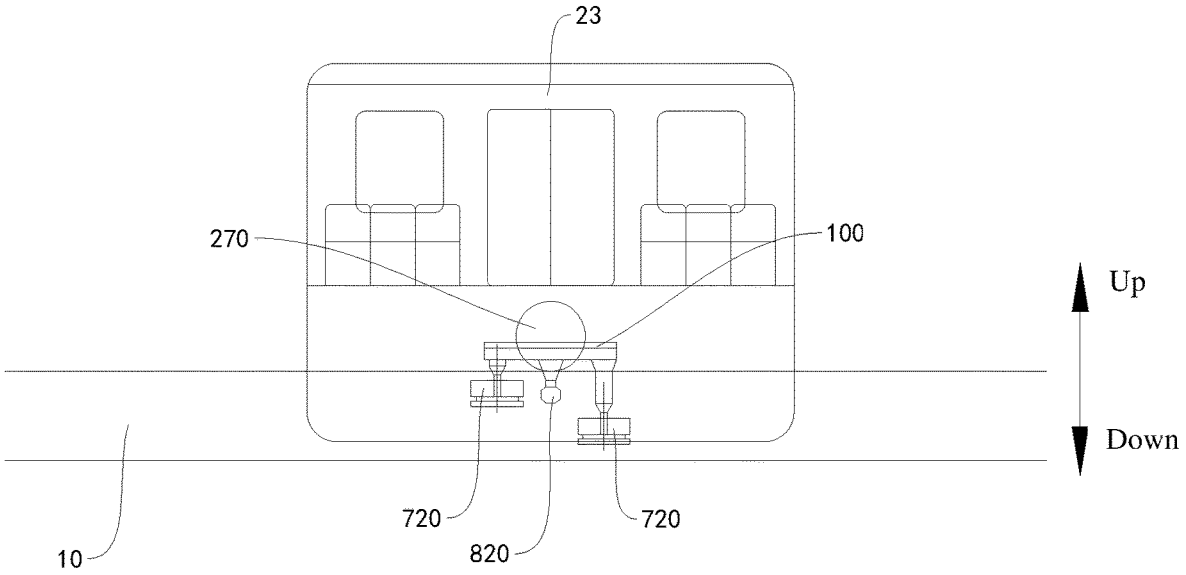
FIG. 90 is a partially schematic view of a rail transport system according to an embodiment of the present disclosure.
Figure 91:
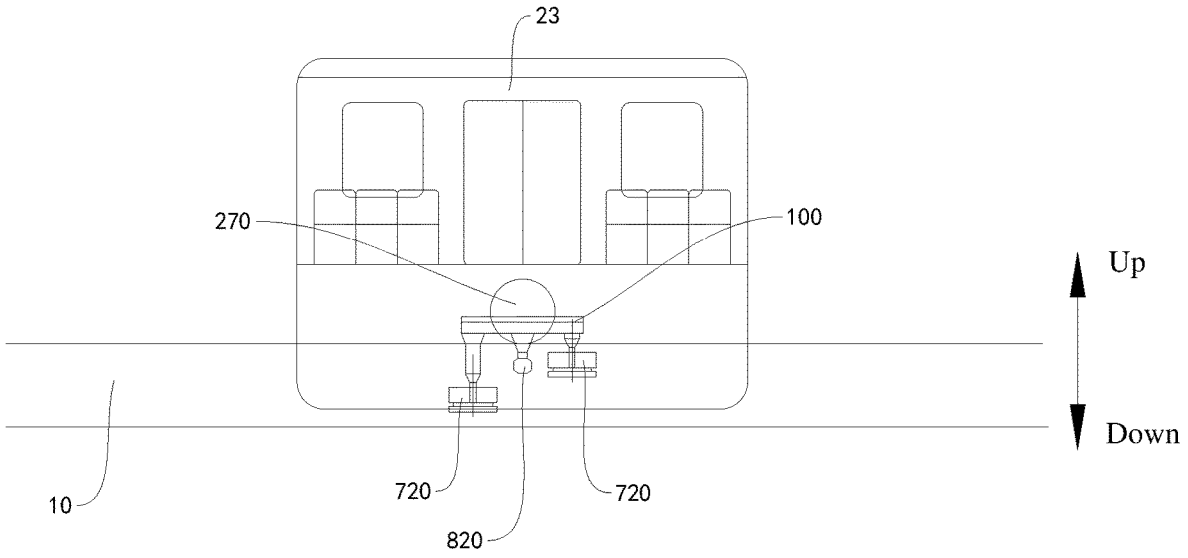
FIG. 91 is a partially schematic view of a rail transport system according to an embodiment of the present disclosure.
Figure 92:
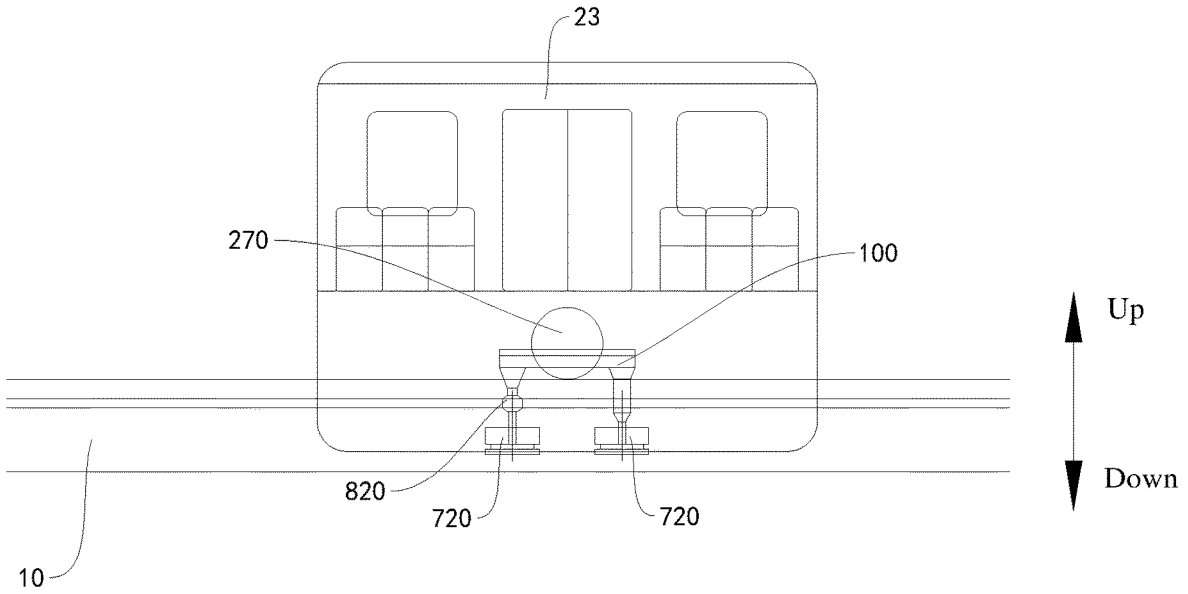
FIG. 92 is a partially schematic view of a rail transport system according to an embodiment of the present disclosure.
Figure 93:
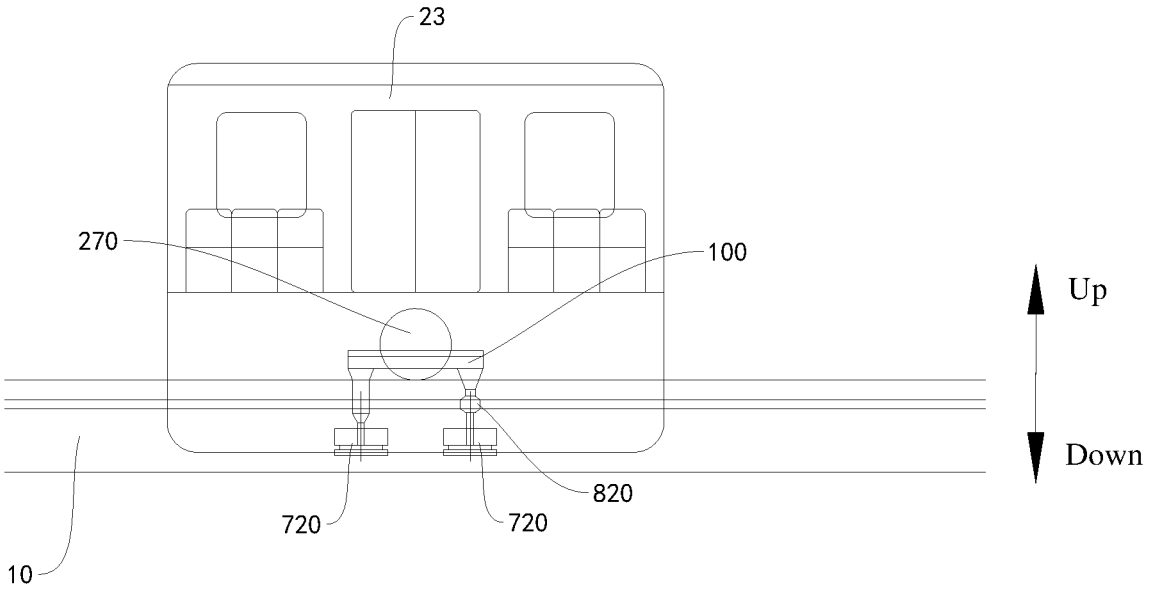
FIG. 93 is a partially schematic view of a rail transport system according to an embodiment of the present disclosure.
Figure 94:
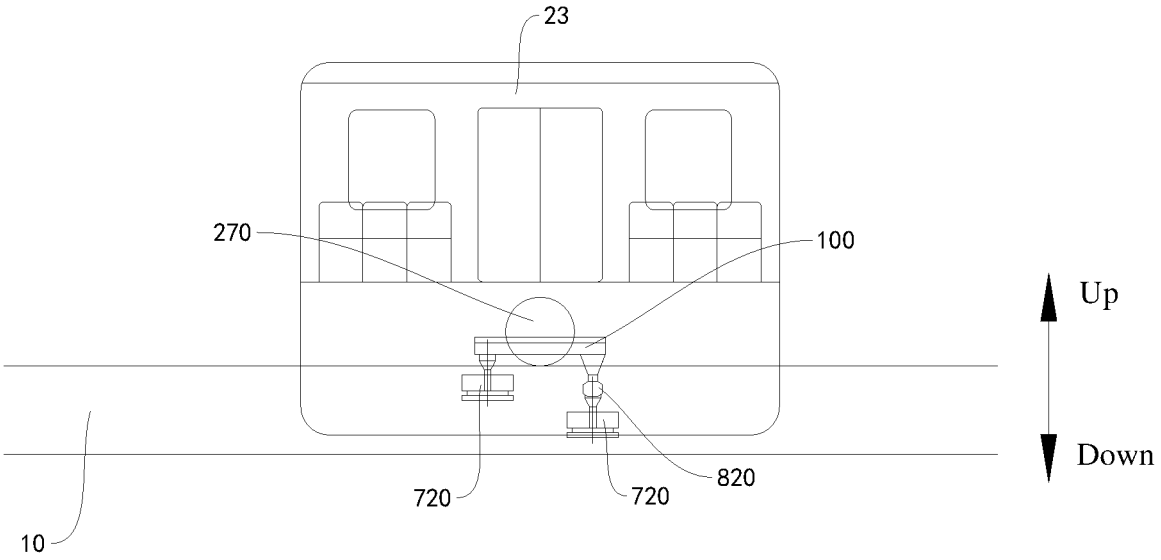
FIG. 94 is a partially schematic view of a rail transport system according to an embodiment of the present disclosure.
Figure 95:
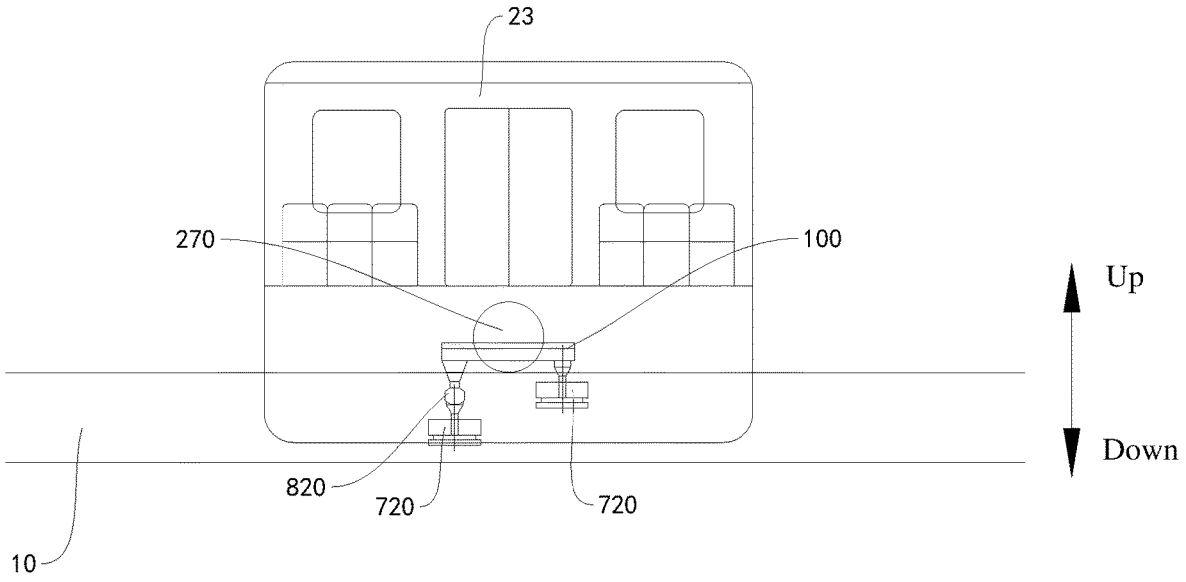
FIG. 95 is a partially schematic view of a rail transport system according to an embodiment of the present disclosure.

In some specific examples of the present disclosure, as shown in FIG. 90 and FIG. 91, a plurality of first horizontal wheels 710 exist and are spaced apart in an up-down direction and a lengthwise direction of the steering portion 111, and a plurality of second horizontal wheels 720 exist and are spaced apart in an up-down direction and the lengthwise direction of the steering portion 111. That is, the first horizontal wheel 710 is disposed in a staggered manner in the up-down direction, and the second horizontal wheel 720 is disposed in a staggered manner in the up-down direction. Some of the plurality of first horizontal wheels 710 may be located above some of the plurality of second horizontal wheels 720, and some of the plurality of first horizontal wheels 710 may also be located below some of the plurality of second horizontal wheels 720. In this way, during running, the horizontal wheels above can have a guiding effect, and the horizontal wheels below are relatively far away from the vehicle body 22 and can achieve an effect of stabilization and overturning prevention.

In some examples of the present disclosure, as shown in FIG. 77 to FIG. 84, the bogie 21 further includes a first collector shoe 810 and a second collector shoe 820.

A first conductor rail 830 that extends in the lengthwise direction of the steering portion 111 is disposed on the first side surface of the steering portion 111, and a second conductor rail 840 that extends in the lengthwise direction of the steering portion 111 is disposed on the second side surface of the steering portion 111. The first collector shoe 810 is disposed on the bogie frame 100 and is fit with the first conductor rail 830, and the second collector shoe 820 is disposed on the bogie frame 100 and is fit with the second conductor rail 840. The first collector shoe 810 draws electricity through the first conductor rail 830, and the second collector shoe 820 draws electricity through the second conductor rail 840, so that the electricity is supplied for use by the rail vehicle 20.

In some specific examples of the present disclosure, as shown in FIG. 18, FIG. 90, and FIG. 91, a plurality of first horizontal wheels 710 exist and are spaced apart in the lengthwise direction of the steering portion 111, and the first collector shoe 810 is located between adjacent first horizontal wheels 710 in the lengthwise direction of the steering portion 111. A plurality of second horizontal wheels 720 exist and are spaced apart in the lengthwise direction of the steering portion 111, and the second collector shoe 820 is located between adjacent second horizontal wheels 720 in the lengthwise direction of the steering portion 111. In this way, a force applied on the first horizontal wheel 710 does not affect the first collector shoe 810 and a force applied on the second horizontal wheel 720 does not affect the second collector shoe 820, space utilization can be improved, and the structure of the bogie 21 is simplified.

For example, FIG. 88, FIG. 90, and FIG. 91 show examples in which the first collector shoe 810 of the bogie 21 is located between adjacent first horizontal wheels 710 in the lengthwise direction of the steering portion 111 and the second collector shoe 820 of the bogie 21 is located between adjacent second horizontal wheels 720 in the lengthwise direction of the steering portion 111. The plurality of first horizontal wheels 710 and the plurality of second horizontal wheels 720 may be located at a same height. The plurality of first horizontal wheels 710 may also be disposed in a staggered manner in an up-down direction and the plurality of second horizontal wheels 720 may also be disposed in a staggered manner in an up-down direction.

In some specific examples of the present disclosure, as shown in FIG. 92 to FIG. 95, a plurality of first horizontal wheels 710 exist and are spaced apart in the lengthwise direction of the steering portion 111. The first collector shoe 810 and one of the plurality of first horizontal wheel 710 are aligned in an up-down direction. For example, a central axis of the first collector shoe 810 and a central axis of the one of the plurality of first horizontal wheels 710 coincide. A plurality of second horizontal wheels 720 exist and are spaced apart in the lengthwise direction of the steering portion 111. The second collector shoe 820 and one of the plurality of second horizontal wheels 720 are aligned in an up-down direction. For example, a central axis of the second collector shoe 820 and a central axis of the one of the plurality of second horizontal wheels 720 coincide. In other words, collector shoes are disposed in the front or in the rear. In this way, mounting space of the horizontal wheels can be fully utilized, and no additional mounting mechanism is needed, so that the structure of the bogie 21 is simplified and the weight of the bogie 21 is reduced.

For example, FIG. 92 to FIG. 95 show examples in which the collector shoes of the bogie 21 are disposed in the front or in the rear. The plurality of first horizontal wheels 710 and the plurality of second horizontal wheels 720 may be located at a same height. The plurality of first horizontal wheels 710 may also be located at different heights and the plurality of second horizontal wheels 720 may also be located at different heights.

Figure 77:
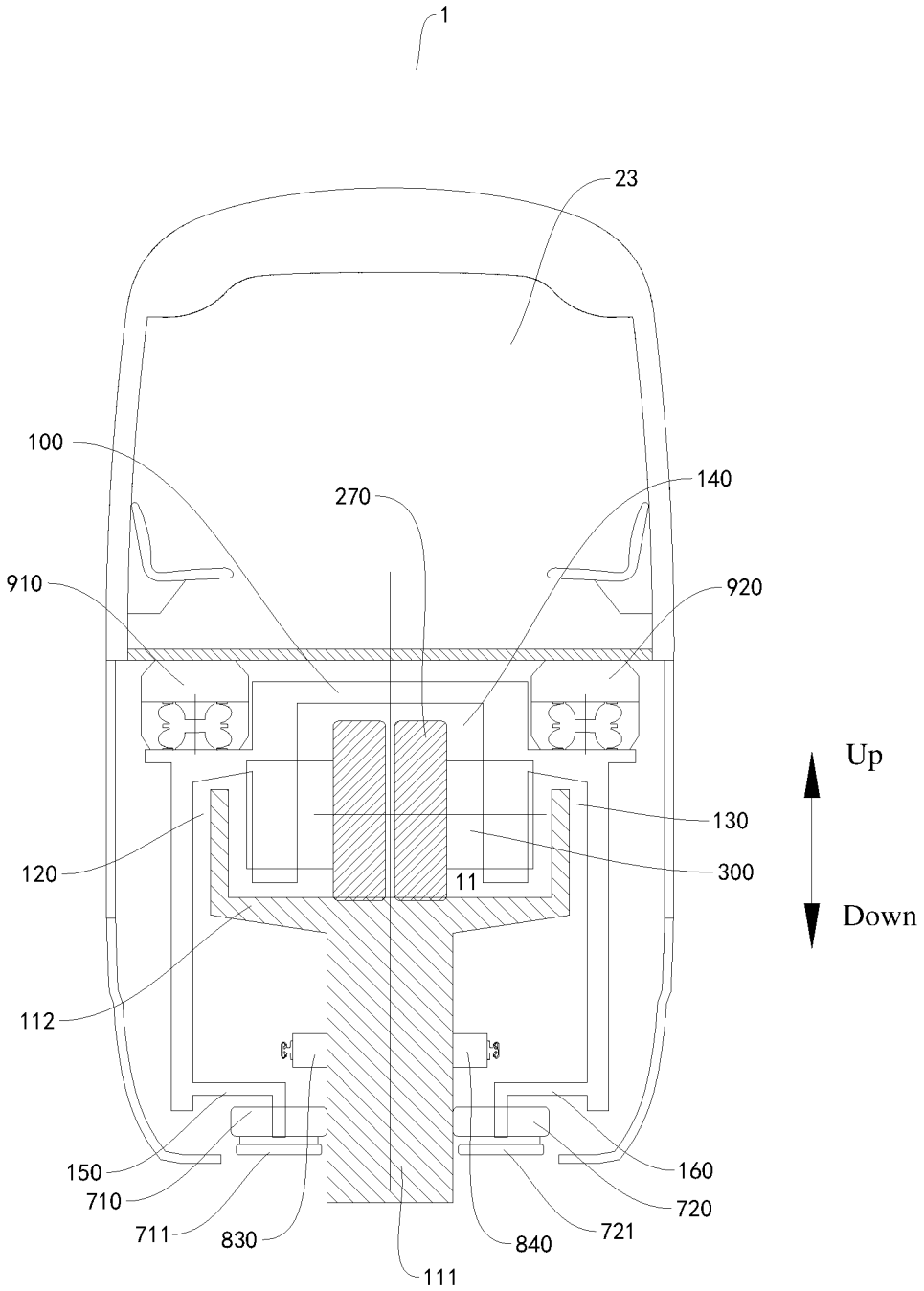
FIG. 77 is a sectional view of a rail transport system according to another embodiment of the present disclosure.
Figure 78:
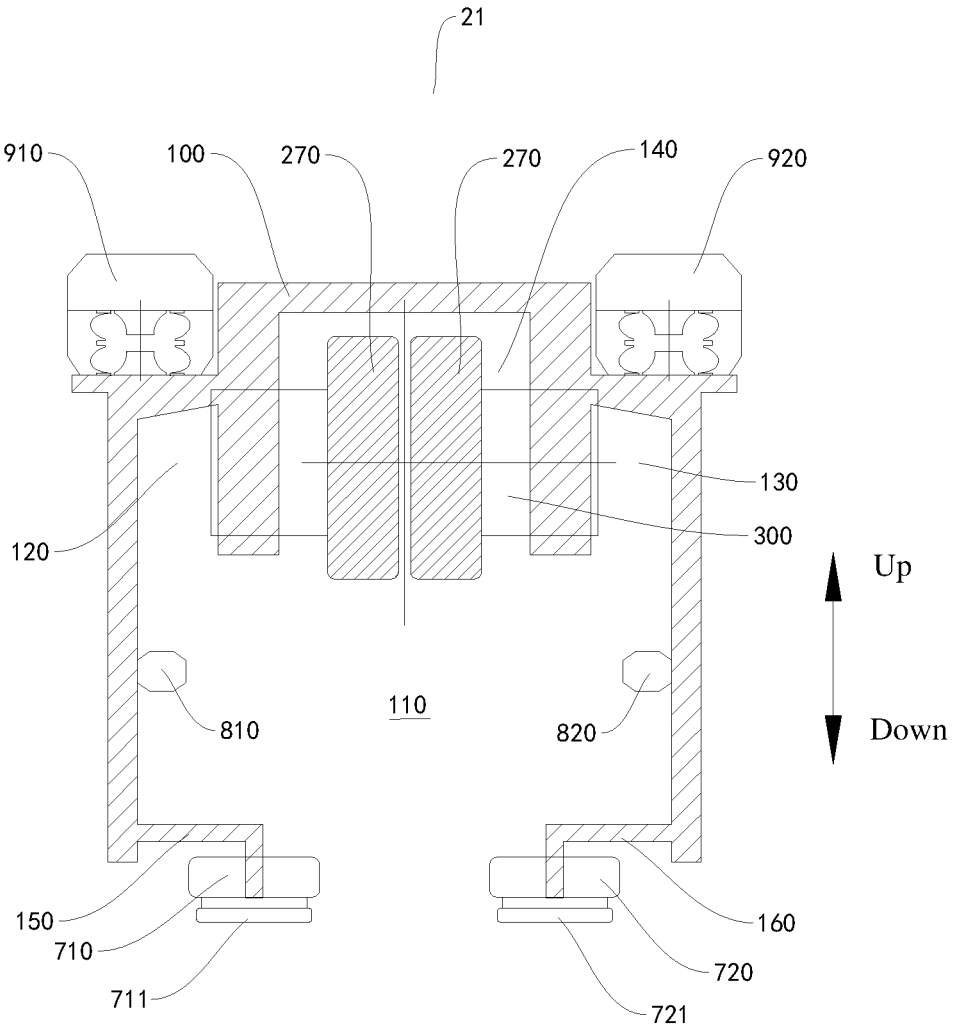
FIG. 78 is a sectional view of a bogie of a rail vehicle according to another embodiment of the present disclosure.

In some specific embodiments of the present disclosure, as shown in FIG. 77 and FIG. 78, the first collector shoe 810 is located above each first horizontal wheel 710, and the second collector shoe 820 is located above each second horizontal wheel 720. A distance between the collector shoe and the driving device 300 is reduced, which facilitates energy transfer and improves space utilization.

Figure 79:
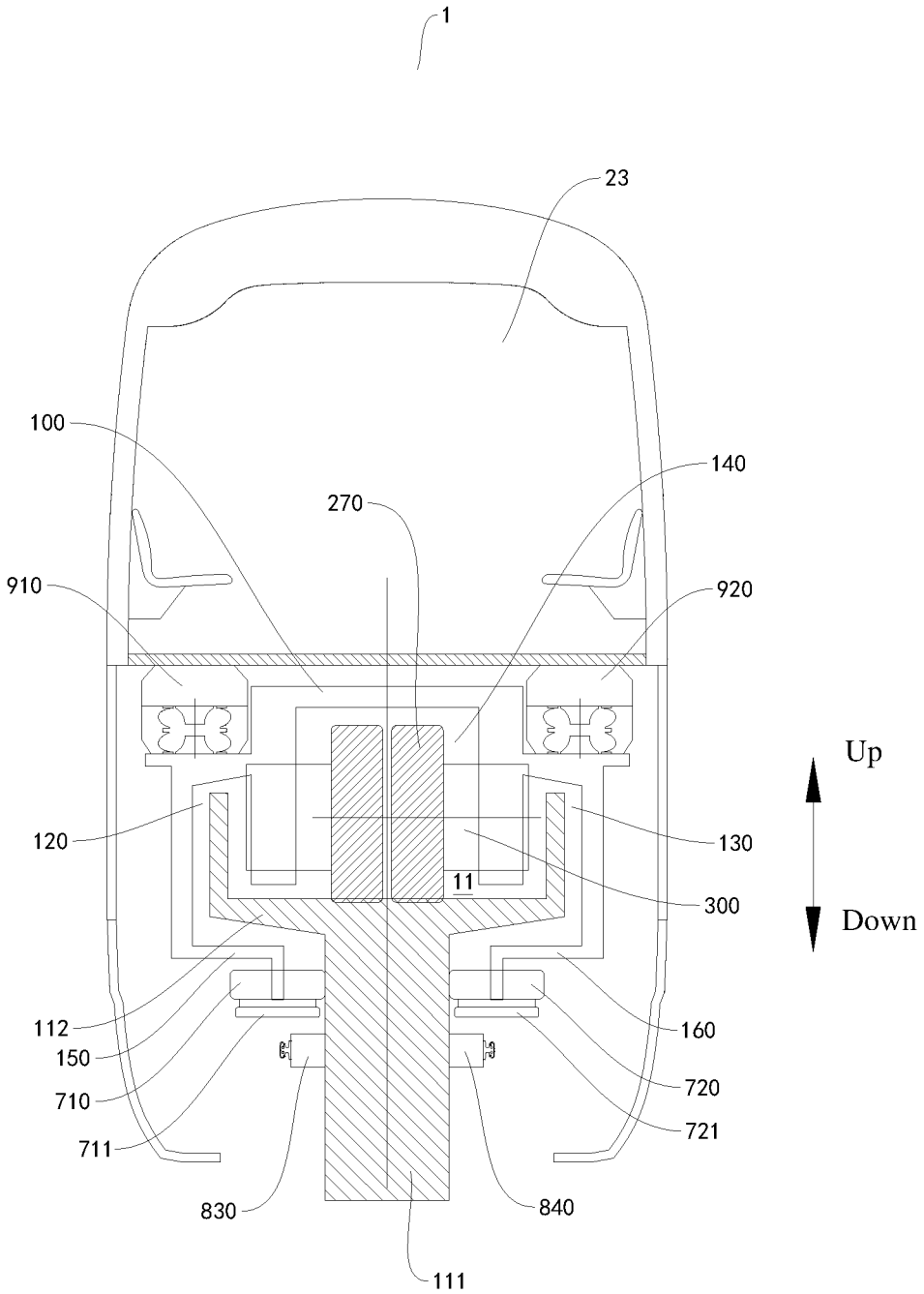
FIG. 79 is a sectional view of a rail transport system according to another embodiment of the present disclosure.
Figure 80:
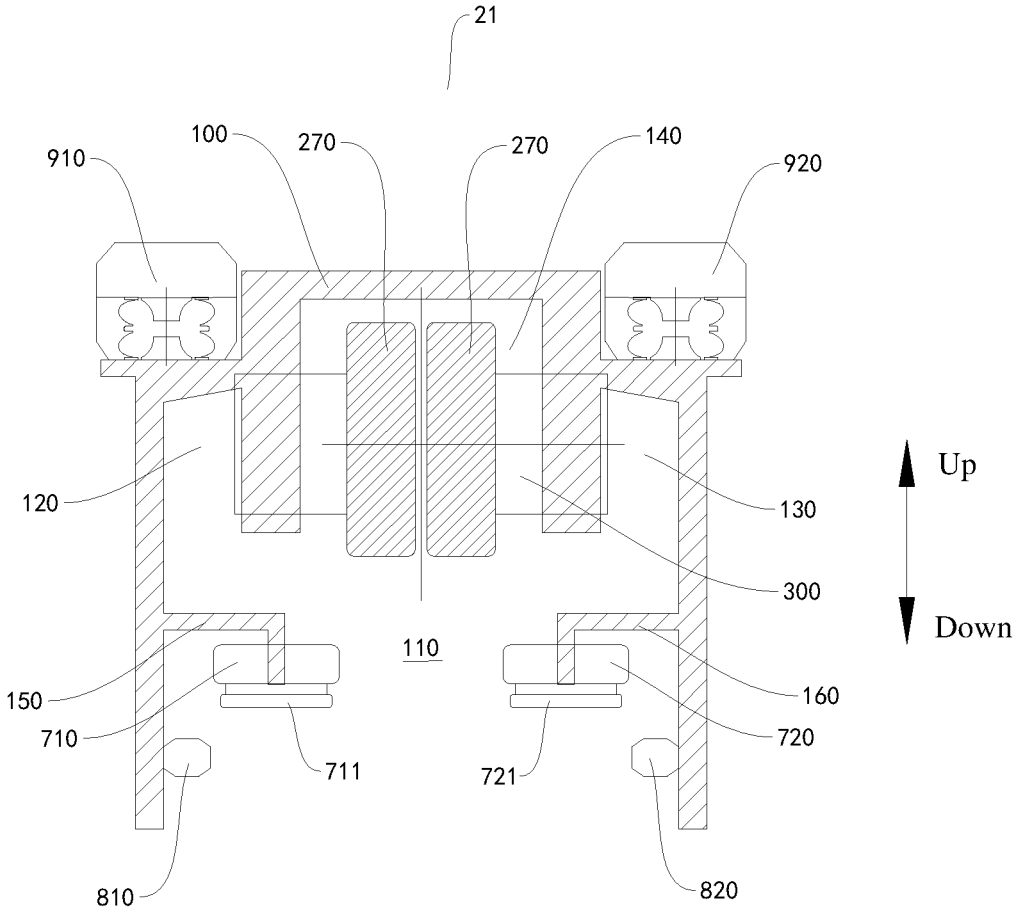
FIG. 80 is a sectional view of a bogie of a rail vehicle according to another embodiment of the present disclosure.

In some specific embodiments of the present disclosure, as shown in FIG. 79 and FIG. 80, the first collector shoe 810 is located below each first horizontal wheel 710, and the second collector shoe 820 is located below each second horizontal wheel 720, In this way, the horizontal wheel is arranged at a position near an upper portion of a track beam, to facilitate stability of the running rail vehicle 20.

Figure 81:
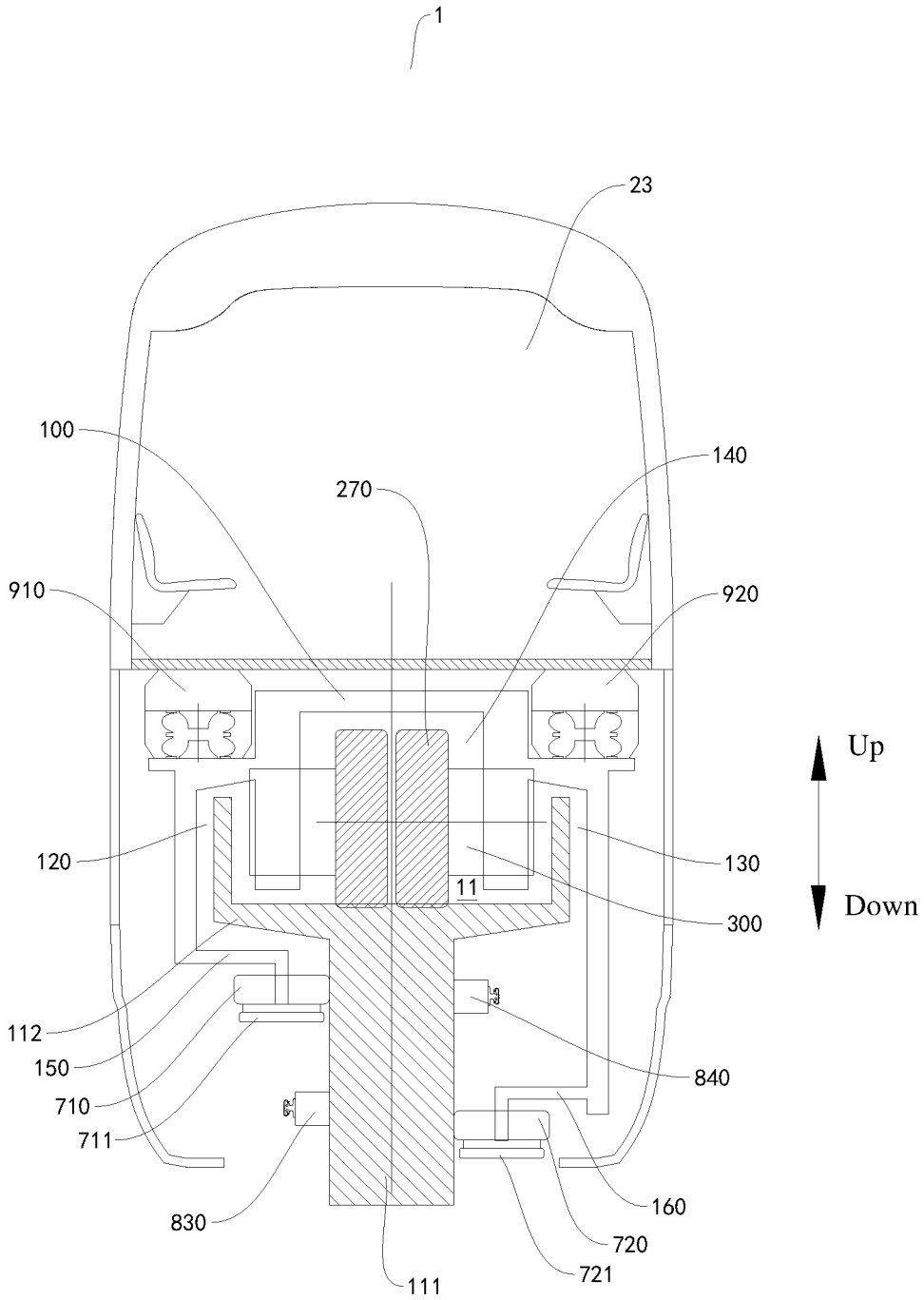
FIG. 81 is a sectional view of a rail transport system according to another embodiment of the present disclosure.
Figure 82:
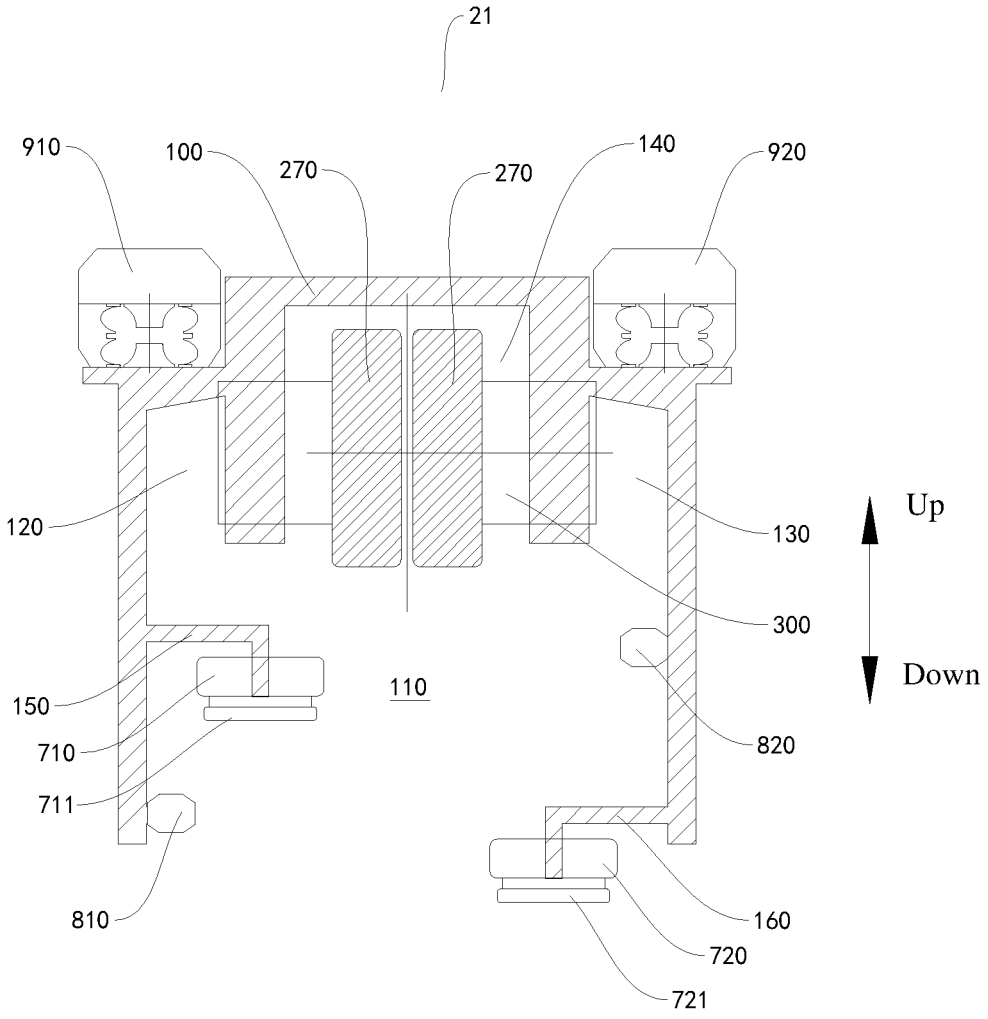
FIG. 82 is a sectional view of a bogie of a rail vehicle according to another embodiment of the present disclosure.

In some specific embodiments of the present disclosure, as shown in FIG. 81 and FIG. 82, the first collector shoe 810 is located below each first horizontal wheel 710, and the second collector shoe 820 is located above each second horizontal wheel 720. In this way, collector shoes are arranged in the up-down direction according to polarities for drawing currents. For example, a collector shoe at an upper portion is connected to a positive electrode of a current, and a collector shoe at a lower portion on an opposite side is connected to a negative electrode of the current. In this way, thereby facilitating space distribution and improving the safety of current reception.

Figure 83:
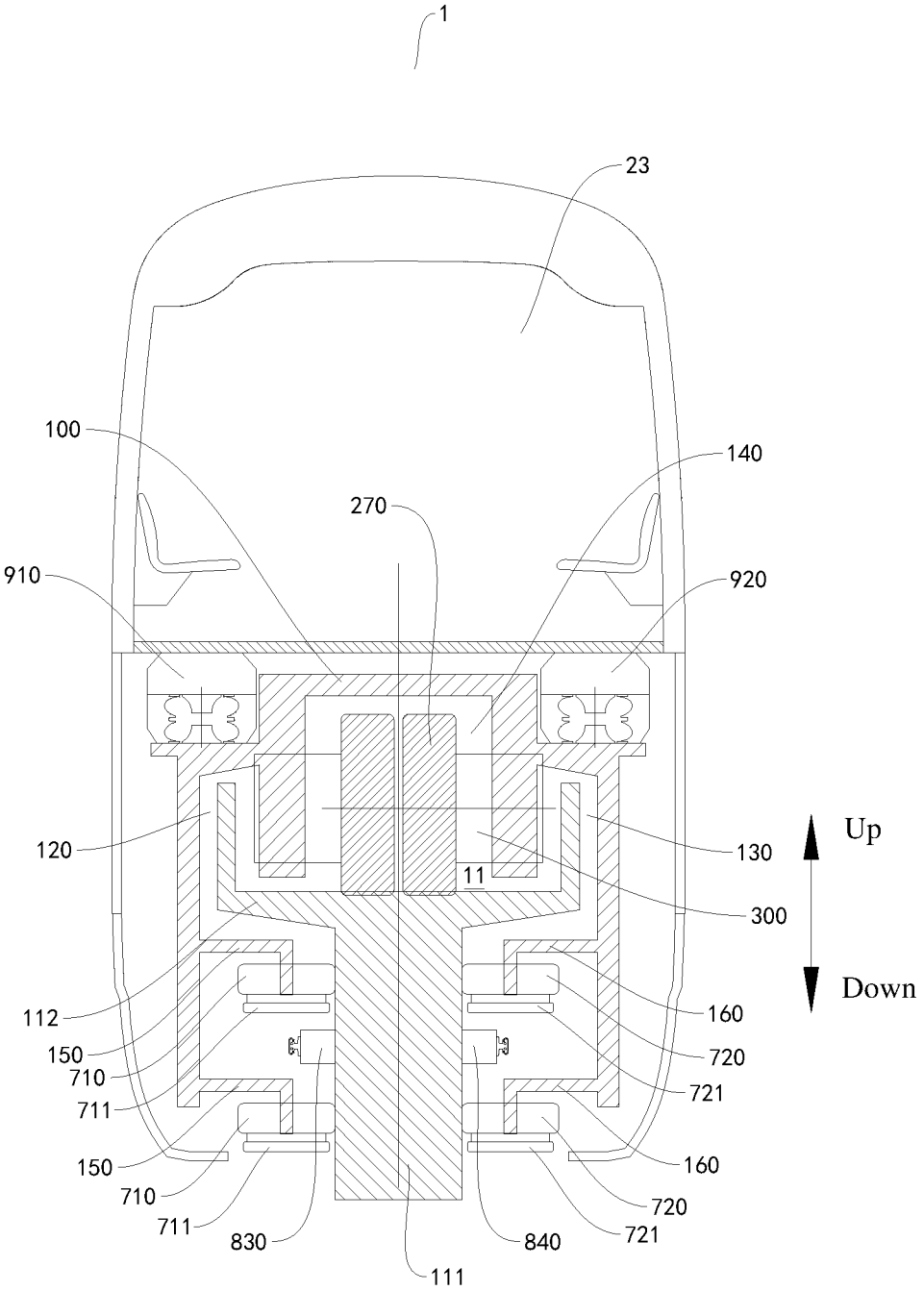
FIG. 83 is a sectional view of a rail transport system according to another embodiment of the present disclosure.
Figure 84:
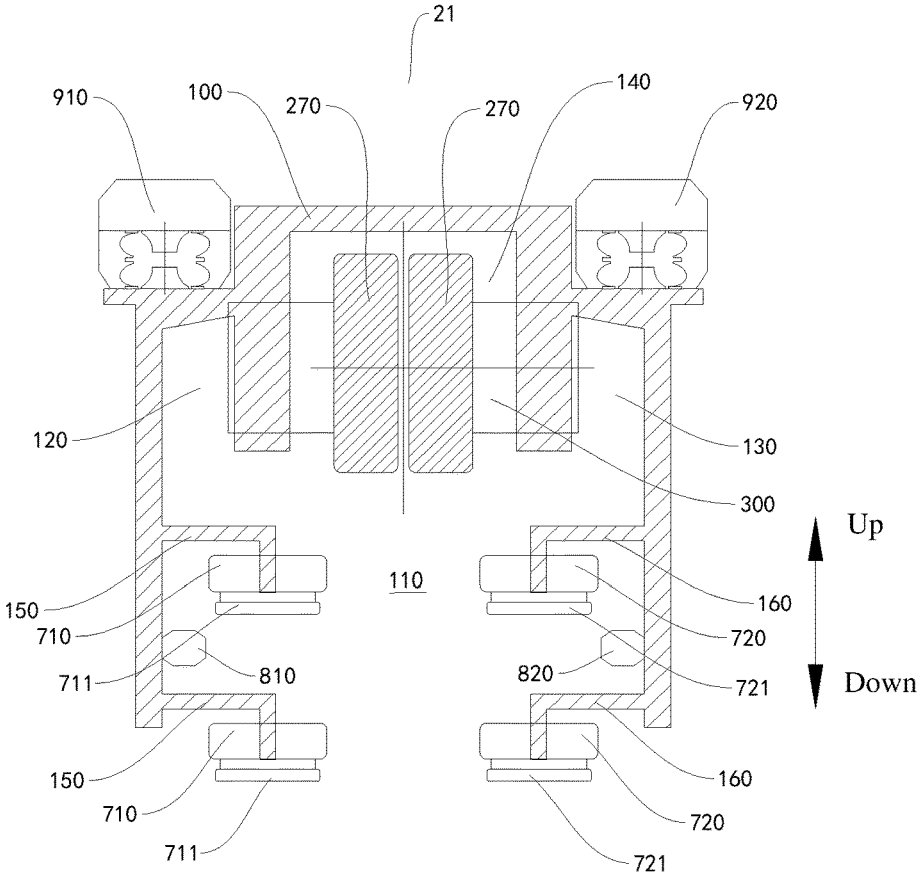
FIG. 84 is a sectional view of a bogie of a rail vehicle according to another embodiment of the present disclosure.

In some specific embodiments of the present disclosure, as shown in FIG. 83 and FIG. 84, a plurality of first horizontal wheels 710 exist and are spaced apart in an up-down direction, and the first collector shoe 810 is located between adjacent first horizontal wheels 710 in the up-down direction. A plurality of second horizontal wheels 720 exist and are spaced apart in an up-down direction, and the second collector shoe 820 is located between adjacent second horizontal wheels 720 in the up-down direction. In this way, space distribution and stabilization of an overall structure can be facilitated.

Figure 98:
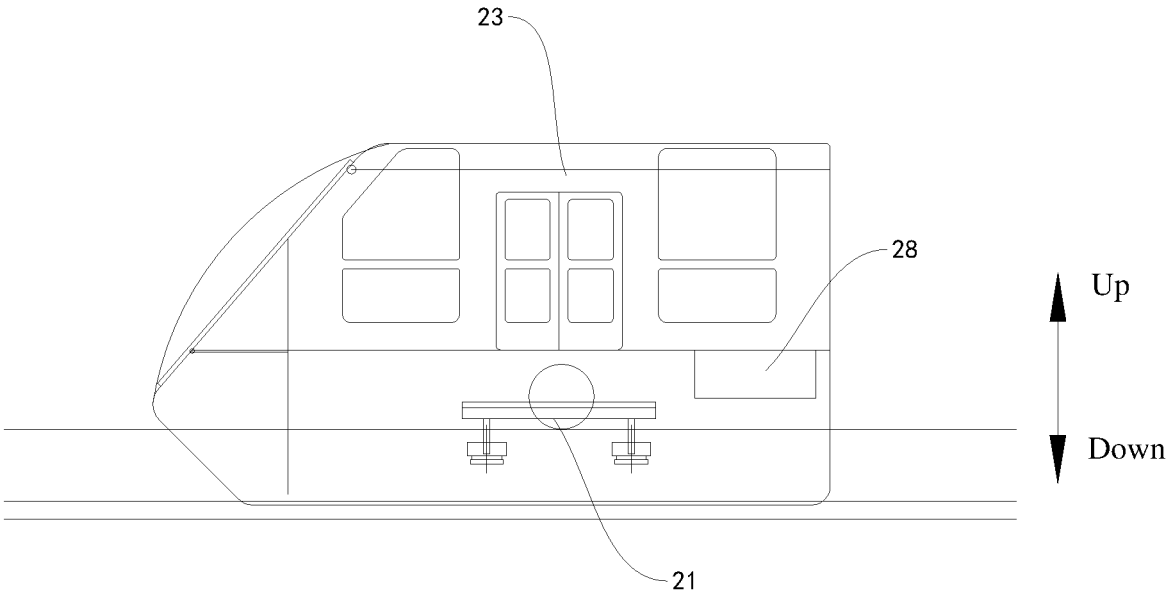
FIG. 98 is a partially schematic view of a rail transport system according to another embodiment of the present disclosure.

In another embodiment of the present disclosure, as shown in FIG. 98, the rail transport system 1 according to this embodiment of the present disclosure may be applied to transport connections between a main line and community areas. Therefore, a volume of a rail vehicle 20 is smaller than a volume of a mainline rail vehicle, so that a conductor rail and a collector shoe can be cancelled. The power battery 28 is used to supply power. The power battery 28 supplies power for running the rail vehicle 20, and certainly may also supply power to another part needing power of the rail vehicle 20. In this way, the structure and power supply lines can be simplified, thereby reducing a cost.

Specifically, the power battery 28 may be disposed at a portion other than the bogie 21, for example, may be mounted on a bottom portion of a carriage 23, or may be mounted inside a carriage 23. The power battery 28 can ensure normal operation at a needed speed, and is automatically charged when a passenger flow is relatively small.

Figure 85:
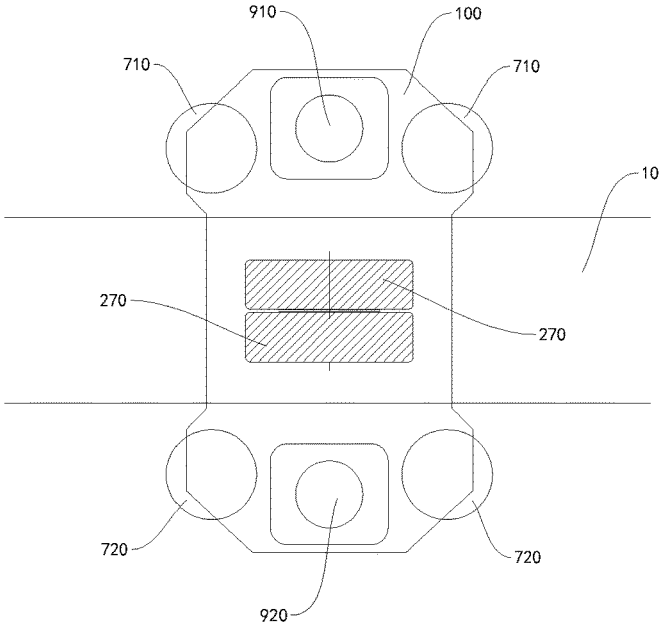
FIG. 85 is a schematic view of a bogie of a rail vehicle according to an embodiment of the present disclosure.
Figure 86:
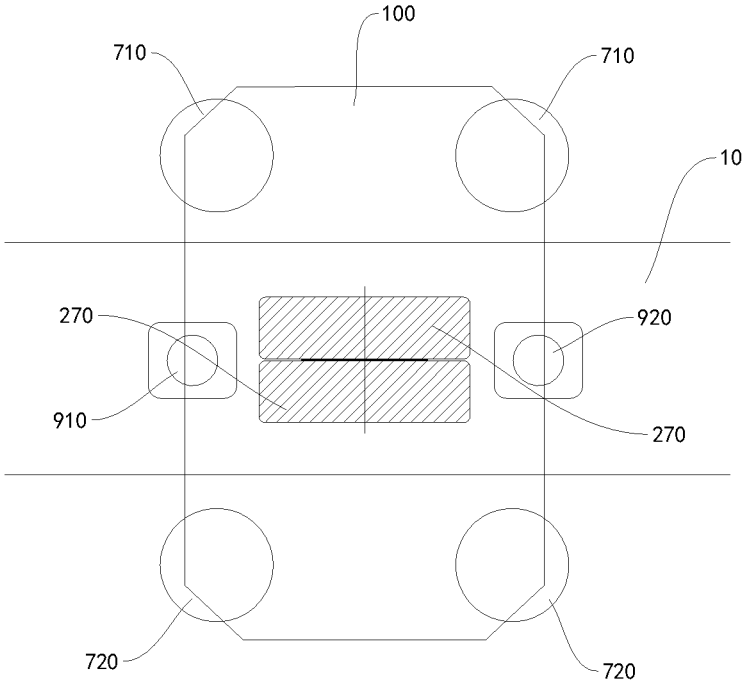
FIG. 86 is a schematic view of a bogie of a rail vehicle according to another embodiment of the present disclosure.

In some specific examples of the present disclosure, as shown in FIG. 85 and FIG. 86, the bogie 21 further includes a first support suspension device 910 and a second support suspension device 920.

The first support suspension device 910 and the second support suspension device 920 are mounted on the bogie frame 100 and are connected to the vehicle body 22. The first support suspension device 910 and the second support suspension device 920 are spaced apart in the lengthwise direction of the rail 10. In a horizontal plane, a central axis of the first support suspension device 910 and a central axis of the second support suspension device 920 are located on a central axis of the bogie frame 100, and the central axis of the bogie frame 100 equally divides the bogie frame 100 in the width direction of the rail 10.

Alternatively, the first support suspension device 910 and the second support suspension device 920 are spaced apart in the width direction of the rail 10. In a horizontal plane, a central axis of the first support suspension device 910 and a central axis of the second support suspension device 920 are located on a central axis of the bogie frame 100, and the central axis of the bogie frame 100 equally divides the bogie frame 100 in the lengthwise direction of the rail 10.

The first support suspension device 910 and the second support suspension device 920 are configured to support the vehicle body 22 and achieve an effect of shock absorption. The first support suspension device 910 and the second support suspension device 920 are subject to even forces and have even supporting effects, so that the stability and comfort of the rail vehicle 20 are ensured and a cost is relatively low.

For example, the first support suspension device 910 and the second support suspension device 920 may be spaced apart in the lengthwise direction of the rail 10 and located on a central axis that equally divides the bogie frame 100 in the width direction of the rail 10 (as shown in FIG. 86). The first support suspension device 910 and the second support suspension device 920 may also be spaced apart in the width direction of the rail 10 and located on a central axis that equally divides the bogie frame 100 in the lengthwise direction of the rail 10 (as shown in FIG. 85).

Figure 87:
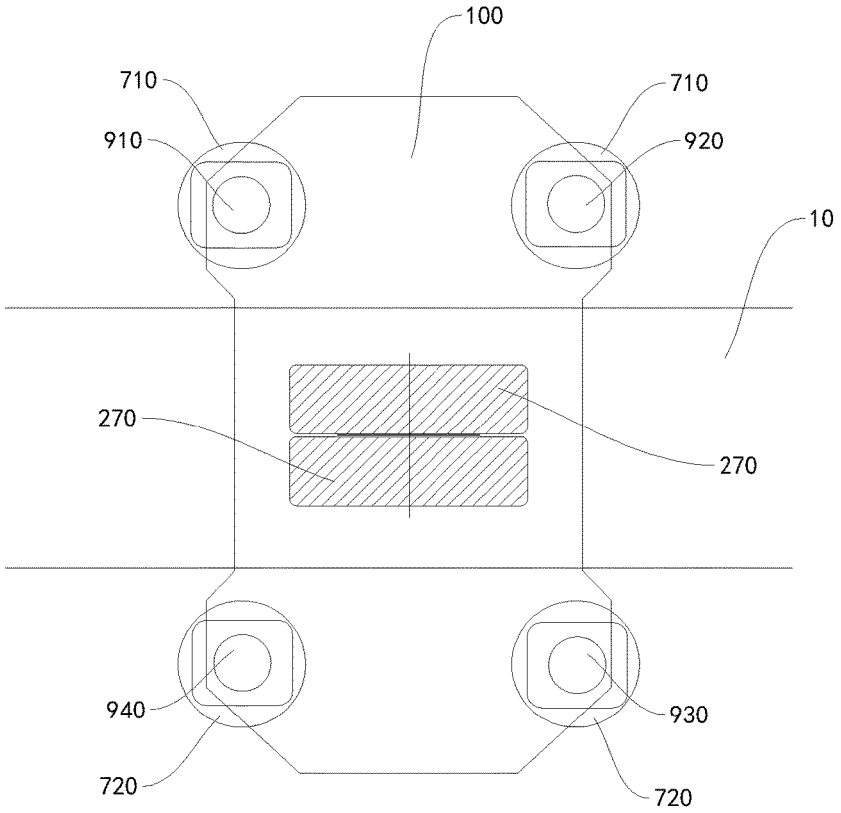
FIG. 87 is a schematic view of a bogie of a rail vehicle according to another embodiment of the present disclosure.

In some other specific embodiments of the present disclosure, as shown in FIG. 87, the bogie 21 further includes a first support suspension device 910, a second support suspension device 920, a third support suspension device 930, and a fourth support suspension device 940.

The first support suspension device 910, the second support suspension device 920, the third support suspension device 930, and the fourth support suspension device 940 are mounted on the bogie frame 100 and are connected to the vehicle body 22. The first support suspension device 910, the second support suspension device 920, the third support suspension device 930, and the fourth support suspension device 940 are respectively located in a horizontal plane at four corners of a rectangle, and the rectangle is symmetric about the center of the bogie frame 100. In other words, in a horizontal plane, after the rectangle rotates by 180° about the center of the bogie frame 100, the rectangle before the rotation and the rectangle after the rotation coincide. The first support suspension device 910, the second support suspension device 920, the third support suspension device 930, and the fourth support suspension device 940 are configured to support the vehicle body 22 and achieve an effect of shock absorption. The first support suspension device 910, the second support suspension device 920, the third support suspension device 930, and the fourth support suspension device 940 are subject to even forces and have even supporting effects, so as to improve the stability and comfort of the rail vehicle 20.

In some specific embodiments of the present disclosure, as shown in FIG. 85 to FIG. 87, two first horizontal wheels 710 exist and are spaced apart in the lengthwise direction of the steering portion 111, and two second horizontal wheels 720 exist and are spaced apart in the lengthwise direction of the steering portion 111. Central axes of the two first horizontal wheels 710 and central axes of the two second horizontal wheels 720 are respectively located in a horizontal plane at four corners of a rectangle, and the rectangle is symmetric about the center of the bogie frame 100. In other words, in the horizontal plane, after the rectangle rotates by 180° about a center of the bogie frame 100, the rectangle before the rotation and the rectangle after the rotation coincide. In this way, four horizontal wheels may be evenly arranged in the horizontal plane, thereby ensuring the stability when the horizontal wheels drive the rail vehicle 20 to make a turn and run in a straight line.

A person skilled in the art may understand that the foregoing rectangles are all assumed virtual rectangles. The rectangles are used to clearly depict an arrangement manner of the first support suspension device 910, the second support suspension device 920, the third support suspension device 930, and the fourth support suspension device 940 in a horizontal plane, and an arrangement manner of the two first horizontal wheels 710 and the two second horizontal wheels 720 a horizontal plane.

In the example shown in FIG. 87, central axes of the two first horizontal wheels 710 and central axes of the two second horizontal wheels 720 may respectively coincide with a central axis of the first support suspension device 910, a central axis of the second support suspension device 920, a central axis of the third support suspension device 930, and a central axis of the fourth support suspension device 940.

Figure 99:
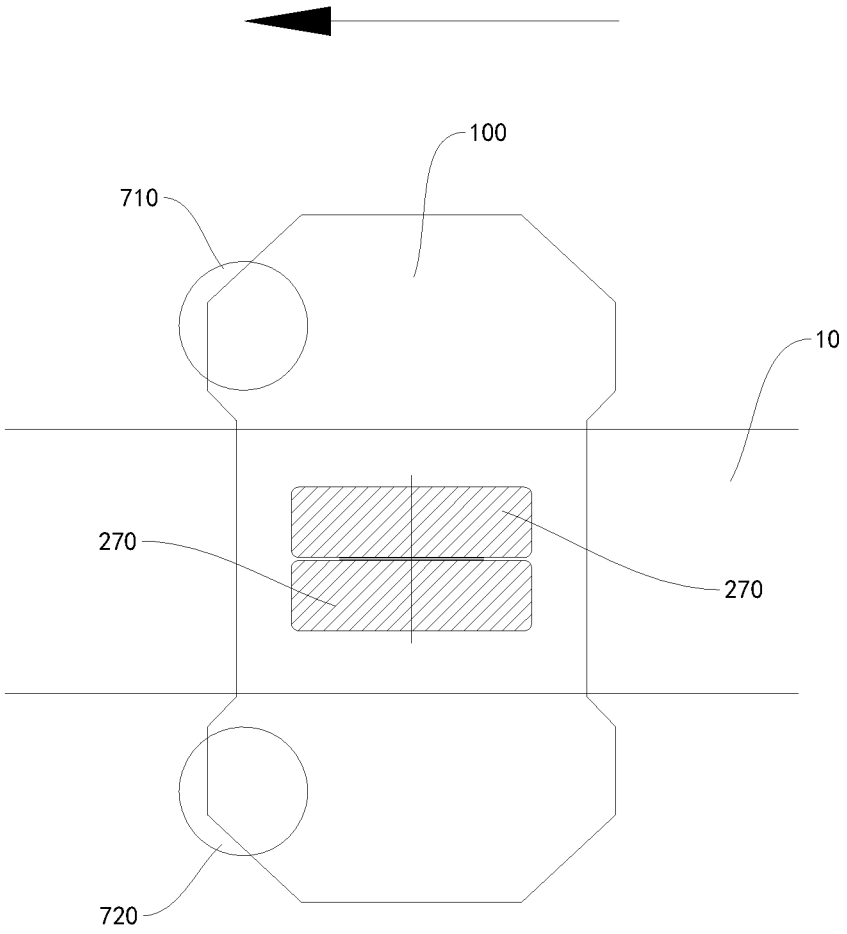
FIG. 99 is a schematic view of a bogie of a rail vehicle according to another embodiment of the present disclosure.

In some specific embodiments of the present disclosure, as shown in FIG. 99, one first horizontal wheel 710 and one second horizontal wheel 720 exist. The first horizontal wheel 710 and the second horizontal wheel 720 are spaced apart in the width direction of the rail 10. The first horizontal wheel 710 and the second horizontal wheel 720 deviate, towards a running direction of the rail vehicle 20, from the center of the bogie frame 100 in the lengthwise direction of the rail 10 (the arrow in FIG. 99 shows the running direction of the rail vehicle 20). In other words, the first horizontal wheel 710 and the second horizontal wheel 720 deviate from the center of the bogie frame 100 in the lengthwise direction of the rail 10 and deviating directions of the first horizontal wheel 710 and the second horizontal wheel 720 are consistent with the running direction of the rail vehicle 20. In a process in which the rail vehicle 20 runs, horizontal wheels on a front side in the running direction mainly exert a guiding effect. When the rail vehicle 20 makes a turn, horizontal wheels on a rear side in the running direction interferes with the bogie frame 100 to produce a side effect. Therefore, for a unidirectional rail transport system 1 or an annular rail transport system 1, the horizontal wheels on the rear side in the running direction are canceled, so that interference with the bogie frame 100 can be eliminated when the rail vehicle 20 makes a turn, the weight of the rail vehicle 20 can be reduced, and a cost of the rail vehicle 20 is reduced.

Other forms and operations of the rail transport system 1 according to this embodiment of the present disclosure are known to a person of ordinary skill in the art, and are no longer described in detail here.

In addition, a person skilled in the art may understand that single technical features in the foregoing embodiments can be combined with each other without causing any interference or contradiction.

In the description of the present disclosure, it needs to be understood that orientation or position relationships indicated by the terms "central", "longitudinal", "transverse", "length", "width", "thickness", "up", "down", "front", "rear", "left", "right", "vertical", "horizontal", "top", "bottom", "inside", "outside", "clockwise", and "counterclockwise" are orientation or position relationships that are shown based on the accompanying drawings, and are merely used for ease of description of the present disclosure and used to simplify description, but do not indicate or imply that the discussed devices or elements must have specific orientations or must be built and operated according to specific orientations, and therefore should not be construed as a limitation to the present disclosure.

In addition, the terms "first" and "second" are merely used for the purpose of description, but should not be understood as an indication or an implication of relative importance or an implicit indication of a quantity of indicated technical features. In this way, a feature that is defined by using "first" and "second" may explicitly or implicitly include one or more features. In the description of the present disclosure, the meaning of "a plurality of" is at least two, for example, two, or three, unless otherwise explicitly and specifically defined.

In the present disclosure, unless otherwise explicitly specified and defined, the terms "mount", "connected", "connect", and "fix" should be understood in a broad sense. For example, the terms may indicate a fixed connection, or a detachable connection, or integration; the terms may indicate a mechanical connection, or an electrical connection; and the terms may indicate a direct connection, or an indirect connection through an intermediate medium, or a connection inside two elements or a mutual effect relationship between two elements. For a person of ordinary skill in the art, specific meanings of the foregoing terms in the present disclosure may be understood according to specific cases.

In the description of this specification, the description of reference terms "an embodiment", "some embodiments", "an example", "a specific example", or "some examples" refers to that specific features, structures, materials or characteristics that are described in combination with the embodiments or examples are included in at least one embodiment or example of the present disclosure. In this specification, the illustrative description of the foregoing terms is not required to be about a same embodiment or example. Moreover, the described specific features, structures, materials or characteristics may be combined in a suitable manner in any one or more embodiments or examples. In addition, a person skilled in the art may join and combine different embodiments or examples described in this specification.

Although the embodiments of the present disclosure are shown and described above, it may be understood that the foregoing embodiments are exemplary and should not be construed as a limitation to the present disclosure. A person of ordinary skill in the art can make changes, modifications, replacements, and variations to the foregoing embodiments within the scope of the present disclosure.

What is claimed is:

1. A rail transport system, comprising:

a rail with a first concave portion built thereon; and a rail vehicle comprising a bogie and a vehicle body, wherein the bogie has a second concave portion for straddling the rail, the bogie movably straddles the rail, and the vehicle body is connected to the bogie and is pulled by the bogie to move along the rail, and wherein the bogie comprises:

a bogie frame, the second concave portion being disposed inside the bogie frame; and a first running wheel and a second running wheel, the first running wheel and the second running wheel being pivotably mounted on the bogie frame and being disposed coaxially and spaced apart, the first running wheel being fit on an upper surface of a first track beam of the rail, and the second running wheel being fit on an upper surface of a second track beam of the rail;

a first horizontal wheel being pivotably mounted on the bogie frame and being fit on a side surface of the first track beam, and a second horizontal wheel being pivotably mounted on the bogie frame and being fit on a side surface of the second track beam;

a first horizontal safety wheel moving synchronously with the first horizontal wheel and being connected to the first horizontal wheel, and a second horizontal safety wheel moving synchronously with the second horizontal wheel and being connected to the second horizontal wheel, wherein an external diameter of the first horizontal safety wheel is less than an external diameter of the first horizontal wheel, and an external diameter of the second horizontal safety wheel is less than an external diameter of the second horizontal wheel; and a driving device mounted on the bogie frame, wherein when the driving device is located between the first running wheel and the second running wheel, the first running wheel and the second running wheel are driven by the driving device.

2. The rail transport system according to claim 1, wherein the first concave portion is configured to be an escape passage.

3. The rail transport system according to claim 1, wherein the vehicle body comprises a plurality of carriages that are sequentially hinged in a lengthwise direction of the rail and an emergency door that can be opened and closed, and the emergency door is disposed on a surface, opposite to an adjacent carriage, of a carriage that is located at at least one end of the vehicle body in the lengthwise direction of the rail; and wherein the emergency door comprises a first end and a second end, the first end of the emergency door is pivotably mounted on the corresponding carriage, and the second end of the emergency door slants downwards and is inserted in an escape passage when the emergency door is open.

4. The rail transport system according to claim 3, wherein a slideway is disposed on an inner surface of the emergency door.

5. The rail transport system according to claim 1, wherein the vehicle body comprises a plurality of carriages that are sequentially hinged in a lengthwise direction of the rail and an emergency door that can be opened and closed, and the emergency door is disposed on a surface, opposite to an adjacent carriage, of a carriage that is located at at least one end of the vehicle body in the lengthwise direction of the rail;

wherein the vehicle body further comprises an emergency exit and a cover plate; and wherein the emergency exit is disposed on an inner floor of the carriage that is located at the at least one end, and the cover plate is linked with the emergency door and disposed on the inner floor of the carriage that is located at the at least one end to enable the cover plate to open and close the emergency exit.

6. The rail transport system according to claim 5, wherein the emergency exit has an escape ladder connected to an escape passage; and the vehicle body further comprises a telescopic driving device configured to drive the escape ladder to extend or retract.

7. The rail transport system according to claim 1, wherein:

the first track beam is spaced apart from the second track beam; and the rail further comprises a bearing floor, the bearing floor being disposed between the first track beam and the second track beam and connected to the first track beam and the second track beam.

8. The rail transport system according to claim 7, wherein the bearing floor comprises:

a connecting beam, two ends of the connecting beam being respectively connected to the first track beam and the second track beam;

a support frame, the support frame being mounted on the connecting beam; and a support plate, the support plate being connected on the support frame and being supported by the support frame.

9. The rail transport system according to claim 8, wherein the support plate is spaced apart from at least one of the first track beam and the second track beam in a horizontal direction.

10. The rail transport system according to claim 7, wherein the bearing floor comprises a plurality of connecting beams spaced apart in the lengthwise direction of the rail, and a plurality of support plates sequentially connected in the lengthwise direction of the rail.

11. The rail transport system according to claim 7, wherein the rail further comprises an anti-falling edge; and wherein the anti-falling edge is disposed at at least one of an upper end and a lower end of at least one of the first track beam and the second track beam, and the anti-falling edge extends outwards horizontally and is configured to prevent the bogie from falling out of the rail.

12. The rail transport system according to claim 1, wherein the bogie further comprises:

a third running wheel and a fourth running wheel, the third running wheel and the fourth running wheel being pivotably mounted on the bogie frame and being disposed coaxially and spaced apart, the third running wheel being fit on the upper surface of the first track beam and being spaced apart from the first running wheel in a lengthwise direction of the first track beam, and the fourth running wheel being fit on the upper surface of the second track beam and being spaced apart from the second running wheel in a lengthwise direction of the second track beam; and when the driving device is located between the third running wheel and the fourth running wheel, the third running wheel and the fourth running wheel are driven by the driving device.

13. The rail transport system according to claim 12, wherein the first running wheel and the second running wheel are connected through a first connecting shaft; the third running wheel and the fourth running wheel are connected through a second connecting shaft; and the driving device has a first transmission connection to one of the first connecting shaft and the second connecting shaft and a second transmission connection to the other one of the first connecting shaft and the second connecting shaft.

14. The rail transport system according to claim 1, wherein the first horizontal wheel is fit on an outside surface of the first track beam; and the second horizontal wheel is fit on an outside surface of the second track beam.

15. The rail transport system according to claim 1, wherein the first horizontal wheel is fit on an inside surface of the first track beam; and the second horizontal wheel is fit on an inside surface of the second track beam.

16. The rail transport system according to claim 15, wherein the first horizontal wheel and the second horizontal wheel are located at different heights in an up-down direction.

17. The rail transport system according to claim 1, further comprises:

a plurality of first horizontal wheels fit on an inside surface and an outside surface of the first track beam respectively; and a plurality of second horizontal wheels fit on an inside surface and an outside surface of the second track beam respectively.

* * * * *